US005745947A

United States Patent [19]

Liu et al.

[11] Patent Number: 5,745,947

[45] Date of Patent: May 5, 1998

[54] AUTOMATIC DEBRIS RETRIEVAL SYSTEM

[75] Inventors: Kaibai Liu, Eagan; Charles Carl Holley, Bloomington; Walter John Petersen, Eden Prairie, all of Minn.

[73] Assignee: The Toro Company, Bloomington, Minn.

[21] Appl. No.: 593,106

[22] Filed: Jan. 30, 1996

[51] Int. Cl.[6] ..... E01H 1/04

[52] U.S. Cl. ..... 15/84; 15/82; 56/328.1; 414/502; 414/528

[58] Field of Search ..... 15/78, 80–87; 56/14.5, 328.1, DIG. 12; 414/502, 528

[56] References Cited

U.S. PATENT DOCUMENTS

| | | | |
|---|---|---|---|
| 542,808 | 7/1895 | Reagan | 15/84 |
| 703,194 | 6/1902 | Hansbury | 15/84 |
| 1,000,798 | 8/1911 | Gregory | 15/84 |
| 2,514,945 | 7/1950 | Fortier | 15/84 X |
| 2,701,889 | 2/1955 | Riddell | 15/82 X |
| 3,802,022 | 4/1974 | Fleming | 56/328.1 X |
| 3,927,780 | 12/1975 | Dearlove | 414/502 |
| 4,199,923 | 4/1980 | Blake | 56/14.5 |
| 4,965,993 | 10/1990 | Butler et al. | 56/14.5 X |
| 5,247,717 | 9/1993 | Smith | 15/82 X |
| 5,577,286 | 11/1996 | Smith et al. | 15/84 |
| 5,596,784 | 1/1997 | Tolmachoff | 15/83 |

FOREIGN PATENT DOCUMENTS

| | | | |
|---|---|---|---|
| 2446056 | 9/1980 | France | 56/14.5 |
| 4236030 | 4/1994 | Germany | 15/78 |
| 5-76235 | 3/1993 | Japan | 56/14.5 |
| 685546 | 1/1953 | United Kingdom | 15/84 |
| 2173684 | 10/1986 | United Kingdom | 56/328.1 |

*Primary Examiner*—Mark Spisich

*Attorney, Agent, or Firm*—David George Johnson

[57] ABSTRACT

A debris collection vehicle (1) having an offset cab (12) adjacent to a conveyor belt (61) which transports collected debris to a hopper (59). Rows of resilient fingers (51) are mounted on a collector drum (36), the conveyor (61) and on curb brushes (22, 24). The orientation of the collector (36) may be varied with respect to the lower drum (57) supporting the conveyor belt (61) in order to permit the reliable entrainment of various sized and shaped objects without fouling. The collector drum (36) is biased by a spring (192) to facilitate clearance of obstacles or oversized debris. A front deflection bar (229) is mounted adjacent to the collector drum (36) to direct debris toward the lower support (56) of the conveyor belt (61). A rear deflection bar (239) is mounted adjacent to the lower conveyor support (56) to direct debris toward the upper surface of the conveyor belt (61). The lower region (387) of the conveyor belt (61) may also be supported by a forward axle (401) and a tandem rear axle (402) to provide a volume (391) within which uncollected debris is urged toward a collector drum (368). The upper region (349) of a modified conveyor belt (347) is constructed to transition to a horizontal orientation to facilitate delivery to a hopper (350). The hopper (350) is connected to an hydraulic lift assembly (292) to permit elevation and emptying of the hopper (350) at a suitable collection site.

13 Claims, 51 Drawing Sheets

AUTOMATIC DEBRIS RETRIEVAL SYSTEM

BACKGROUND OF THE INVENTION

1. Field of the Invention

The present invention is directed generally to the field of highway litter collection or pick up devices, and specifically to an apparatus that is capable of retrieving a variety of litter, solid refuse, traffic cones and roadside debris while the apparatus is in continuous forward motion.

2. Description of Related Art

A common type of litter collecting device typically includes a single pick up roller or drum rotatably supported on a frame which is movable over the ground. Resilient fingers project from the rollers to entrap litter therebetween during rotary contact with the ground. The entrapped litter is then lifted from the ground by the fingers as the drum rotates. A fundamental example of such a device is disclosed in U.S. Pat. No. 3,746,099, in which a single roller is towed over the ground. The trapped litter is passed through a rake which strips the litter and permits it to fall by gravity into a hopper. A similar device is disclosed in U.S. Pat. No. 3,849,824, issued to Doering and intended for picking up lawn debris. This device utilizes a rotating drum having projecting wires that pass between stripper bars so as to collect grass clippings and leaves which are then passed to a series of compactor blades.

A final example of this technology is disclosed in U.S. Pat. No. 4,214,336, issued to Peterson. The Peterson device is towed behind a truck and includes three rollers positioned abreast so as to cover substantially the entire width of the vehicle. An inclined, semielliptical plate is positioned in front of the rollers so as to capture debris thrown forward by the rollers. Eventually, this material passes in front of the central roller which transfers it to an inclined conveyor leading into the rear of the parent vehicle. A major drawback of this design is its limitation to small items having a particular range of densities that would permit them to land in and be confined by the collection plate. Further, all debris is first driven over by the parent vehicle before encountering the collection drums, such that the entire collection operation occurs behind and out of sight of the vehicle operator.

The next evolutionary step in automated litter collection has been to utilize a smaller, elevated brush roller downstream from the pick up roller to remove and transfer trapped litter from the fingers for discharge into a trash bin carried by the frame. An example of such a device is disclosed in U.S. Pat. No. 3,923,101. While the latter device is somewhat effective to remove certain types and quantities of litter scattered over relatively large areas, the rotating pick up fingers often fail to initially engage or retain entrapped litter for subsequent removal by the elevated brush roller. Consequently, substantial quantities of litter remain on the ground. Additionally, substantial quantities of litter lifted by the fingers are often ejected back onto the ground by the rotating brush roller.

Another type of litter collecting apparatus utilizes a tandem pair of identical, oppositely rotating rollers, as disclosed in U.S. Pat. No. 2,916,753, issued to Redpath et al. Each roller supports respectively intermeshing plural fingers engageable with the ground. This type of prior art apparatus tends to lift greater quantities of litter from the ground than the single roller/elevated brush arrangement discussed above, since litter not grasped by the front roller fingers is usually lifted by the rear roller fingers.

To transfer litter to a downstream conveyor for discharge in a rear trash bin, Redpath et al. uses plural elevated, fingered rollers meshing with front and rear fingered, ground level rollers. The elevated and ground level rollers convey litter downstream along an arcuate transfer path above the ground level rollers. Difficulties are encountered, however, in maintaining precise control over transfer of litter entrapped between the fingers of the ground level rollers. Specifically, there is a tendency for the elevated rollers to redeposit entrapped litter onto the ground since the fingers cannot maintain positive control over all types of litter for movement to the conveyor within the same transfer path. Also, since the rollers are designed to yield to uneven terrain, the opportunity to pass over litter is increased. In addition to these drawbacks, the equipment is complex and cumbersome, thereby increasing production and maintenance costs.

An even more ambitious device is disclosed in U.S. Pat. No. 3,777,327, issued to Ellis. The Ellis device includes a windrowing apparatus consisting of two side mounted augers followed by a single pickup roller. A series of conveyors and augers transports and sorts the collected material, some of which is directed to an onboard hammermill. The Ellis device is intended primarily for collecting small, readily deformable agricultural waste and is intended to be towed by a tractor moving at relatively low speeds. The density of material collected aids significantly in the function of the Ellis device, which is not well suited for collecting larger items, such as traffic cones, that should not be damaged during collection.

A similar agricultural device is disclosed in U.S. Pat. No. 3,872,657, issued to Ramacher, et al., which is intended for harvesting almonds and other nuts, as well as fruits such as oranges. The Ramacher et al. harvester utilizes a forwardly mounted pickup roller bearing rubber fingers followed by a synchronized collection roller that transfers the material to a first inclined conveyor. The conveyor discharges into a large fan that separates the heavier, desired materials and deposits them onto a second inclined conveyor that discharges into a separate hopper towed behind or following the main vehicle. The resultant machine is quite long and is adapted to pick up only relatively small items. Further, this vehicle is not roadworthy and is not capable of handling the wide variety of materials that would be encountered in a roadway debris collection application. The lack of onboard storage is a further drawback, as is the requirement of a casing or shroud around much of the vehicle, since a substantial portion of the post entrainment transport function is accomplished by the movement of air. In order for the harvesting function to be performed, the material must be moved at a "very substantial velocity" within the shrouded region, which would be an undesirable condition in the collection of many types of litter. The required synchronization between the pickup and collection rollers adds another degree of undesirable complexity.

A multiple conveyor device intended for dedicated roadway use is disclosed in U.S. Pat. No. 4,290,820, which includes a pair of forward curb brushes and a central pick up drum which leads to a first conveyor. A pair of intermediate curb brushes precede a second sweeper drum which directs material forwardly toward a second, steeply inclined conveyor. The second conveyor discharges onto the first conveyor, the first conveyor extending well beyond the rear of the vehicle frame so as to permit the debris to be deposited into a trailing or towed hopper. This device is primarily intended for particulate material, but is not shrouded due to height limitations, resulting in the redistribution onto the street of some of the collected material. Further, the steepness of the second conveyor requires that it be operated at an extremely high velocity which necessarily promotes high wear in a particulate environment. The lack of onboard storage space results in a vehicle of excessive length. The first conveyor is at least twenty feet in length and is at its lowest point only a few inches above the road surface. The mechanical, structural and maintenance requirements of such a conveyor are substantial. Since this vehicle is intended primarily for collecting particulate material, the throat clearance between the pick up drum and the conveyor is only a few inches, making this vehicle totally unsuitable for entraining the larger types of debris that are so frequently encountered on a roadway surface.

In all of these machines, the transfer of the collected litter from the collector to the storage bin involves a number of discrete handling steps in which the litter goes from one location to another between the ground and the storage bin. However, each time that a piece of litter must be handled by a separate piece or structure in the machine there exists an opportunity in which the overall collecting efficiency of the machine can be reduced. For example, when a transfer of litter between two relatively moving machine elements is required, it is always possible that flexible types of litter such as cardboard cartons or paper wrappers can become jammed between the two elements. Rather than being transferred from one element to the other, the litter may be returned to the ground or require stoppage of the machine to clear the obstruction. In another type of entrainment action, collected litter may be allowed to freely drop from one type of handling apparatus into another. For example, it may fall from a collecting roller into a trap area where it is picked up by a subsequent handling device. In such situations, it is entirely possible that litter such as a glass bottle or the like may break as it falls into the trap area, allowing the smaller pieces to drop through spaces in the machine and return to the ground.

U.S. Pat. No. 3,993,141, issued to Donahue, employs a relatively simple collecting concept that does not involve numerous handling steps in transferring the litter from the collecting device to the storage bin. However, the basic collecting device itself is too simple in concept, comprising a series of relatively rigid rods mounted on a shaft and adapted to picking up only certain types of litter or litter of certain sizes that is capable of being wedged between the rods.

In an effort to provide a yielding, yet rigid, rod in a collection device, U.S. Pat. No. 3,802,022, issued to Fleming, uses a spring steel rod having a coil spring base. The pickup roller so disclosed uses a narrow throat having a tight fitting shroud which can be aimed and manipulated by the vehicle operator. The small cross section of the pickup head limits the size of debris which can be entrained. Further, a substantial portion of the roadway width cannot be covered by the narrow pickup head, nor can debris directly in front of the vehicle be entrained since the movable boom/conveyor system is mounted to the side of an existing van. Although the resultant vehicle is wider than a standard truck, the size of the pickup swath is much narrower than the width of a conventional automobile. U.S. Pat. No. 4,550,465, issued to Chrisley, utilizes a plurality of flexible fingers to collect litter, the fingers being subject to wear, thus reducing their effectiveness. The fingers in such prior art machines are difficult to replace, and their circular cross section tends to deflect rather than entrain at least some portion of the debris.

U.S. Pat. No. 5,247,717, issued to Smith, also utilizes flexible fingers arranged on opposed conveyors to lift debris entrained by a pair of ground engaging rollers. The fingers overlap so as to increase the probability of entraining and transferring a high percentage of the litter, and the multiple conveyor scheme reduces the horizontal length of the litter collecting apparatus, leaving a greater length available for the collection hopper for a vehicle of a given size. However, the intermeshed fingers require a controlled timing sequence among the various rollers that prevents rapid variations in conveyor and collector speeds. Further, certain types of litter, such as blankets or carpeting, tend to become entangled in the intermeshed fingers which define a relatively tortuous path for the entrained litter. The intermeshing of the fingers and the spacing of the opposed conveyors imposes a finite limit on the size of the debris which may be transported through the space in between the conveyors. Although the collection bin is potentially enlarged, there is no mechanism to insure that substantially the entire volume of the bin will be filled before the proximity of the collected debris to the conveyors will preclude further debris entrainment. Finally, the length of the vehicle is such that the collection bin is necessarily behind the rearmost wheels of the vehicle, resulting in wide center of gravity variations and undesirable low frequency undamped resonant oscillations of the entire vehicle at certain, unpredictable speeds.

In summary, previously developed litter collecting machines have not solved the problem of collecting the wide variety of litter that is commonly found on highways. In particular, the previous devices have been subject to incomplete litter collection, jamming and fouling of collection elements, poor utilization of the available collection bin volume, limitations on the size and shape of the debris which can be entrained and an inability to operate while in motion at any substantial forward velocity. The lack of reliability of prior art debris pick up devices has caused most public safety departments with responsibility for high speed limited access highways to routinely block traffic in all lanes in anticipation of debris removal by a stationary vehicle assisted by pedestrian personnel. This practice is inherently dangerous, slow and labor intensive.

SUMMARY OF THE INVENTION

The present invention addresses some of the problems associated with litter collection in a highway environment. An ideal highway litter collection device should be able to pick up a wide variety of large and small objects that are potential hazards to vehicular traffic. These commonly include such diverse items as dead animals, automotive mufflers, boxes, newspaper, carpets, mattresses and bottles. Further, the collection should be accomplished at as rapid a forward velocity as possible by a single vehicle which does not disrupt traffic flow and which can be operated without assistance by one person. The collection bin on the vehicle should be able to accommodate enough debris such that the bin does not need to be emptied more than twice a day, thereby permitting, for example, the vehicle operator to make all required pickups without interruption until the normal lunch break, at which time the bin may be conveniently emptied. The collection device should be simple enough in design and construction so that fouling, jamming and maintenance are minimized. Finally, the operator's position within the vehicle should provide a view of the collected debris as it encounters the collection and conveying mechanisms of the device.

Accordingly, the present invention includes only a single collection roller and either one or two conveyors, each driven independently by a separate hydraulic motor. In an alternate embodiment, the collection roller is followed by a rear finger roller. The collection roller includes multiple rows of flexible paddles which are, in one embodiment, laterally offset from, but radially overlapping with, rows of substantially identical flexible paddles mounted on the conveyor. Since the paddles of the collection roller are offset laterally from the paddles of the conveyor, there is no need to provide for a timing sequence to synchronize their relative rotations. Further, the conveyor(s) and collector can be operated at different, nonintegrally related speeds, which offers the advantage that the paddles from the collector and conveyor will form a substantially continuous surface for entraining and lifting debris for portions of each complete revolution of the collector roller. Operation of the conveyor (s) at a somewhat higher speed than the collector roller also offers the advantage of greater debris entrainment.

In a second embodiment, the fingers of the collector roller and the conveyor are permitted to overlap in a variety of ways. The spacing and relative elevations of the collector drum and the lower conveyor spindle are controlled by a hydraulic ram. Further, a pivoting mounting arrangement permits the collector roller to be elevated above the lower conveyor spindle. This arrangement permits both a variation in the throat size encountered by the debris to be entrained, as well as varying the height of debris above a street surface that may be successfully entrained by the device.

The flexible paddles employed in the present invention are tapered, having a relatively wide base region and a narrow tip portion. The paddles are also formed so as to have a substantially rectangular cross section. The small clearance between the paddles of the conveyor and the paddles of the collector rollers at their point of closest contact has the added effect of entraining a substantial amount of air and urging it toward the collection hopper, which has the benefit of transporting small or lightweight debris into the hopper.

The conveyor(s) are inclined at angles in the range of forty five degrees to twenty degrees and have lengths varying between two and one half feet to five feet. The collection hopper is located to the rear of the vehicle operator. The conveyor(s) are at least partially in front of or beside the vehicle operator. The collector roller is entirely in front of the vehicle operator, permitting an accurate assessment by the operator of the success of debris collection and entrainment for a given combination of vehicle and collector/conveyor speeds.

Additionally, the collection bin or hopper of the present invention can be hydraulically elevated up to ten feet, permitting unloading of the bin at a variety of collection facilities by a single operator. The collection bin is well to the rear of the vehicle operator, and is adaptable to either a mid or rear engine vehicle configuration.

In one embodiment, the collection roller is spring biased toward the conveyor, thereby permitting the collection roller to deflect forwardly or upwardly in response to the presence of unusually large articles and thus increase the maximum dimension of the passageway or path defined by the space between the collector and conveyor. Also, the collector roller is supported or suspended along a vertical axis such that the downward force exerted by the collector roller on an item to be entrained is substantially less than the weight of the collector roller, thereby permitting the collector roller to climb or travel over the article. This "walk over" motion of the collector simplifies the entrainment of larger articles which can be more readily collected by the action of the conveyor alone.

Finally, two novel curb brush designs are disclosed, each using the flexible rubber paddles of the conveyor(s) and collectors.

DETAILED DESCRIPTION OF PREFERRED EMBODIMENTS

General Layout of the Device

Figure 1:
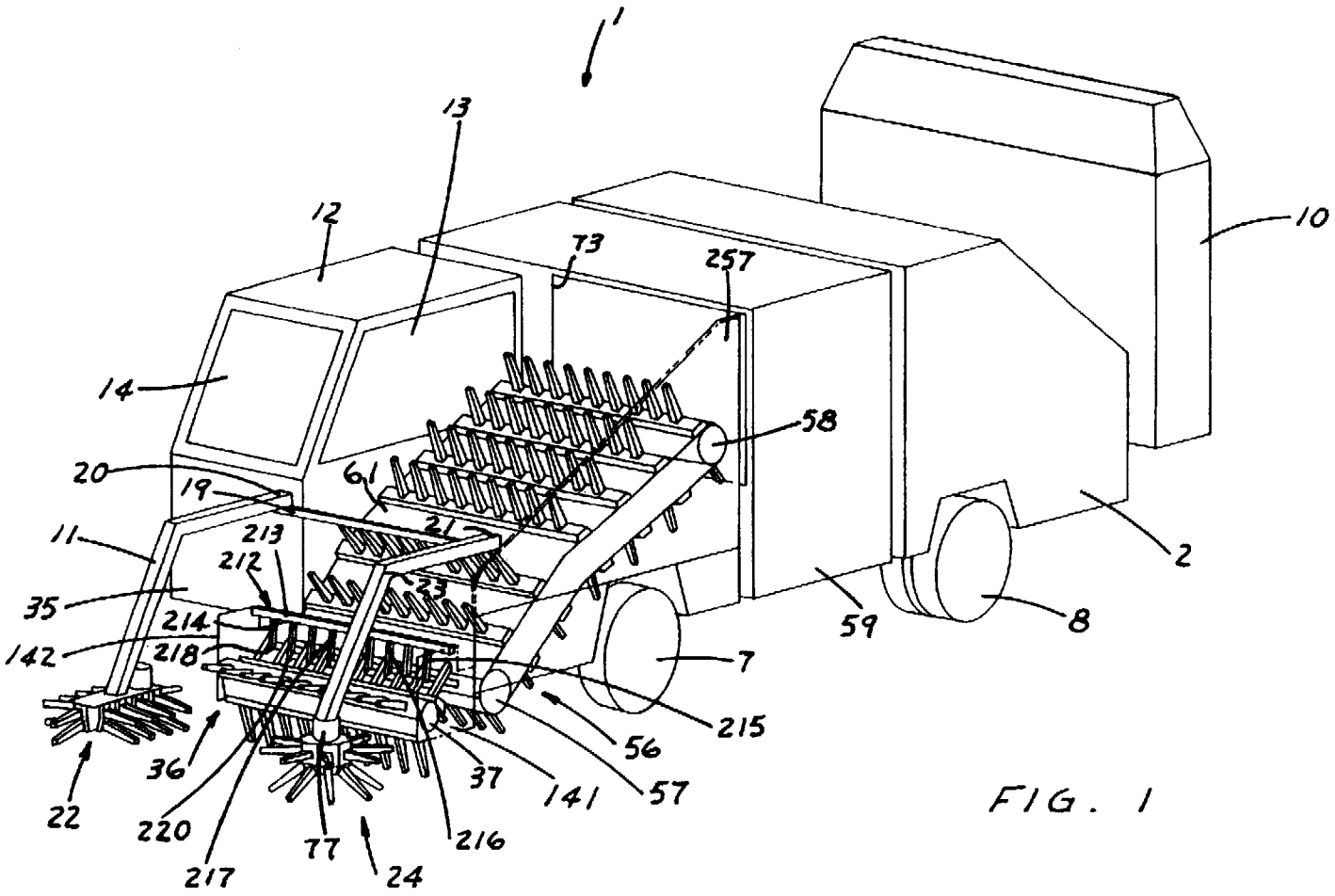
FIG. 1 is a perspective view of a debris collection vehicle constructed according to the principles of the present invention.
Figure 2:
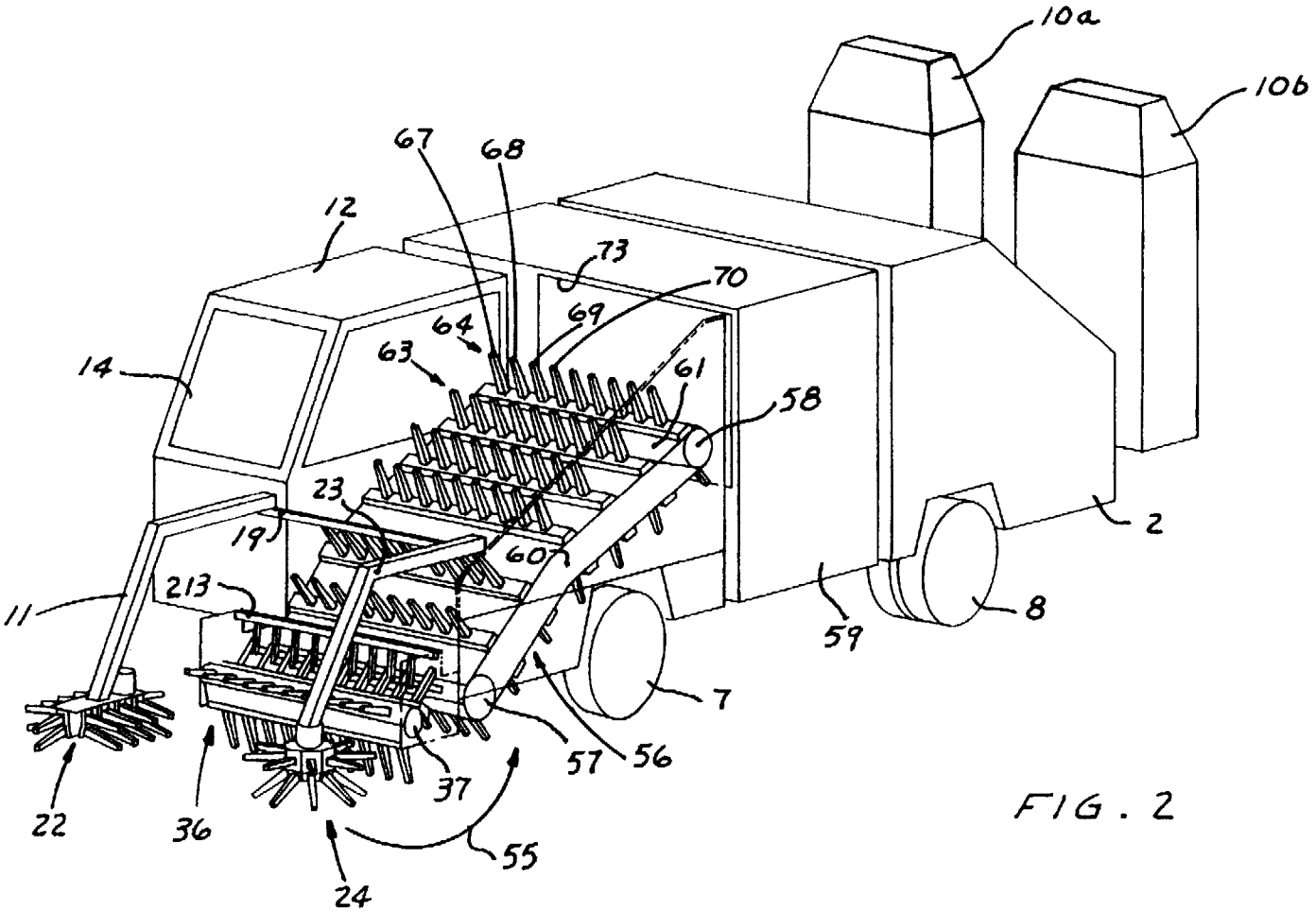
FIG. 2 is a perspective view of the debris collection device of FIG. 1 showing the presence of debris shields as shaded partitions.
Figure 5:
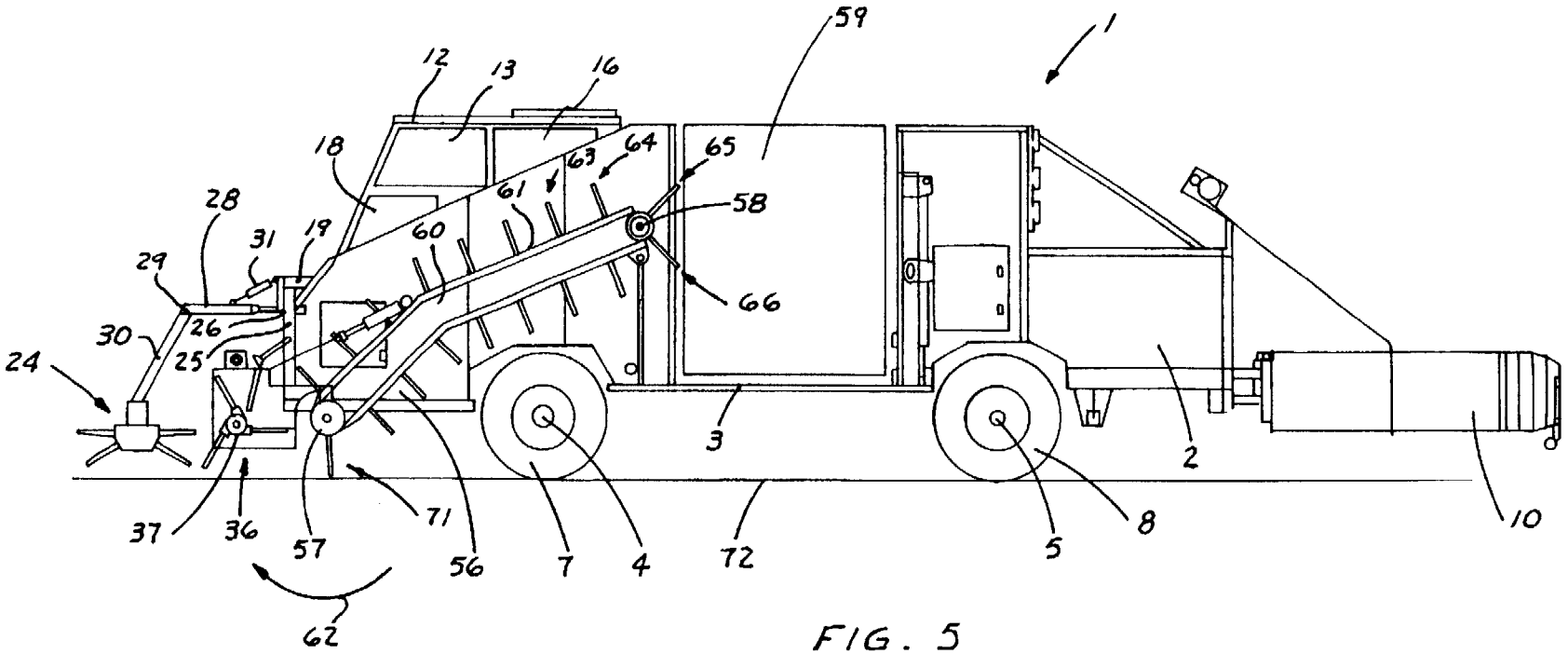
FIG. 5 is a left side elevation of the vehicle depicted in FIG. 1, with the attenuator shown in a deployed position.
Figure 6:
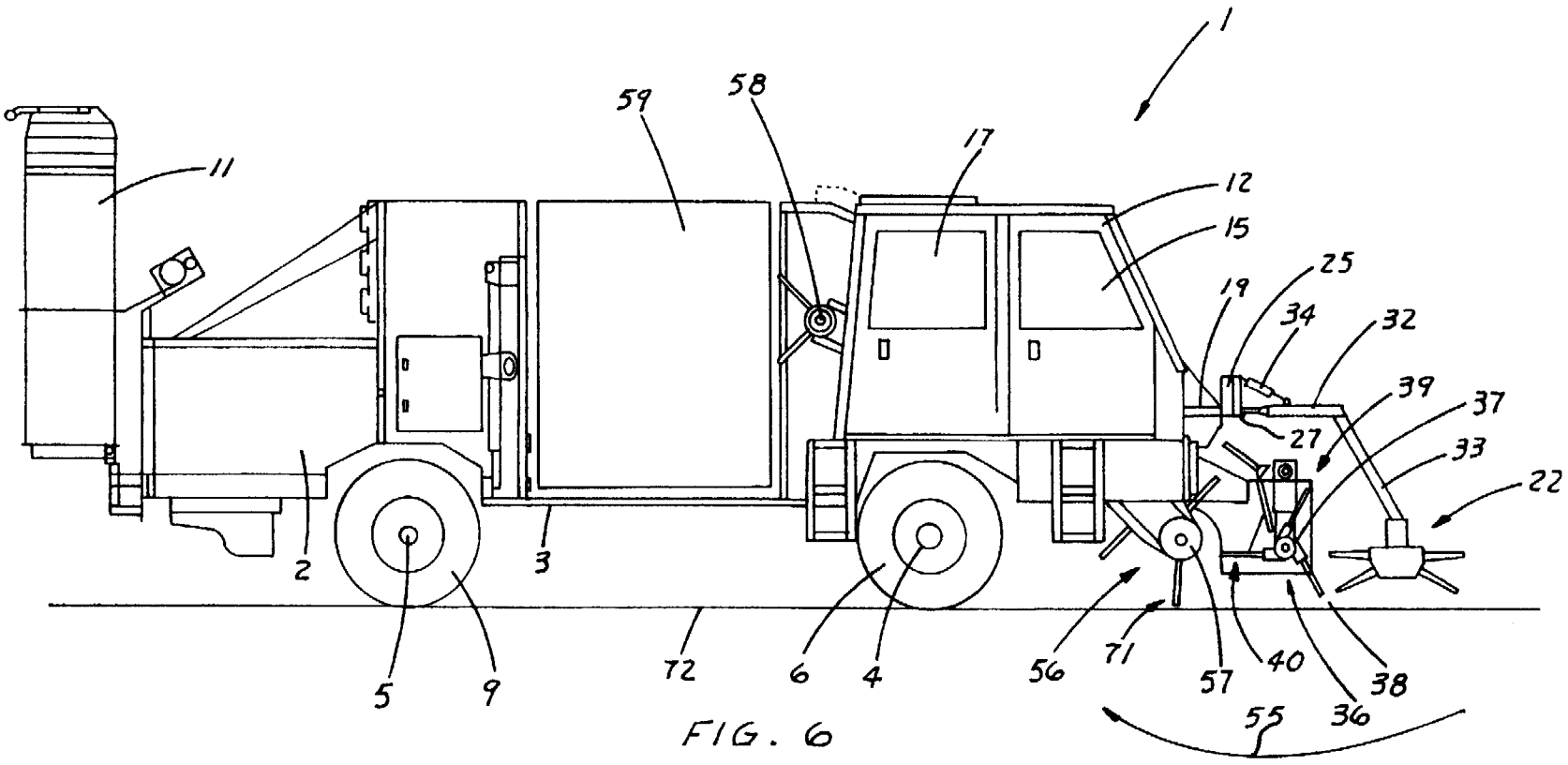
FIG. 6 is a right side elevation of the vehicle depicted in FIG. 1, with the attenuator shown in a transport position.
Figure 9:
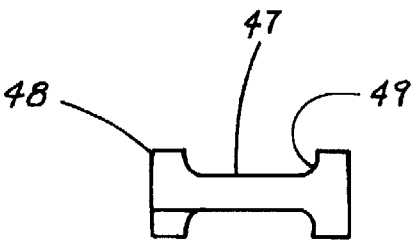
FIG. 9 is a front elevation of the debris collection finger depicted in FIG. 7.
Figure 7:
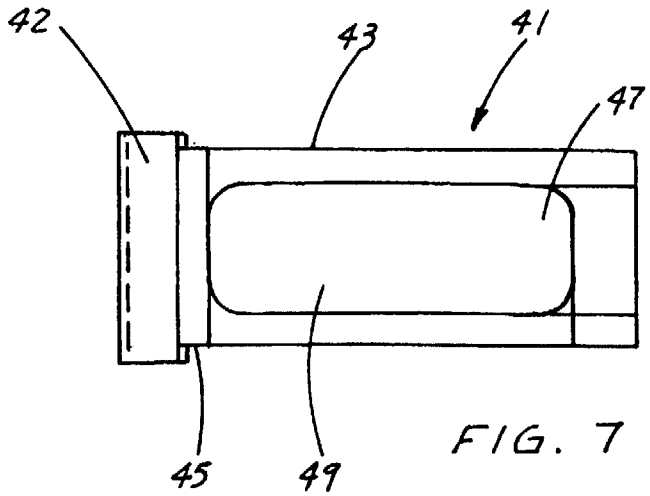
FIG. 7 is a top plan view of a debris collection finger utilized by the vehicle depicted in FIG. 1.
Figure 8:
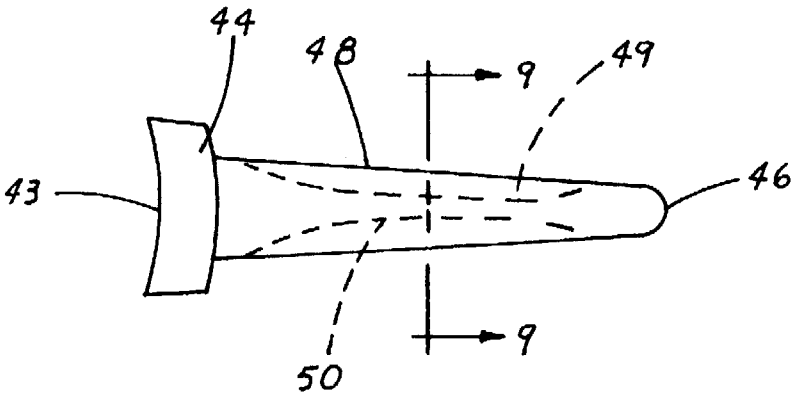
FIG. 8 is a side elevation of the debris collection finger depicted in FIG. 7.

Referring to FIGS. 1, 5 and 6, one embodiment of a debris collection vehicle constructed according to the principles of the present invention is shown generally at 1. The vehicle 1 includes a frame 3 supported by a front axle 4 and a rear axle 5. Front axle 4 supports front tires 6 and 7, while the rear axle 5 includes tandem tire assemblies 8 and 9. The vehicle 1 includes a rearwardly disposed engine compartment 2 having sufficient power to propel the vehicle 1 at highway speeds while also energizing the various hydraulic systems present in the vehicle 1. Mounted at the rear of vehicle 1 is a shock absorbing attenuator 10 designed to minimize damage to vehicle 1 in the case of a rear end collision. In FIG. 1, the verical position of the attenuator 10 will enable the vehicle 1 to be parked in a parking lot or transported with a compacted size in normal highway traffic. In FIG. 5, the attenuator 10 is shown in its deployed position, which would be appropriate if the vehicle 1 was in a debris collection mode and hence possibly being operated at a forward speed substantially less than that of the surrounding traffic. As seen in FIG. 2, the attenuator 10 may also consist of two discrete units 10*a* and 10*b*.

The operators of vehicle 1 is seated in cab 12 which includes left side windows 13, 16 and 18, a forwardly facing windshield 14 and right side windows 15 and 17. The cab 12 includes two seats arranged in tandem, as well as the normal vehicle operator controls such as a steering wheel, brakes, etc. In some instances, a single operator will be capable of both driving the vehicle 1 and manipulating the systems required to collect debris, especially in the so called "hot lane" area. In those cases, the single operator will sit in the forward cab position adjacent to windows 13 and 15. In other situations, a second operator or supervisor may be needed, in which case the second operator is seated in the rearward cab position adjacent to windows 16 and 17.

Adjacent to cab 12 is a horizontal frame member 19 which is rigidly bonded to vehicle frame 3. In the embodiment shown in FIG. 1, the frame 19 serves as a platform into which rotatable pins 20 and 21 reside. The right pin 20 pivotably supports arm 11 to which is attached right side curb brush 22. The left pin 21 pivotably supports arm 23 to which is attached left side curb brush 24. In a second embodiment shown in FIGS. 5 and 6, the frame member 19 supports a vertical post 25 to which is attached left pivoting joint 26 and right pivoting joint 27. A left horizontal member 28 extends outwardly from the post 25 and terminates at joint 29, to which is attached left brush support member 30. A first hydraulic ram 31 extending between post 25 and horizontal member 28 permits the left curb brush 24 to be manipulated in a vertical direction. Similarly, a right horizontal member 32 pivots about joint 27 and supports right curb brush support member 33. A second hydraulic ram 34 extends between post 25 and horizontal member 32, thereby permitting vertical movement of right curb brush 22.

Located immediately in front of the forward surface 35 of cab 12 is a collector drum or roller assembly 36. The collector 36 is formed as a cylinder 37 having a diameter of approximately one foot and a length of approximately five feet. Mounted onto the surface of the collector cylinder 37 are three rows 38, 39 and 40 of collection fingers. As best seen in FIGS. 7, 8, 9, 10 and 11, the fingers can take several forms. The finger 41 is formed to include a concave base 42 having a width of approximately 2.5 inches and a length of approximately 3.5 inches. The average height of the base 42 is approximately 0.875 inch.

The base 42 includes a concave bottom surface 43 which has a radius of curvature of approximately 5.0625 inches, while the convex upper surface 44 has a radius of curvature of approximately 6.5625 inches. The curvature permits base 42 to snugly abut the surface of collector drum cylinder 37 when the finger 41 is mounted on the cylinder 37. Extending from base 42 is an elongated body portion 43 having a relatively wide lower region 45 that gradually tapers to a rounded tip region 46. The tip 46 has a radius of approximately 0.375 inch and a width of approximately three inches. The body 43 is of substantially uniform width over its entire length, but the thickness varies from approximately 1.5 inches at the region joining base 42 to a minimum of approximately 0.75 at the transition immediately before the radiused tip 46.

The finger body portion 43 further includes a central region 47 which is of reduced thickness as compared to the outer edge 48. The reduced thickness of region 47 creates two opposing cavities 49 and 50 between the lower region 45 and the tip 46. The length of each cavity is approximately 5.6875 inches and the width is approximately two inches. The finger 41 is integrally molded from natural rubber having a durometer in the range of 75–78. The cavities 49 and 50 help in entraining debris which might otherwise be deflected away from the outer surface of the finger 41. Being relatively wide and short, finger 41 is relatively stiffer and is thus better suited for picking up heavier debris.

Figure 10:
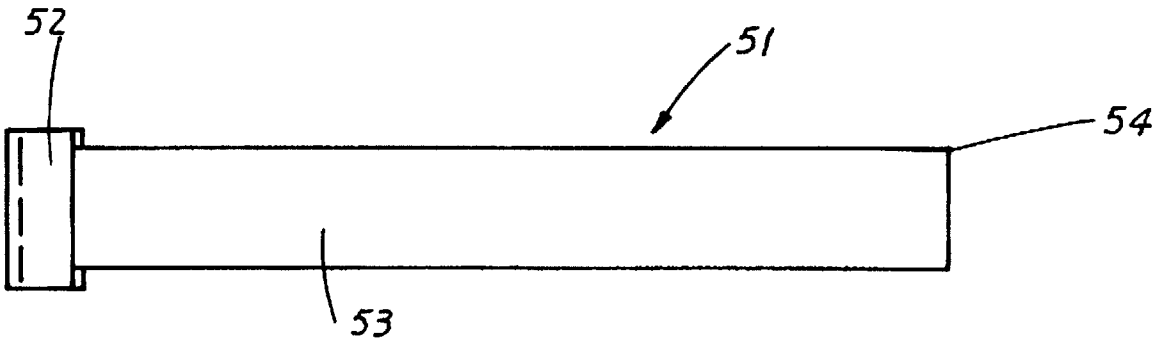
FIG. 10 is a top plan view of a second embodiment of a debris collection finger.
Figure 11:
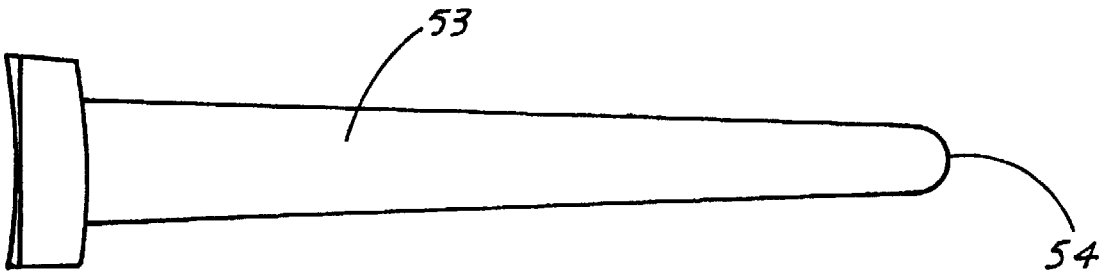
FIG. 11 is a side elevation of the debris collection finger depicted in FIG. 10.

A second finger embodiment 51 which may be mounted on the collector cylinder 37 is shown in FIGS. 10 and 11. The finger 51 includes a concave base region 52 having a length of approximately 2.75 inches and a width of approximately two inches. The height of the base 52 is approximately 0.875 inches. The finger 51 includes a body portion 53 which extends from base 52 and terminates at rounded tip 54, the tip 54 having a radius of approximately 0.375 inch. The thickness of the body portion 53 is approximately 1.50 inches near the base 52, tapering gradually until reaching the radiused tip 54. The body 53 has a length of approximately 11.0625 inches. The entire finger 51 is integrally molded from natural rubber having a durometer in the range of 75–78. The elongated shape of the finger 51 is helpful in entraining and transporting larger types of debris as well as capturing smaller, flexible items such as rope or newspaper.

In one preferred embodiment, the fingers 51 are mounted in a line of ten, thereby constituting a complete row 38. As best seen in FIG. 6, the rows 38, 39 and 40 are arranged so as to be equally spaced from adjacent rows and are substantially tangential to the surface of the collector cylinder 37. The collector drum 36 rotates in the direction of arrow 55, thereby causing the lowest row of fingers, such as row 38 in FIG. 6, to sweep entrained debris rearwardly towards conveyor 56.

The conveyor 56 is constructed to include a lower conveyor drum 57 and an upper conveyor drum 58. In order to provide adequate clearance from vehicle front wheels 6 and 7 while still permitting the rearward placement of collection hopper 59, the conveyor 56 includes a bend of approximately thirty degrees in a region 60 somewhat forward of its midpoint. A conveyor belt 61 passes over conveyor drums 57 and 58, the lower drum 57 being driven by a hydraulic motor mounted at the end of drum 58.

The conveyor belt 61 includes eighteen rows, such as rows 63, 64, 65 and 66, of ten fingers, such as fingers 67, 68, 69 and 70 which are among the fingers present in row 64, as best seen in FIG. 2. The fingers 67, 68, etc. are preferably of the construction shown for finger 51 in FIGS. 10 and 11, although the fingers may be like those shown for finger 41 in FIGS. 7–9. Further, a combination of the fingers 41 and 51 may be used, either within a single row 64, for example, or alternating between sets of rows. In the latter case, all of the fingers in rows 63 and 64 could be formed in the manner of fingers 41, while all of the fingers in the next row 65 could be formed in the manner of fingers 51. The selection and placement of fingers 41 and 51 is dependent primarily on the type of debris to be collected, both in terms of the debris shape and size as well as its density and hardness. In general, the longer finger 51 is relatively less stiff and is best for a wide lighter objects, while the use of the smaller finger 41 should be contemplated as the debris grows heavier. Special materials, such as tailpipes, plywood sheets or moist cardboard, for example, may require interspersing and alternation of fingers 41 and 51, or may require the use of a finger having properties intermediate to those of fingers 41 and 51.

The direction of rotation of lower drum 57 is shown by arrow 62 in FIG. 5. This direction of rotation for drum 57 is such that when conveyor finger row 71, for example, is moving across the roadway surface 72, the row 71 is moving forwardly an then upwardly, thereby intercepting debris being propelled rearwardly by the collector drum 36. The debris will then move upwardly and rearwardly due to the motion of the conveyor belt 61. The debris will eventually pass through opening 73 in the hopper 59, thereby being deposited and stored in the hopper 59 for transport to a final dump site or other suitable location.

Figure 4:
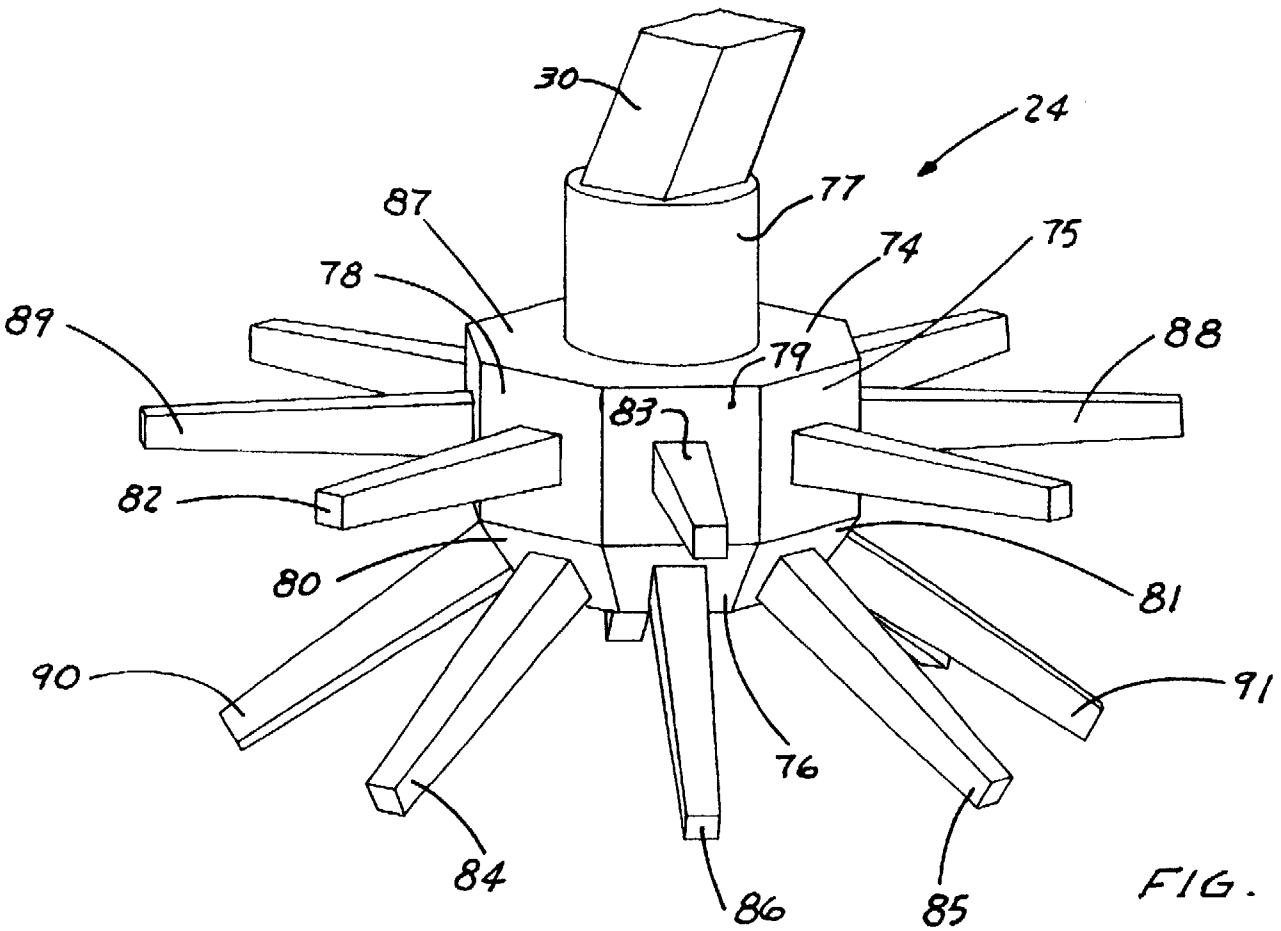
FIG. 4 is a perspective view of a curb brush as utilized by the vehicle of FIG. 1.
Figure 45:
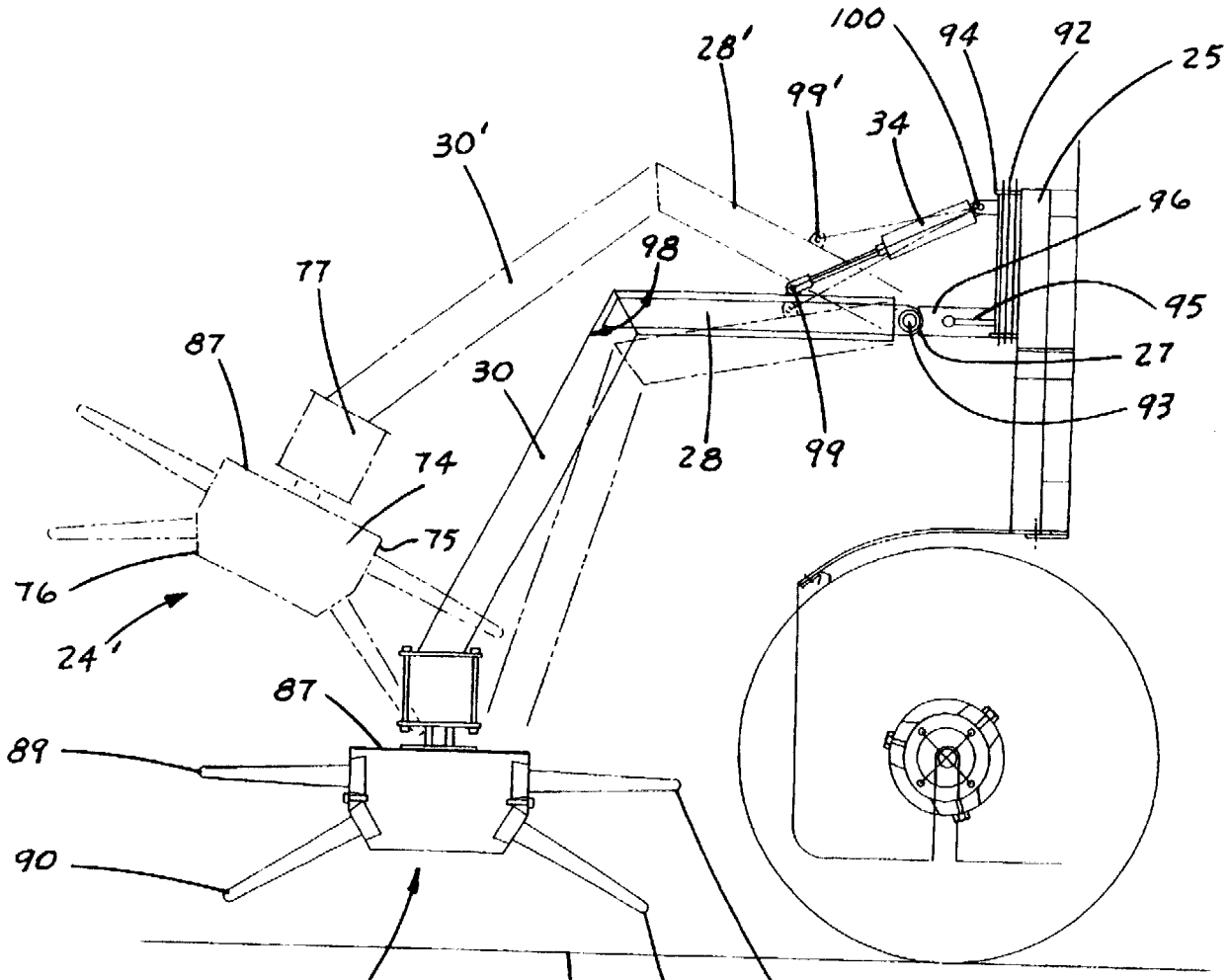
FIG. 45 is a side elevation of the debris collection vehicle depicted in FIG. 44, showing the curb brush in operative and transport positions.
Figure 52:
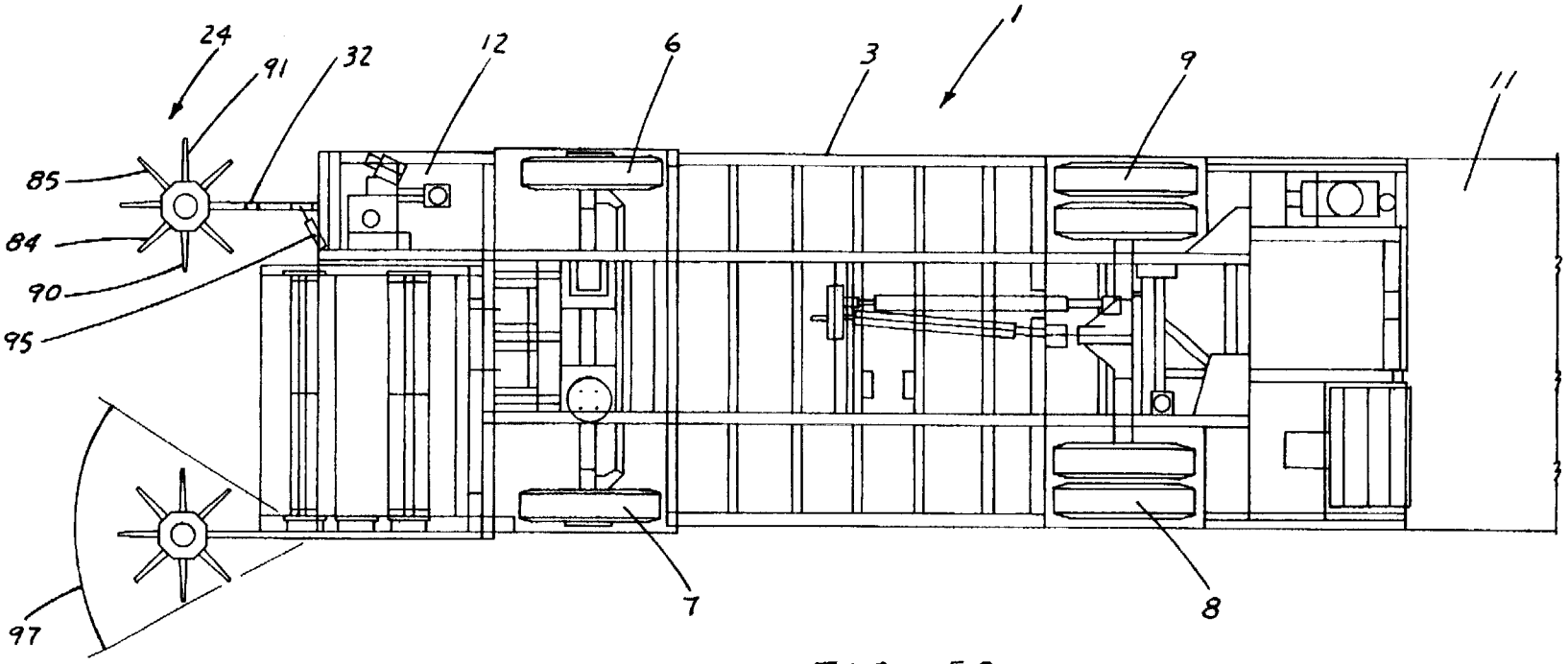
FIG. 52 is a top plan view of the debris collection vehicle depicted in FIG. 1.

At least two types of curb brushes may be used in conjunction with the present debris collection vehicle 1. As best seen in FIGS. 4, 45 and 52, a first type of curb brush 24 includes a housing 74 formed with an upper octagonal portion 75 and a lower octagonal portion 76. A hydraulic motor 77 is pivotably affixed to the upper housing portion 75 and is adapted to cause the entire housing 74 to rotate at a maximum speed of approximately 300 rpm. Extending outwardly through the approximate center of each housing wall segment 78, 79, 80 and 81, for example, is a single rubber finger, such as, for example, fingers 82, 83, 84 and 85. The fingers 82, 83, etc. are preferably of the construction set forth in FIGS. 10 and 11, or they may have the squared tip 86 as shown in FIG. 4. Alternatively, all or some of the fingers 82, 83, etc. may be of the type depicted in FIGS. 7–9.

When the upper, planar portion 87 of housing 74 is approximately horizontal, the fingers 82, 83, 88, 89, etc. extending from the upper octagonal housing 75 are also approximately horizontal. The fingers 84, 85, 90, 91, etc., which extend from the lower octagonal housing are simultaneously inclined downwardly at an approximate forty five degree angle when the planar portion 87 is horizontal. In this configuration, the upper fingers 88, 89, etc. are best suited to clean the sidewalls of a gutter, for example, while the lower fingers 90, 91, etc. are best suited to scour the intersection between the gutter sidewall and the street surface 72. This corresponds to the position of support arm 30 as shown in FIG. 45.

The support arm 30 is pivotable about both a vertical axis 92 and a horizontal axis 93. A hollow cylinder 94 is mounted to vehicle support member 25, and constrains arm 96 to rotate about vertical axis 92. The arm 96 is manipulated by means of hydraulic ram 95 and is capable of moving the arm 96 through the angle defined by arc 97, which is an angle of approximately forty five degrees. The horizontal support arm 28 joins the lower support arm 30 an angle 98 of approximately fifty nine degrees. The horizontal support arm 30 pivots upwardly about horizontal axis 93 from a substantially horizontal position through a maximum angle of approximately twenty degrees, as shown by position 28' in FIG. 45. The upward rotation of arm 28 is caused by retraction of the hydraulic ram 34 which is anchored to the arm 28 at pivot point 99 and to the vertical cylinder 94 at pivot point 100. While the vertical deflection of the curb brush 24 is useful in cleaning uneven surfaces, the maximum upward deflection of twenty degrees is typically reserved for the transport position 24', at which time hydraulic motor 77 would not be activated.

Referring now to FIGS. 30 and 46–50, a second type of curb brush 22 is disclosed. Curb brush 22 is supported by arm 21, and the arm 21 is generally maneuverable in the same manner and to the same extent as the support arm 30 just described for use in conjunction with curb brush 24. Support arm 21 is rigidly affixed to a generally planar mounting plate 101 which serves as the upper support for conveyor frame 102. Also attached in a generally perpendicular orientation to the plate 101 is driven spindle 103 and idler 104. The driven spindle 103 is coaxial with the conveyor drive pulley 105, while a concentric idler pulley 106 is mounted on the shaft of idler 104. A conveyor belt 107 extends between the drive pulley 105 and the idler pulley 106. An hydraulic motor 108 is mounted on drive spindle 103 and permits the conveyor belt 107 to reach a maximum speed of about 300 rpm. The longitudinal tension of the conveyor belt 107 can be adjusted and maintained by sliding the idler mounting fixture 109 within grooves 110, 111 and 112, the grooves being formed within the mounting plate 101. A first perpendicular support plate 113 is rigidly affixed to the mounting plate 101, the support plate 113 being substantially parallel to the idler mounting fixture support plate 114. Longitudinally aligned, threaded holes are formed in each plate 113 and 114, through which are threadably inserted 0.375 inch threaded rods 115 and 116. Rotation of the rods 115 and 116 permits adjustment of the relative longitudinal position of the idler mounting fixture 109, thereby affecting the tension of conveyor belt 107.

Figure 30:
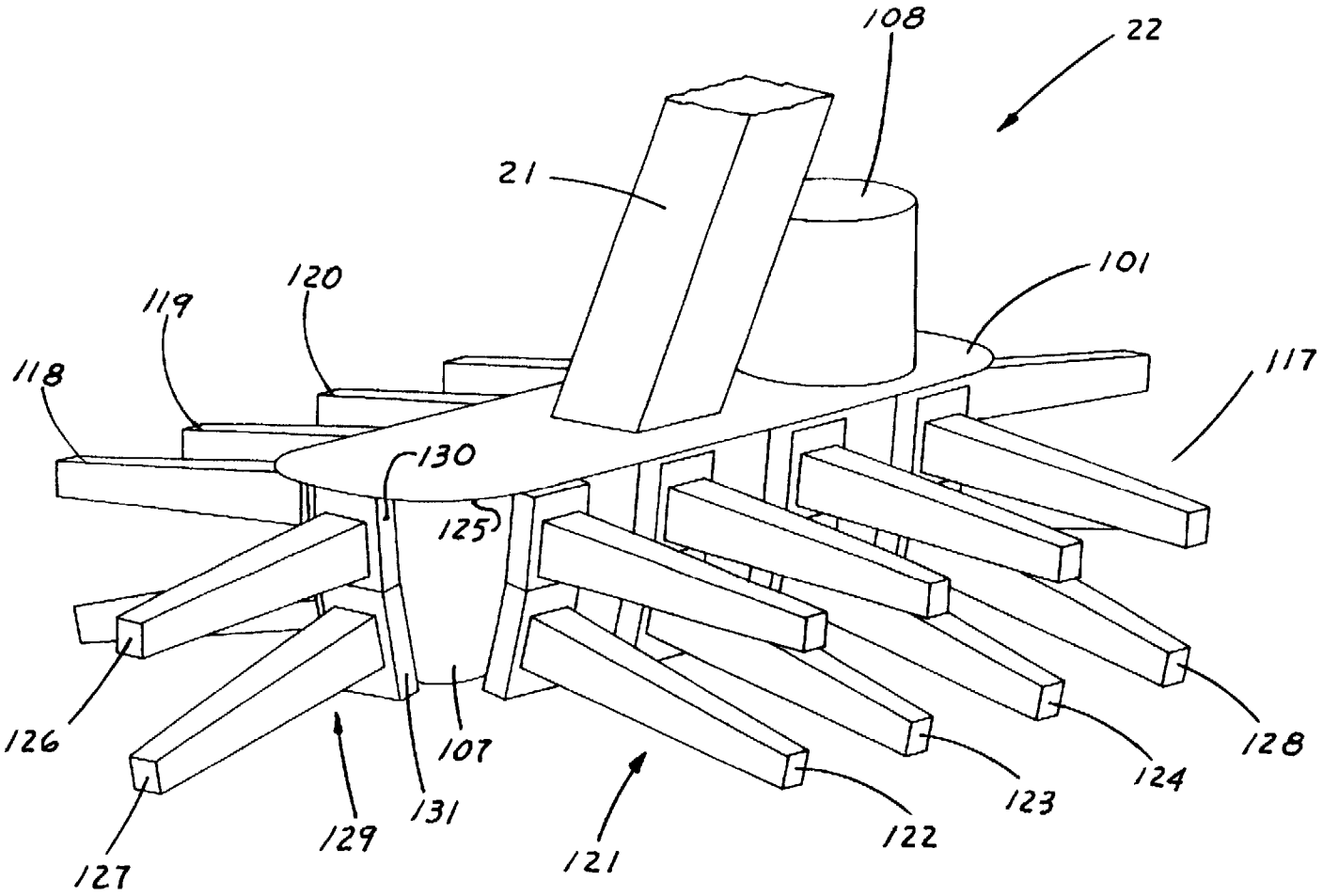
FIG. 30 is a perspective view of an alternate embodiment of a curb brush.
Figure 31:
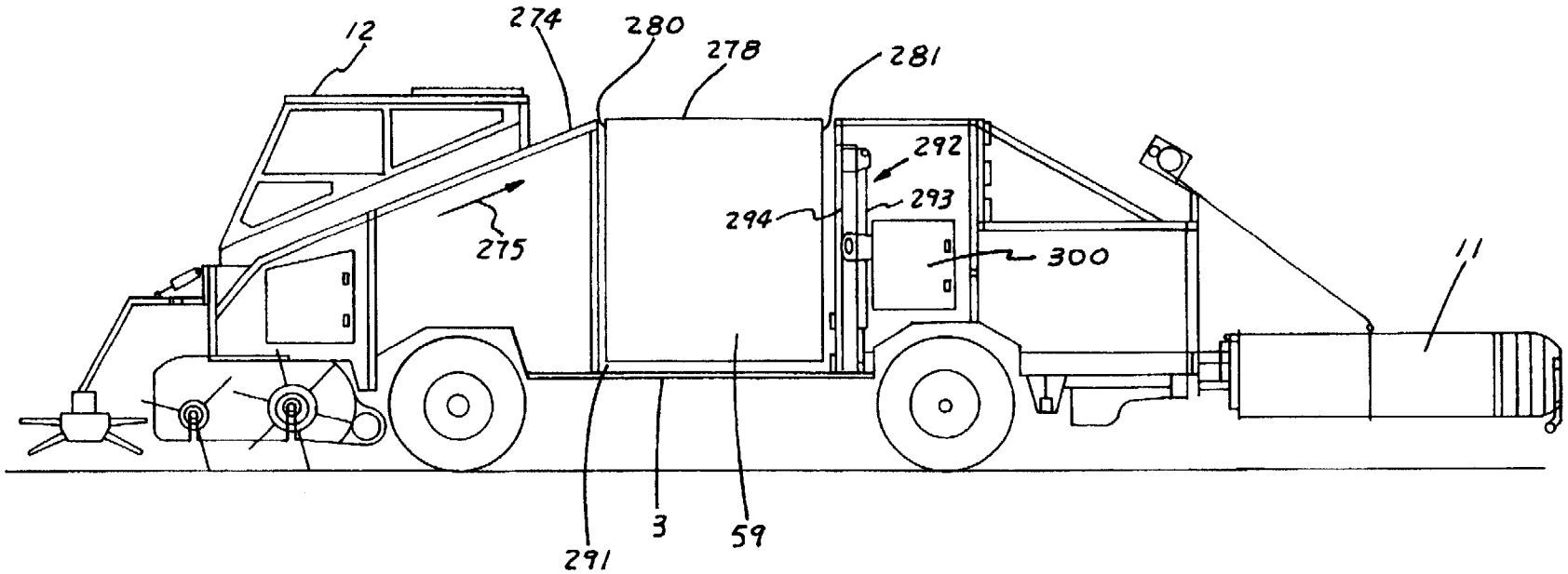
FIG. 31 is a left side elevation of an alternate embodiment of a debris collection vehicle.
Figure 32:
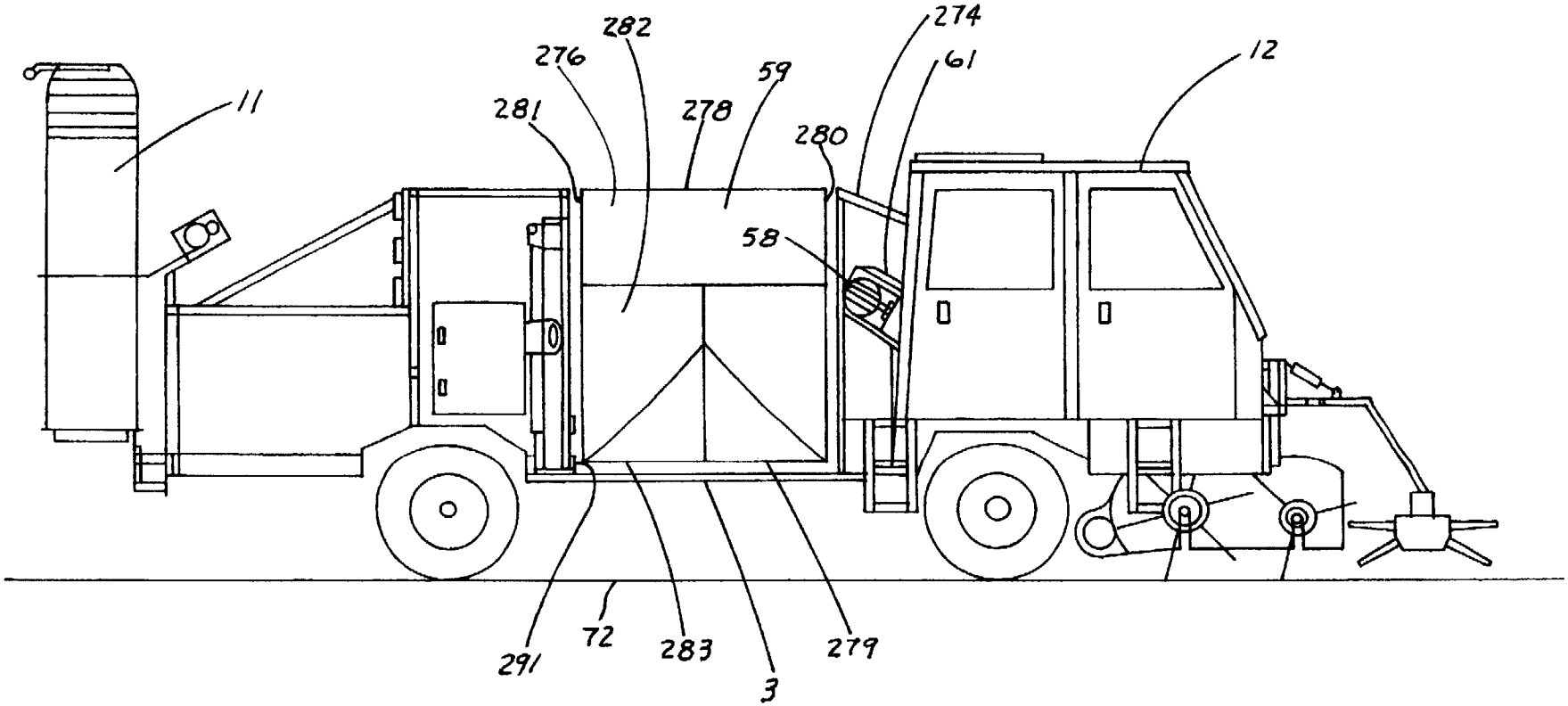
FIG. 32 is a right side elevation of the debris collection vehicle depicted in FIG. 31.

Mounted on the conveyor belt 107 is an upper row 117 of rubber fingers 118, 119, 120, etc. Vertically aligned beneath the upper row 117 is a lower row 121 of rubber fingers 122, 123, 124, etc. In a preferred embodiment, the fingers 118, 122, etc. are of the design depicted in FIGS. 10 and 11. In another embodiment, the fingers may have the squared tips 128 as shown in FIG. 30. The fingers 118, 119, etc. of the upper row 117 are mounted so as to be substantially parallel with the plane defined by mounting plate 101, extending perpendicularly with respect to the edge 125 of the plate 101. The fingers 122, 123, etc. of the lower row 121 are angled downwardly at an angle of approximately thirty degrees from the lane of mounting plate 101. In a first embodiment shown in FIG. 30, the upper and lower fingers in a given column, such as fingers 126 and 127 in column 129, are mounted within and retained by separate, adjacent mounting fixtures 130 and 131, respectively, with each fixture 130 and 131 being affixed directly to conveyor belt 107. In an alternative embodiment shown in FIG. 50, a single piece mounting fixture 132 is utilized which accepts both the upper finger 133 and the lower finger 134. The lower finger 134 is angled inwardly approximately thirty degrees such that its base 135 underlies a portion of the conveyor belt 107. At least one bolt 136 passes through the mounting fixture 132 and secures it to the belt 107.

Figure 46:
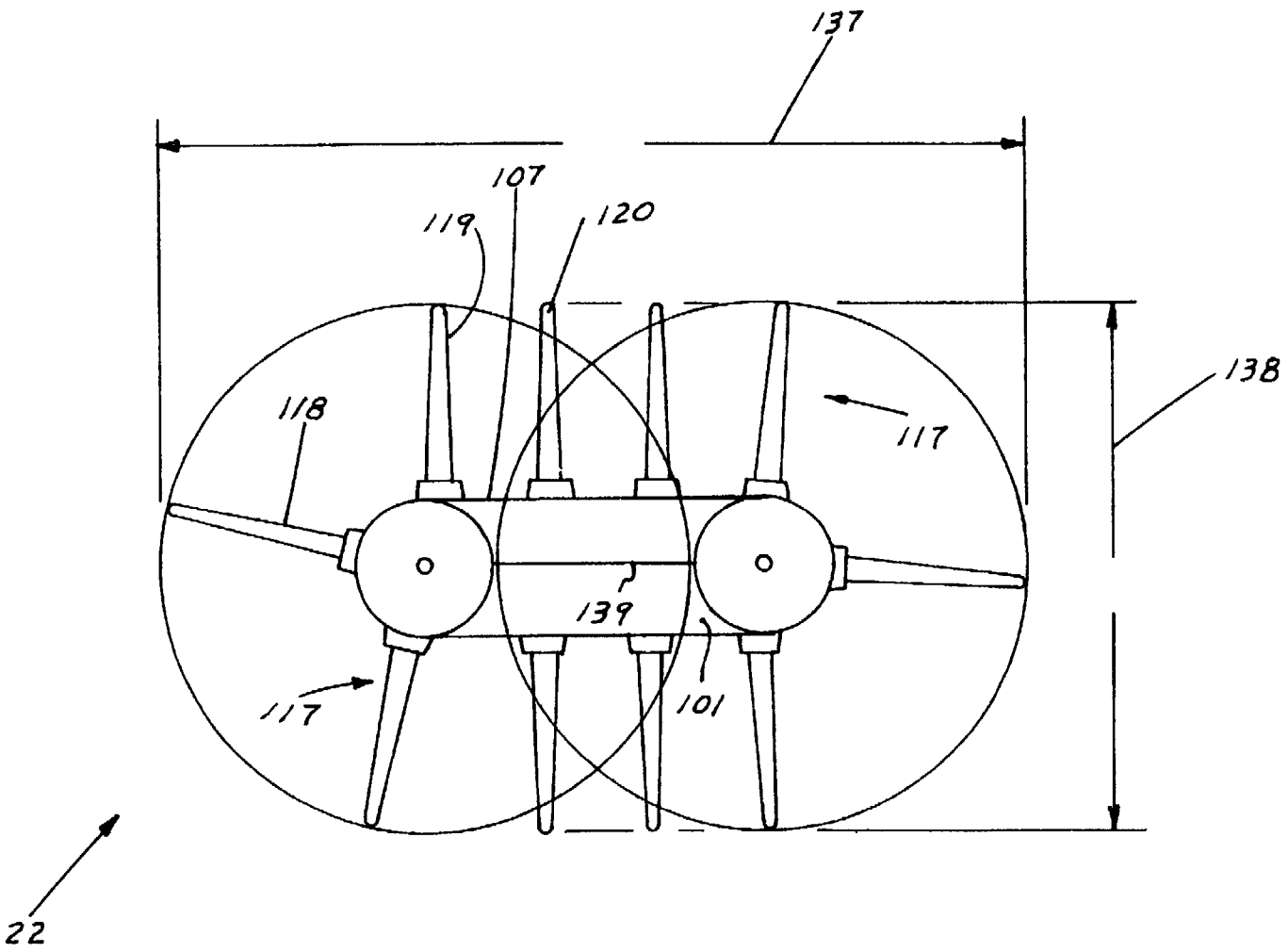
FIG. 46 is a top plan view of the curb brush depicted in FIG. 30.
Figure 47:
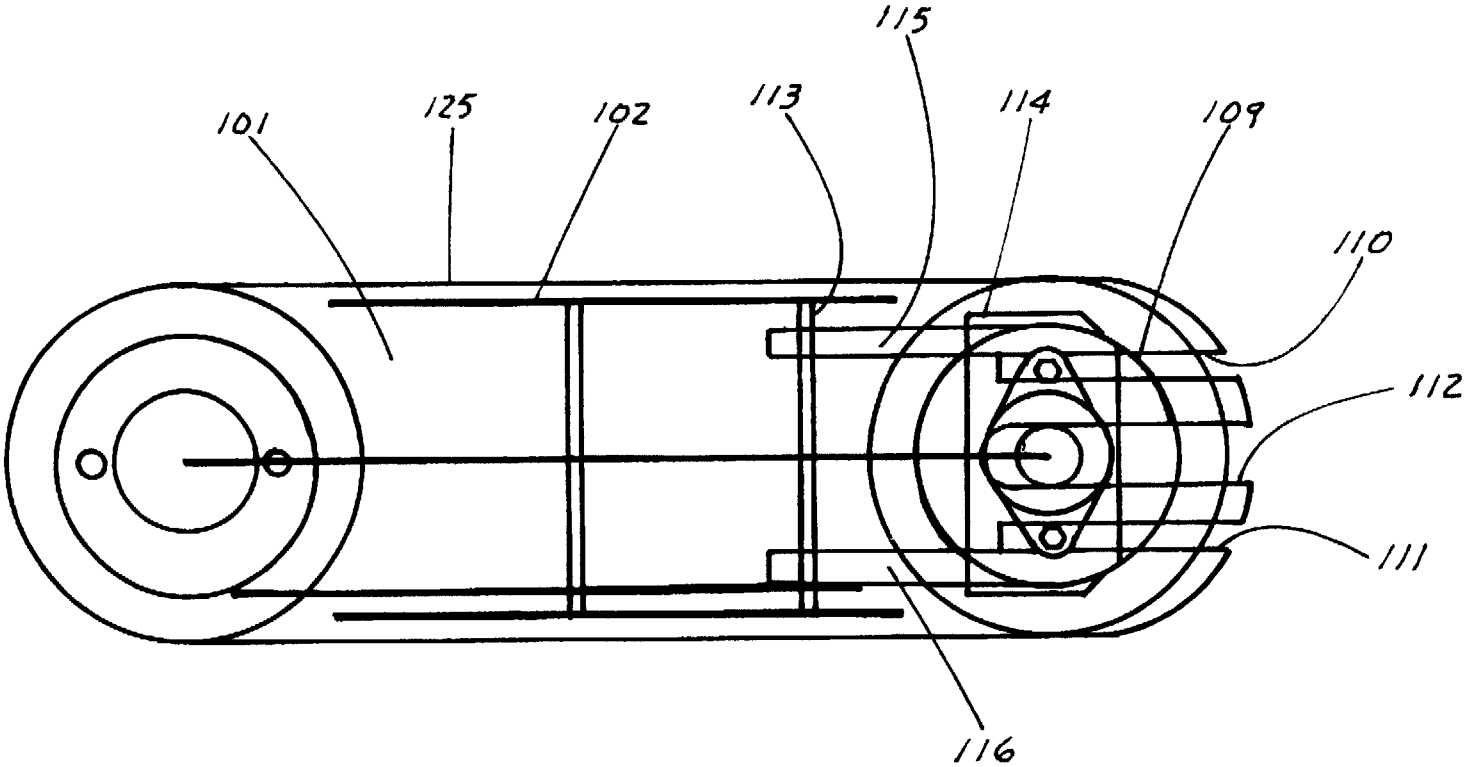
FIG. 47 is a top plan view of the curb brush depicted in FIG. 46 showing details of its internal construction.
Figure 48:
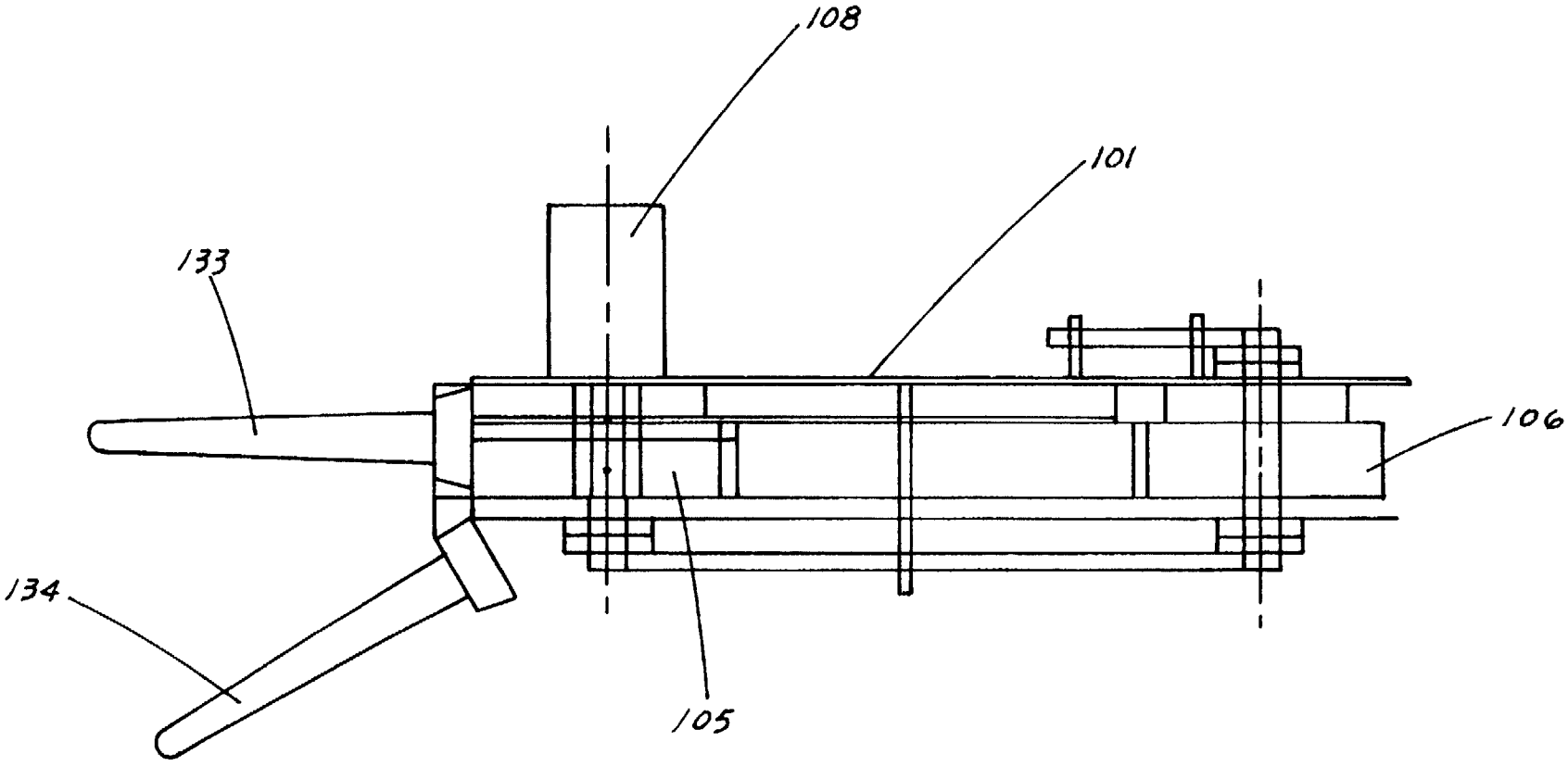
FIG. 48 is a rear elevation of the curb brush depicted in FIG. 46.
Figure 49:
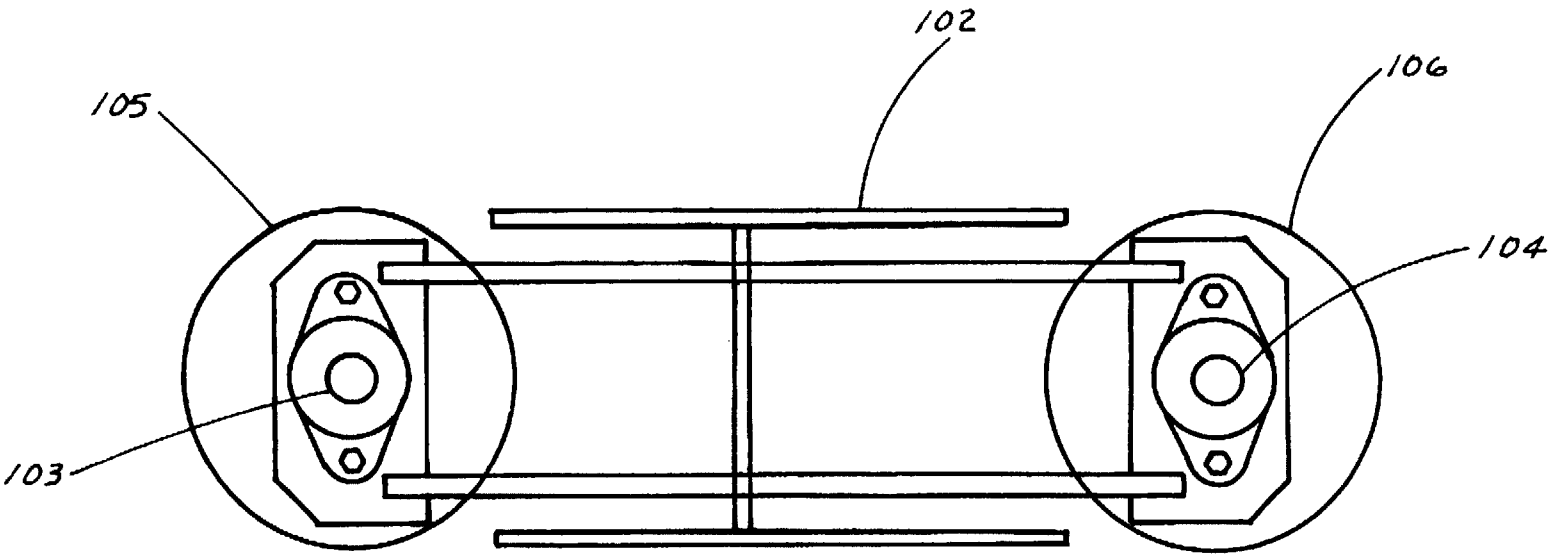
FIG. 49 is a bottom plan view of the curb brush depicted in FIG. 46.
Figure 50:
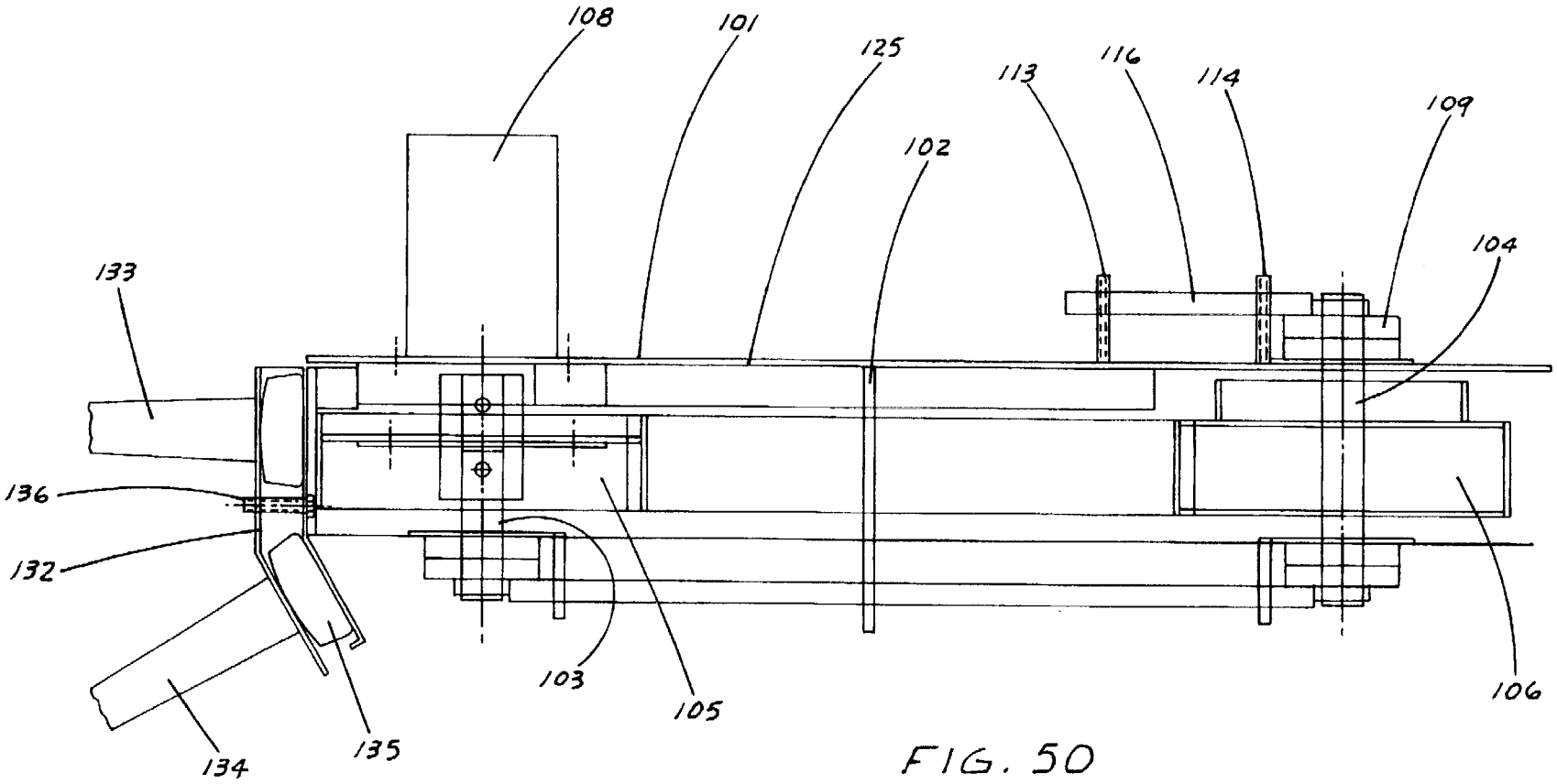
FIG. 50 is a rear elevation of the curb brush depicted in FIG. 46 showing details of its internal construction.

In either embodiment, the upper row 117 of fingers is best oriented to impinge the sidewalls of a gutter, while the lower row 121 is oriented so that the fingers 122, 123, etc. will sweep the intersection of the gutter sidewall and the road surface 72. As best seen in FIG. 46, the overall length or reach 137 of brush 22 is approximately fifty three inches, while the width or swath 138 of brush 22 is approximately thirty three inches. One of the major advantages of the elongated design of curb brush 22 is the ability to define a path which the encountered debris will follow, namely, a path generally parallel to the longitudinal axis 139 of curb brush 22. This simplifies steering or directing of encountered debris toward the collector drum 36.

Collector Drum Orientation

Referring to FIGS. 12–22, another novel aspect of the present device 1 will be discussed, namely, the ability of the collector drum 36 to adjust its position with respect to the lower conveyor roller 56. In the embodiment depicted in FIG. 12, the collector roller 36 is seen to be constructed about cylinder 37 having a longitudinal axis 140. The cylinder 37 is suspended at each end by substantially identical end plates 141 and 142. The end plate 141 is formed of a rugged, stiff material such as steel and includes a pair of cylindrical extensions or posts 144 and 145 which extend perpendicularly from the plane defined by end plate 141. The posts 144 and 145 are each approximately one inch in diameter and four inches in length.

The lower conveyor drum 56 is constructed about cylinder 57 which has a longitudinal axis 146. The cylinder 57 is supported at each end by substantially identical end plates, of which end plate 147 is visible in FIG. 12. The end plate 147 is constructed so as to have a lower end region 148 which is generally tapered and which also includes an orifice which passes completely through the plane defined by end plate 147. The orifice has a longitudinal axis 154 and serves to pivotably secure pin 149.

Pivotably secured to the pin 149 is the first end 151 of an hydraulic ram 150 having a bore of approximately two inches and a stroke of approximately six inches. The body 152 of the ram 150 is rigidly secured to the lower edge 153 of collector end plate 141. Also pivotably secured by pin 149 is upper arm 155. The upper arm 155 is constructed to include a nominally horizontal portion 156, through which a nominally horizontal perforation 143 is formed. The perforation 143 has a width of approximately 1.125 inches and a length of approximately ten inches. The longitudinal axis 159 of perforation 143 does not intersect the longitudinal axis 140 of the collector drum 36, and is nominally offset from the axis 140 by a distance of approximately five inches. The guide posts or pins 144 and 145 of end plate 141 are adapted to fit through the perforation or groove 143 and thereby be retained by the groove 143.

Extending from the upper edge 157 of the horizontal portion 156 of arm 155 is a tab 158. The tab 158 is formed so as to reside in or near the plane defined by the end plate 141. The tab 158 tapers to an end region 160, through which is formed an orifice 161. Pivotably mounted to the upper edge 162 of the conveyor end plate 147 is the first end 163 of hydraulic ram 164. The second end 165 of the ram 164 is pivotably retained within orifice 161. In this configuration, the collector drum 36 may be translated along the longitudinal axis 159, causing the collector drum 36 to move closer to or farther away from the lower conveyor drum 56. This translation may be accomplished by the retraction or extension of the hydraulic ram 150. Additionally, the collector drum 36 may be rotated about the longitudinal axis 146 of the lower conveyor drum 56 by extending or retracting hydraulic ram 164. Retraction of ram 164 causes the cylinder 37 to rotate in the direction of arrow 166. The nominal distance or throat size 167 between the axis 140 of the collector drum 36 and the axis 146 of the lower conveyor drum 56 is 26.156 inches.

The advantage of just described mounting arrangements for the collector drum 36 and the lower conveyor drum 56 are several. First, the collector drum 36 can be raised during transport of the vehicle from one debris collection location to another. Second, the drum 36 can be raised to accommodate collection of relatively larger objects and lowered to facilitate entrainment of smaller objects. More significantly, the throat size 167 may be varied to accommodate various sizes and types of debris. Additionally, the amount of finger overlap 168 may be varied as well.

Figure 12:
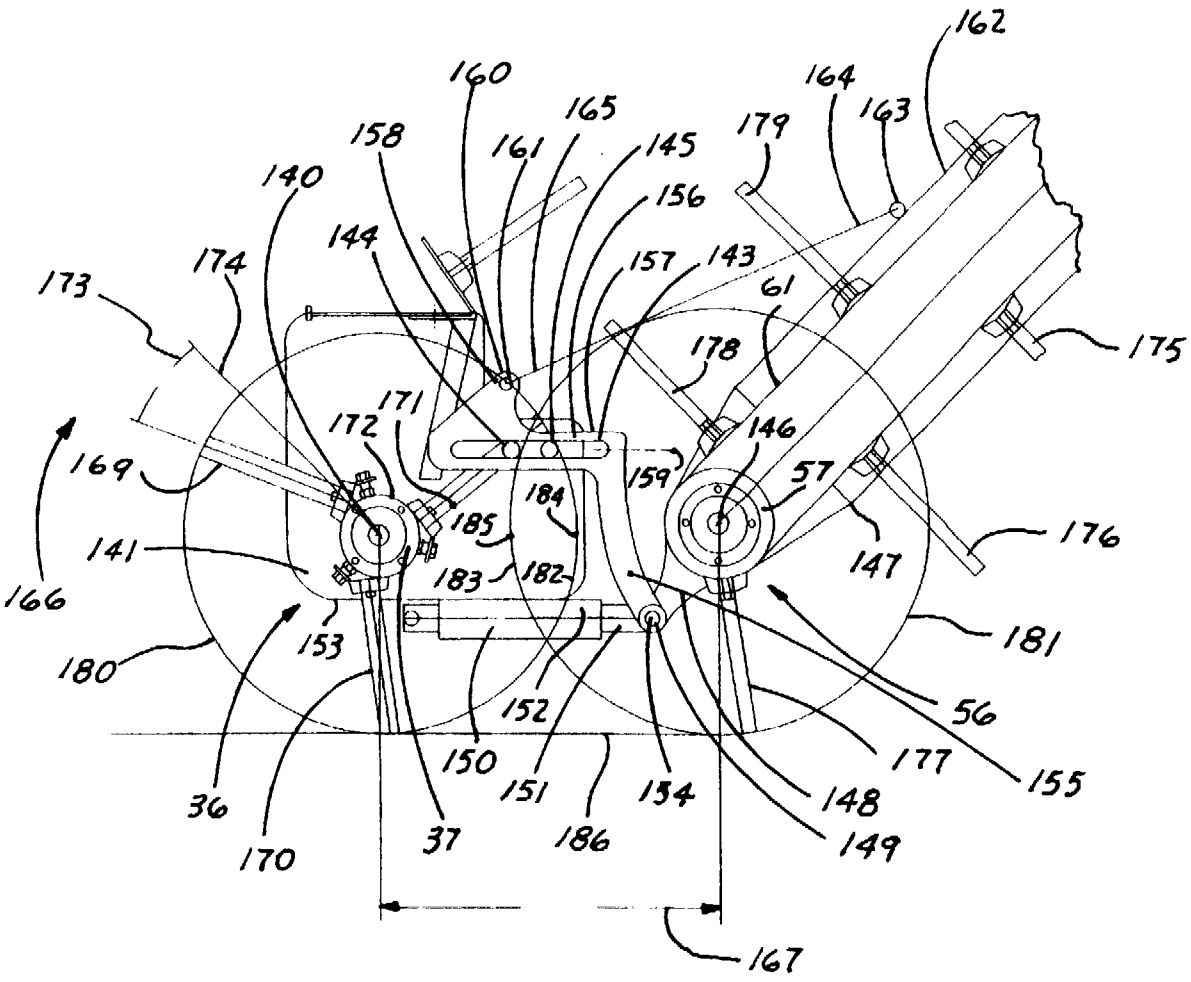
FIG. 12 is a side elevation of an alternate configuration of a collector drum and conveyor to be utilized on the vehicle depicted in FIG. 1.

To better understand the versatility of this mounting arrangement, one should note that fingers 169, 170 and 171 are mounted at 120 degree increments about the surface 172 of collector cylinder 37. Each finger 169–171 has a nominal length of approximately twelve inches. Further, each finger 169–171 has is mounted at an angle 173 which is tilted or offset by approximately 22.65 degrees from the perpendicular angle 174. Thus, including the effect of cylinder 37, each finger 169–171 describes or traces a circle 180 having a diameter of approximately 34.88 inches for each complete rotation of cylinder 37. Another set of fingers 175, 176, 177, 178 and 179, for example, are mounted substantially perpendicularly to conveyor belt 61. Each finger 177, 178, etc. traces a portion of circle 181 for each complete cycle of the conveyor belt 61. As best shown in FIG. 12, the region or arc 182 of circle 180 and the region or arc 183 of circle 181 defines the area in which portions of the fingers 169–172 overlap portions of fingers 175–179 during portions of each cycle of rotation of the collector drum 37 and the lower conveyor drum 57. The shortest distance 168 between point 184 of arc 182 and point 185 of arc 183 represents the area of maximum overlap between portions of the collector fingers 169–171 and the conveyor fingers 175–179.

In a preferred embodiment, the collector fingers 169–171 are laterally offset from the conveyor fingers 175–179, thereby eliminating the need for the timing mechanisms needed in order to provide interlacing of the fingertips. Further, the lateral offset of the opposed fingers permits the collector drum cylinder 37 to be operated at a speed which is independent of the rotational speed of lower conveyor drum cylinder 57. These independent, nonintegrally related speeds offer advantages in collecting and entraining certain types of debris. This feature, combined with the ability to vary the degree of overlap 168 between opposed fingers greatly enhances the amount and types of debris which may be successfully collected.

Figure 13:
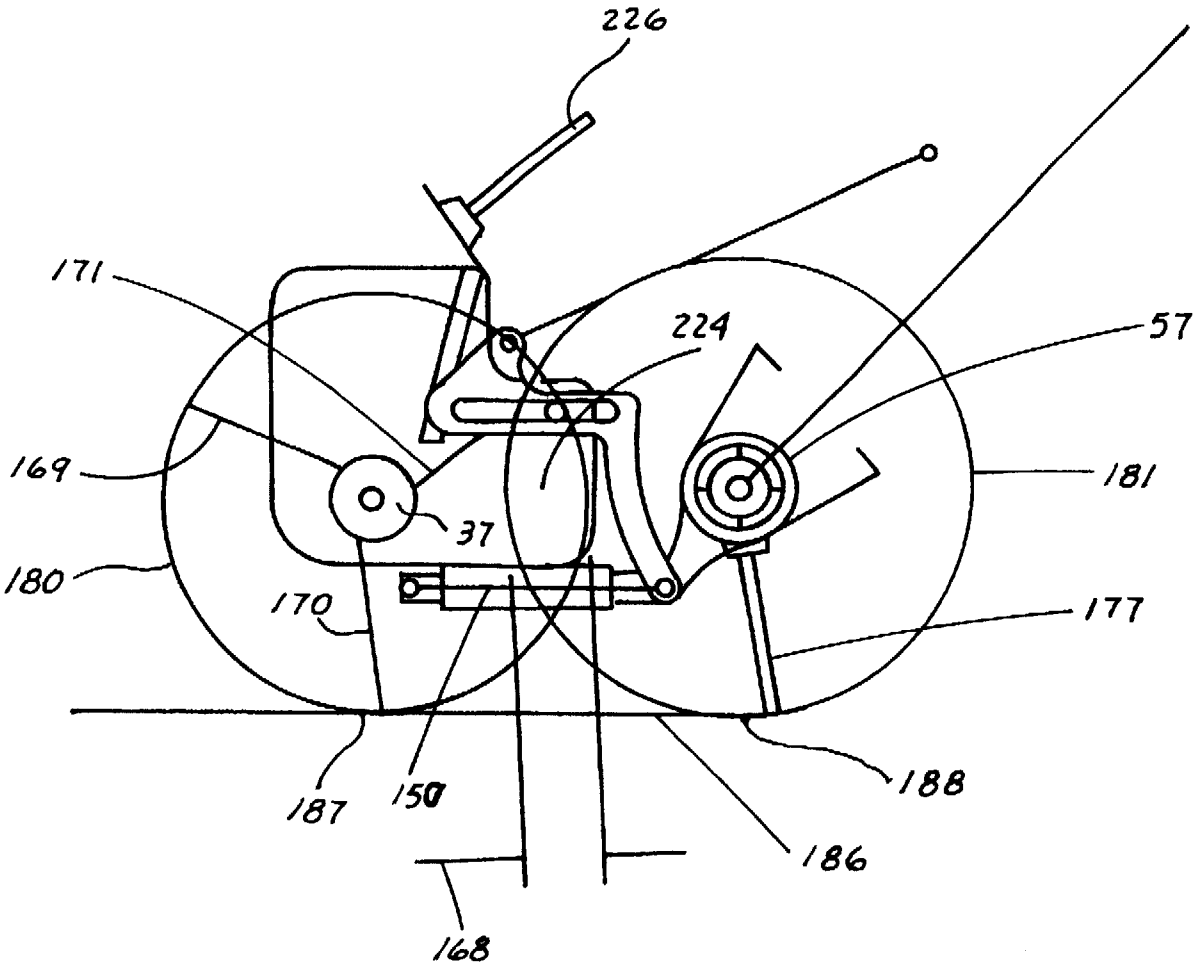
FIG. 13 is a side elevation of the collector/conveyor assembly of FIG. 12 shown in a normal overlap configuration.
Figure 14:
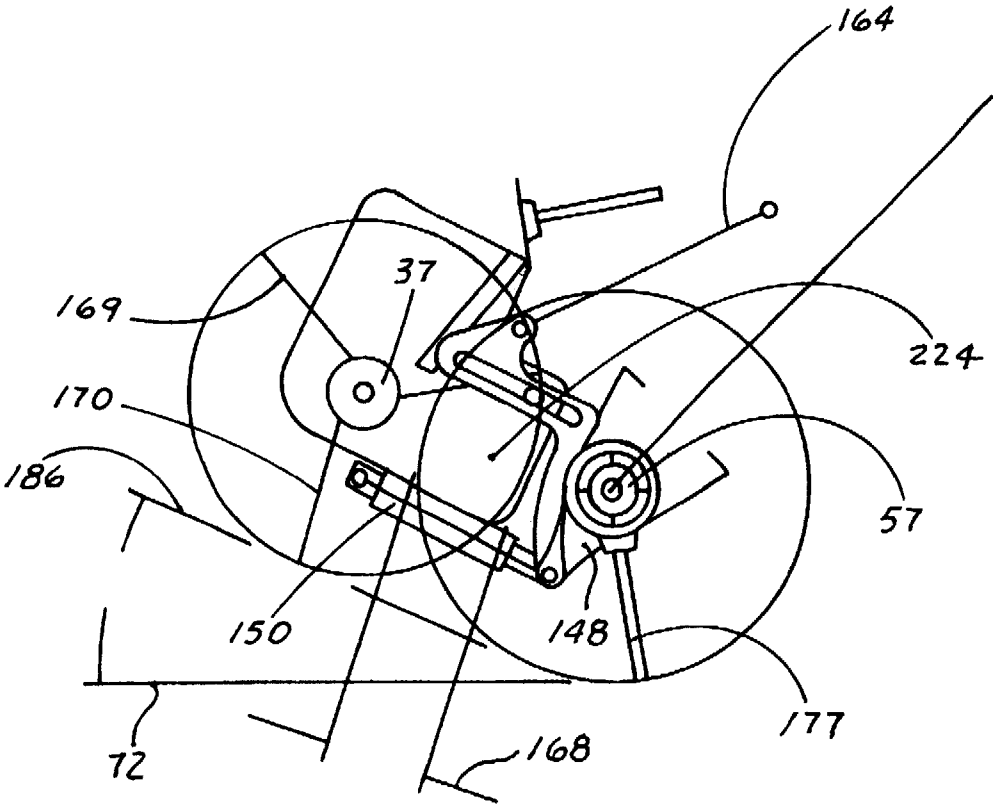
FIG. 14 is a side elevation of the collector/conveyor assembly of FIG. 13 shown in a tilted position.
Figure 15:
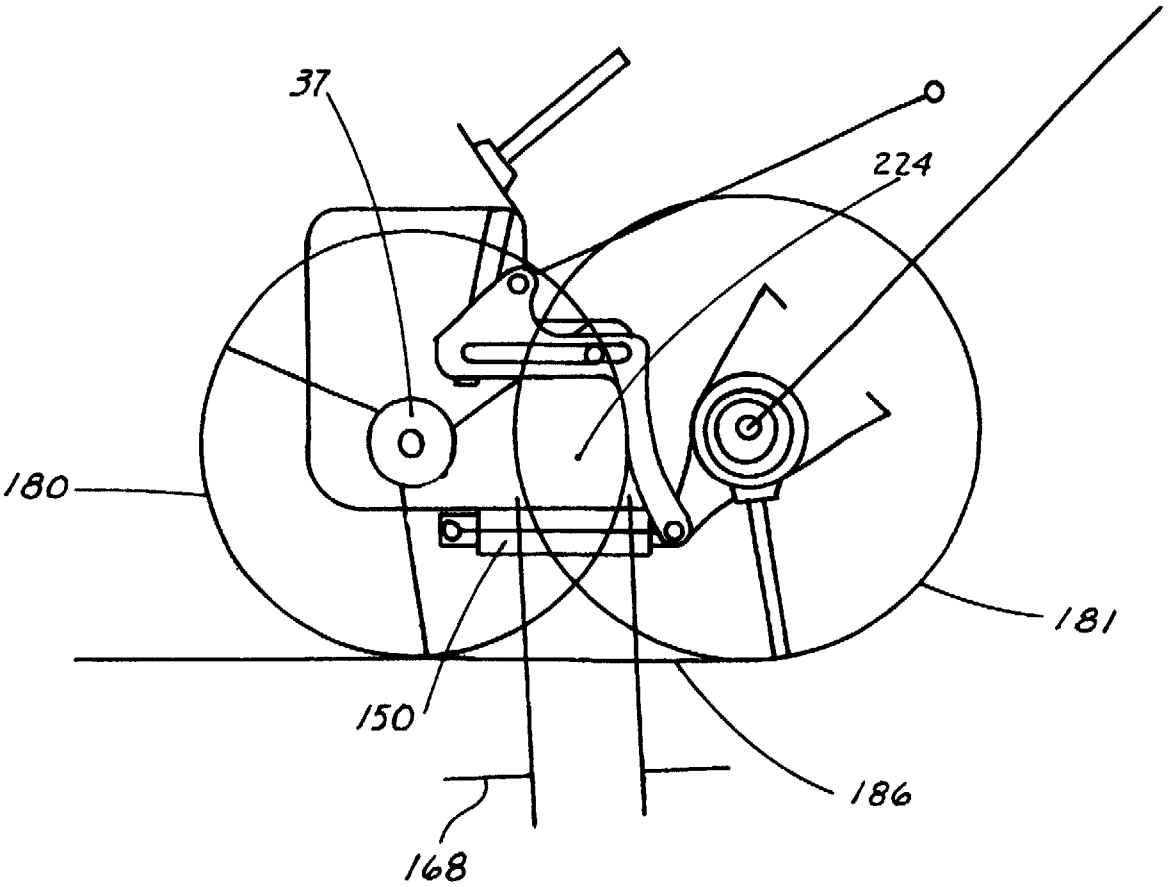
FIG. 15 is a side elevation of the collector/conveyor assembly of FIG. 12 shown in a maximum overlap configuration.

The various relative orientations of collector cylinder 37 and conveyor cylinder 57 are shown in FIGS. 13–17. As seen in FIG. 13, the tangent line 186 extending between the lowest points 187 and 188 of circles 180 and 181, respectively, is substantially horizontal, and the finger overlap distance 168 is approximately five inches, which represents an average amount of finger overlap. In FIG. 15, the hydraulic ram 150 is at its fully retracted position, which corresponds to a maximum finger overlap distance 168 of approximately seven inches, as might be appropriate for the collection of relatively smaller or finer debris. Finally, in FIG. 17 the hydraulic ram 150 is fully extended, resulting in the minimum finger overlap 168 of approximately two inches. The minimum overlap setting is often appropriate for relatively larger or elongated types of debris.

Figure 16:
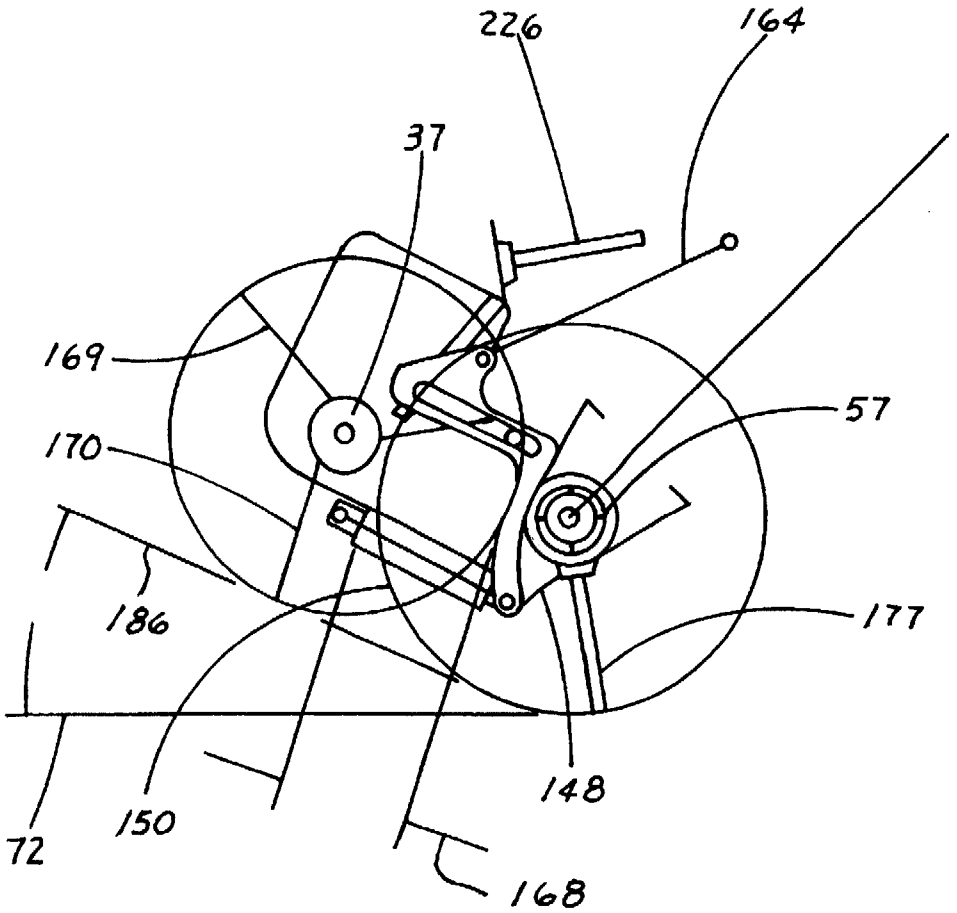
FIG. 16 is a side elevation of the collector/conveyor assembly of FIG. 15 shown in a tilted position.
Figure 17:
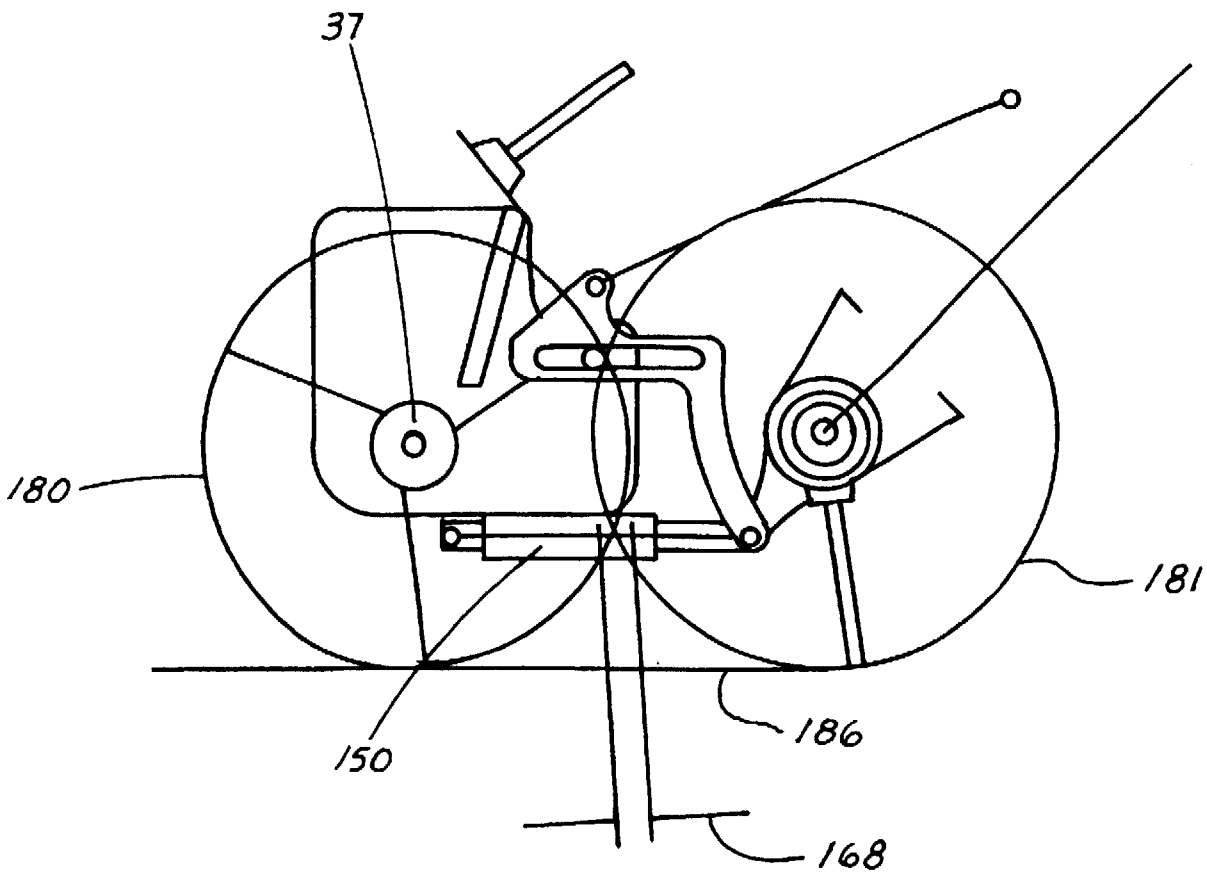
FIG. 17 is a side elevation of the collector/conveyor assembly of FIG. 12 shown in a minimum overlap configuration.
Figure 18:
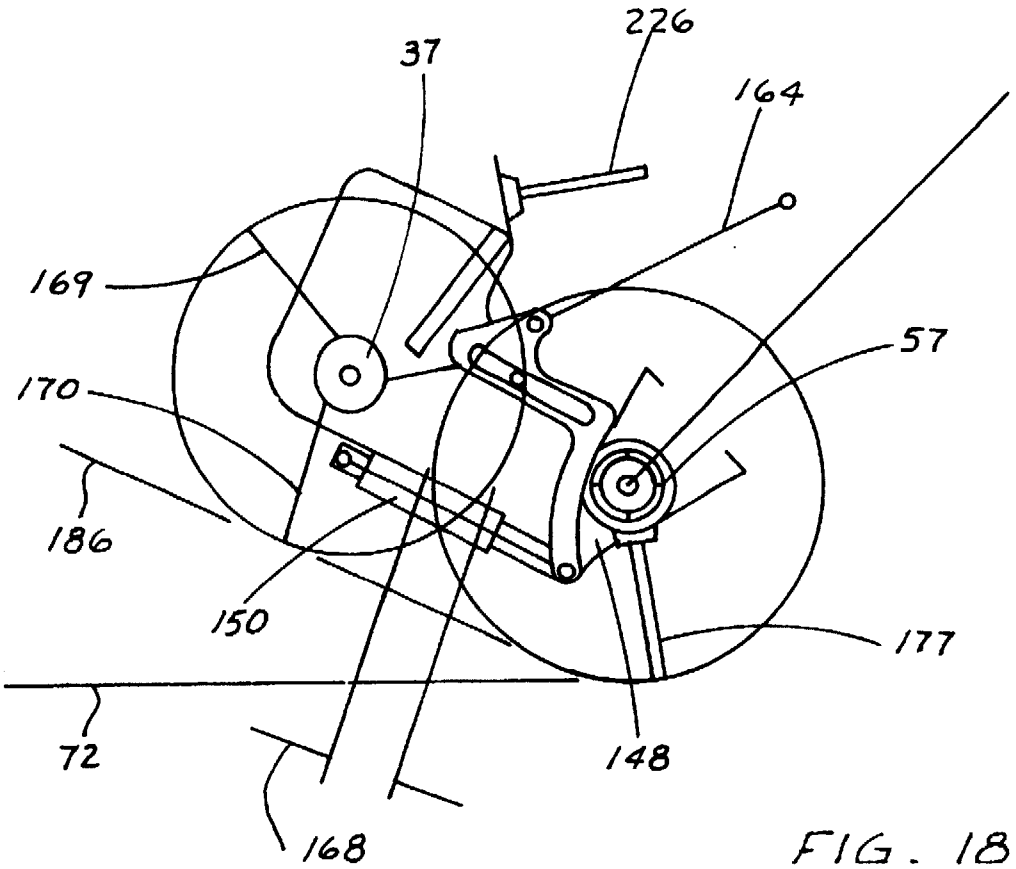
FIG. 18 is a side elevation of the collector/conveyor assembly of FIG. 17 shown in a tilted position.

The effect of tilting the collector cylinder 37 upwardly by retracting ram 164 is shown in FIGS. 14, 16 and 18. The general effect of retracting ram 164 is to increase the amount of finger overlap 168. In FIG. 14, a nominal setting of ram 150 and maximum retraction of ram 164 results in a finger overlap distance of approximately 8.60 inches. FIG. 16 again depicts maximum retraction of ram 164, this time combined with maximum retraction of ram 150. The finger overlap distance 168 is the greatest possible with this mounting arrangement and is equal to approximately 10.40 inches. This particular geometry might be appropriate for the entrainment of cardboard or newspapers, which might initially be arranged as a relatively tall stack of debris, but which quickly disintegrate into fine particles. Finally, FIG. 18 corresponds to minimum retraction of ram 150 and maximum retraction of ram 164. This setting results in a finger overlap distance of approximately 5.70 inches.

Figure 22:
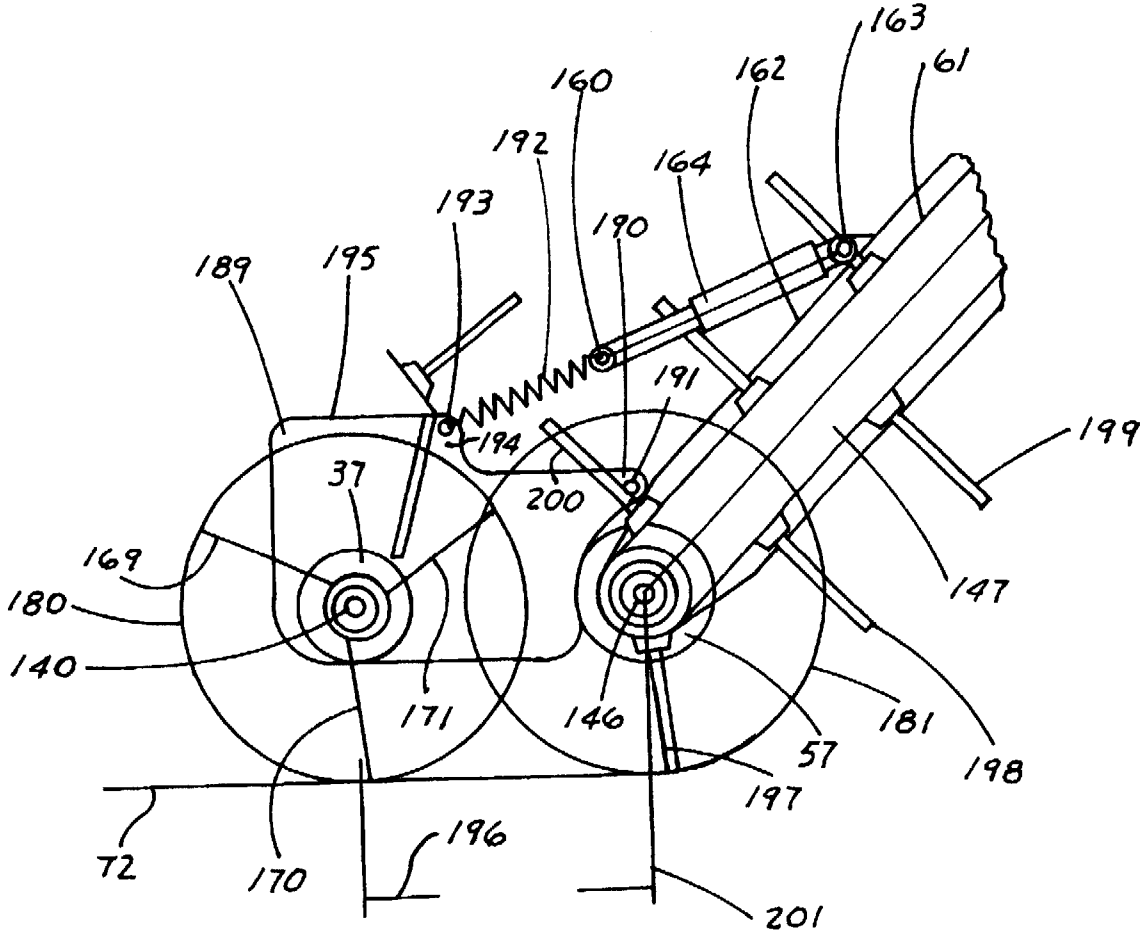
FIG. 22 is a side elevation of the collector/conveyor assembly of FIG. 19 showing mounting details of the spring loaded hydraulic ram.

Referring now to FIGS. 19–22, an alternate embodiment of the collector/conveyor mounting arrangement is shown. In FIG. 22, the collector cylinder 37 is pivotably supported by end plate 189. The end plate 189 extends rearwardly toward the conveyor cylinder 57 where it terminates at mounting tab 190. A pivot pin 191 extends through tab 190, the pivot pin 191 being pivotably affixed to the upper edge 162 of the conveyor end plate 147. The pivot pin 191 is approximately vertically displaced from the axis 146 of the lower conveyor drum 57. The first end 163 of hydraulic ram 164 is mounted to the upper edge 162 of the end plate 147, but the second end 160 of the ram 164 is rigidly affixed to biasing member 192. The end 193 of biasing member 192 is pivotably attached to a mounting tab 194 located near the upper edge 195 of mounting plate 189. The effect of biasing member 192 is to force collector cylinder 37 downwardly towards road surface 72. The nominal distance 196 between axis 140 and 146 is approximately twenty six inches. Also that the spacing of the fingers 197, 198, 199 and 200, for example, on conveyor 61 is sufficiently great that when the finger 197 is substantially vertical, the adjacent finger 200 is intersecting the vertical axis 201 which intersects conveyor cylinder axis 146. The effect of this spacing is to create a large effective throat area 202 which can be defined as the maximum distance between the vertical projections of the closest opposed finger tips of fingers which are mounted on the respective cylinders 37 and 57.

Figure 19:
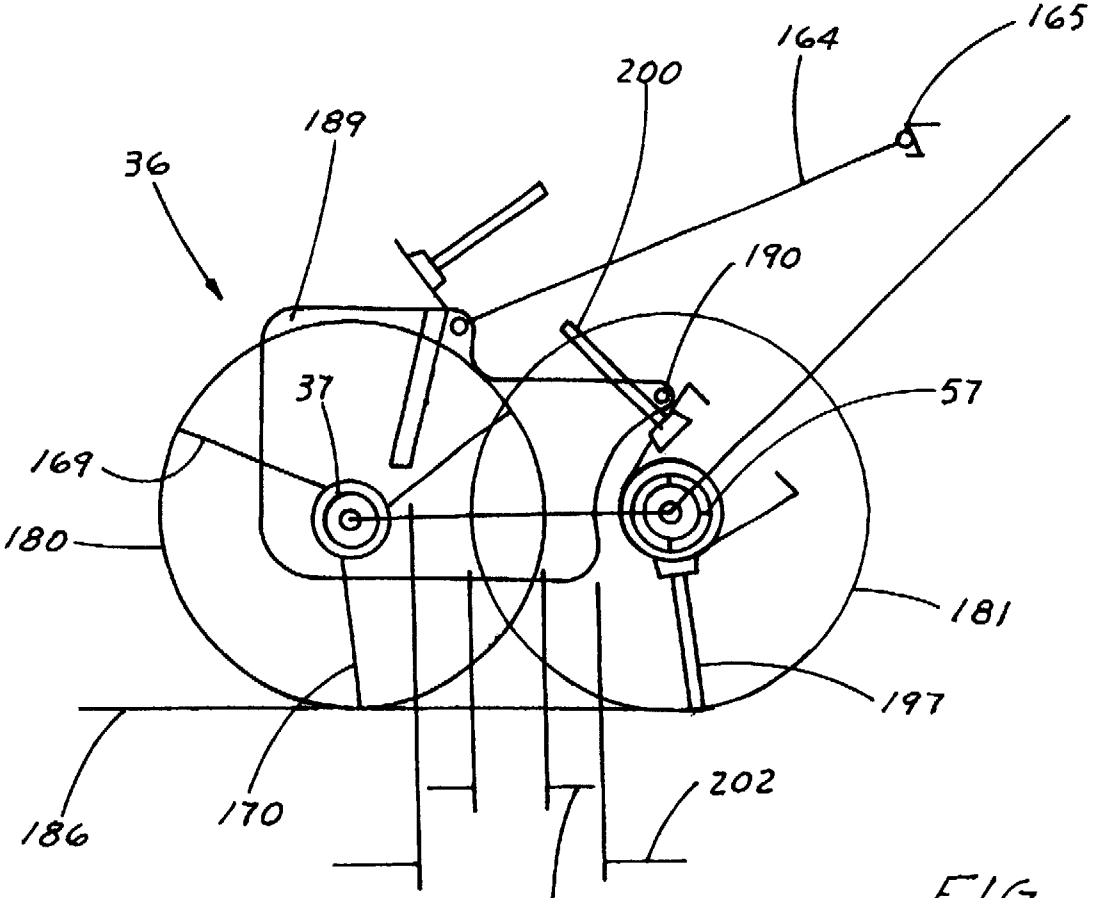
FIG. 19 is a side elevation of a second alternate embodiment of a collector/conveyor assembly utilizing a spring loaded hydraulic ram.
Figure 20:
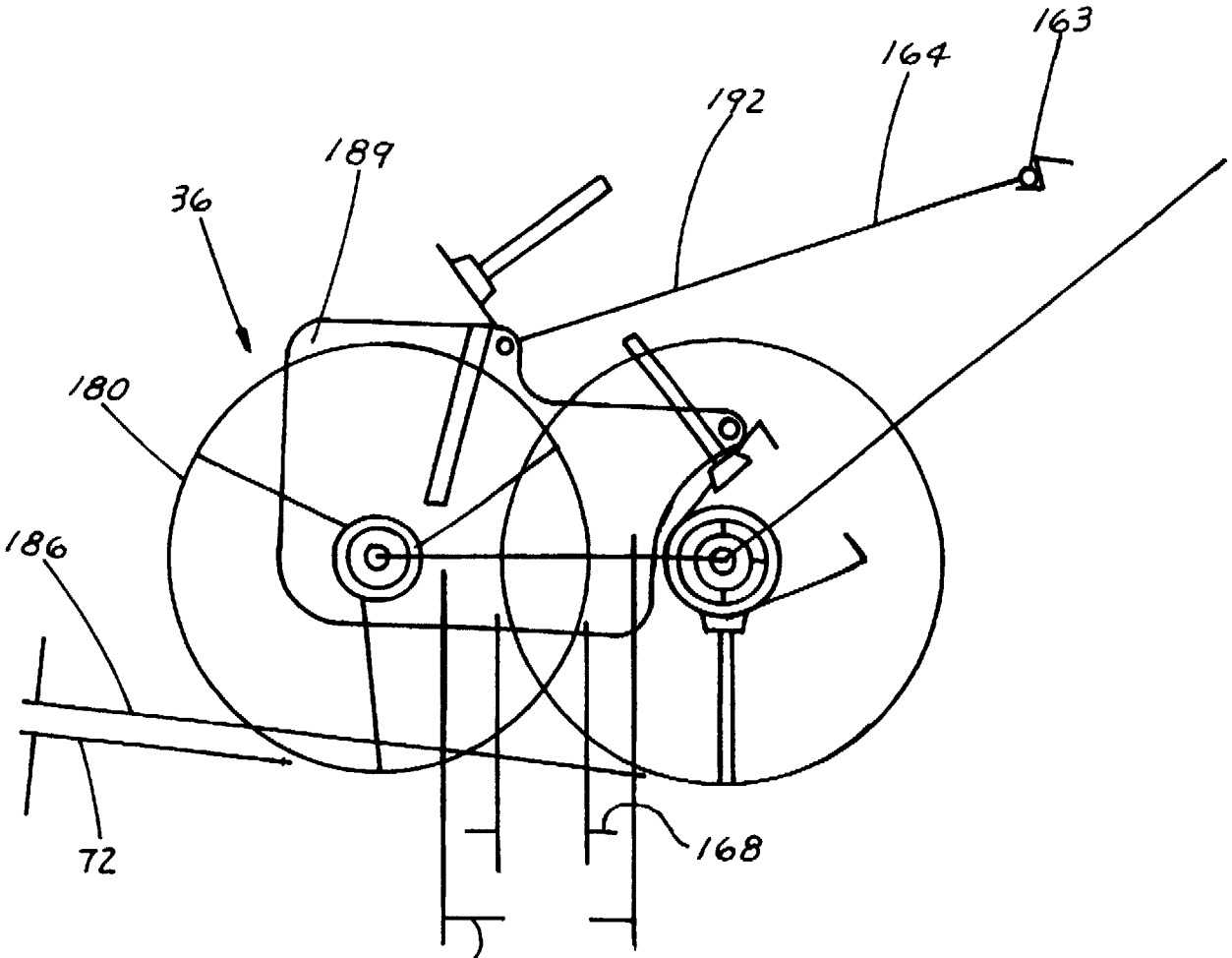
FIG. 20 is a side elevation of the conveyor/collector assembly of FIG. 19 shown in a position of maximum overlap.
Figure 21:
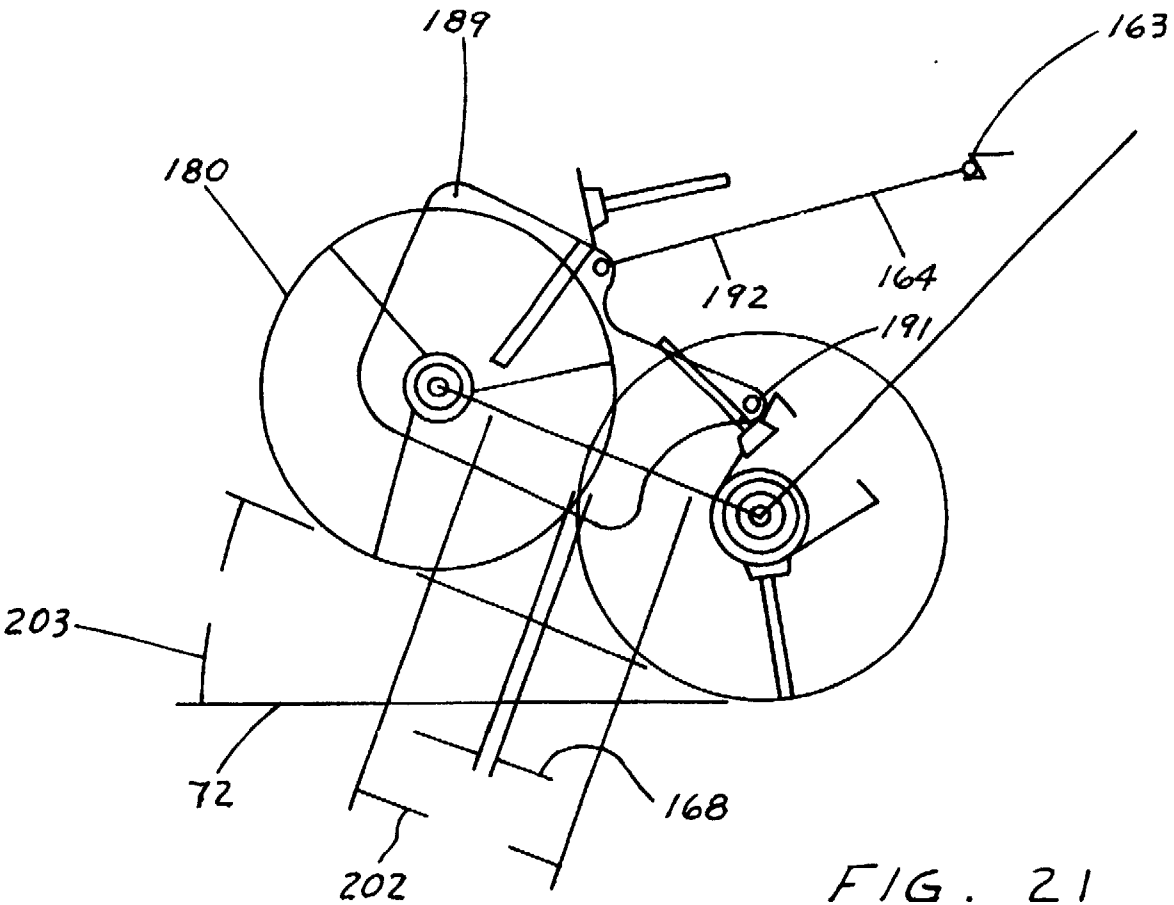
FIG. 21 is a side elevation of the collector/conveyor assembly of FIG. 19 shown in a position of minimum overlap.

Referring to FIG. 19, the ram 164 is fully extended and the tangent line 186 is substantially horizontal. This corresponds to a finger overlap distance 168 of approximately 5.40 inches. The throat width 202 is approximately 14.63 inches. When the road surface 72 is uneven, there will be occasions where the surface 72 slopes downwardly as shown in FIG. 20. The effect of the biasing member 192 is to force the collector cylinder 37 downwardly so as to maintain contact with the road surface 72. Due to the finite length of the assembly formed by ram 164 and biasing member 192, the lowest point of the collector drum contact circle 180 is approximately 2.13 inches below the horizontal line 186. This maximum downward displacement of the curb drum 36 corresponds to the maximum possible finger overlap distance 168 equal to approximately 6.13 inches. The throat opening is reduced to approximately 13.82 inches. The opposite extreme condition occurs when the ram 164 is fully retracted, thereby causing the collector drum 36 to be rotated upwardly through an angle 203 of approximately twenty three degrees. This configuration results in the absolute minimum finger overlap distance 168 of approximately 1.44 inches, while the throat opening distance 202 achieves its absolute maximum value of 18.57 inches.

Figure 51:
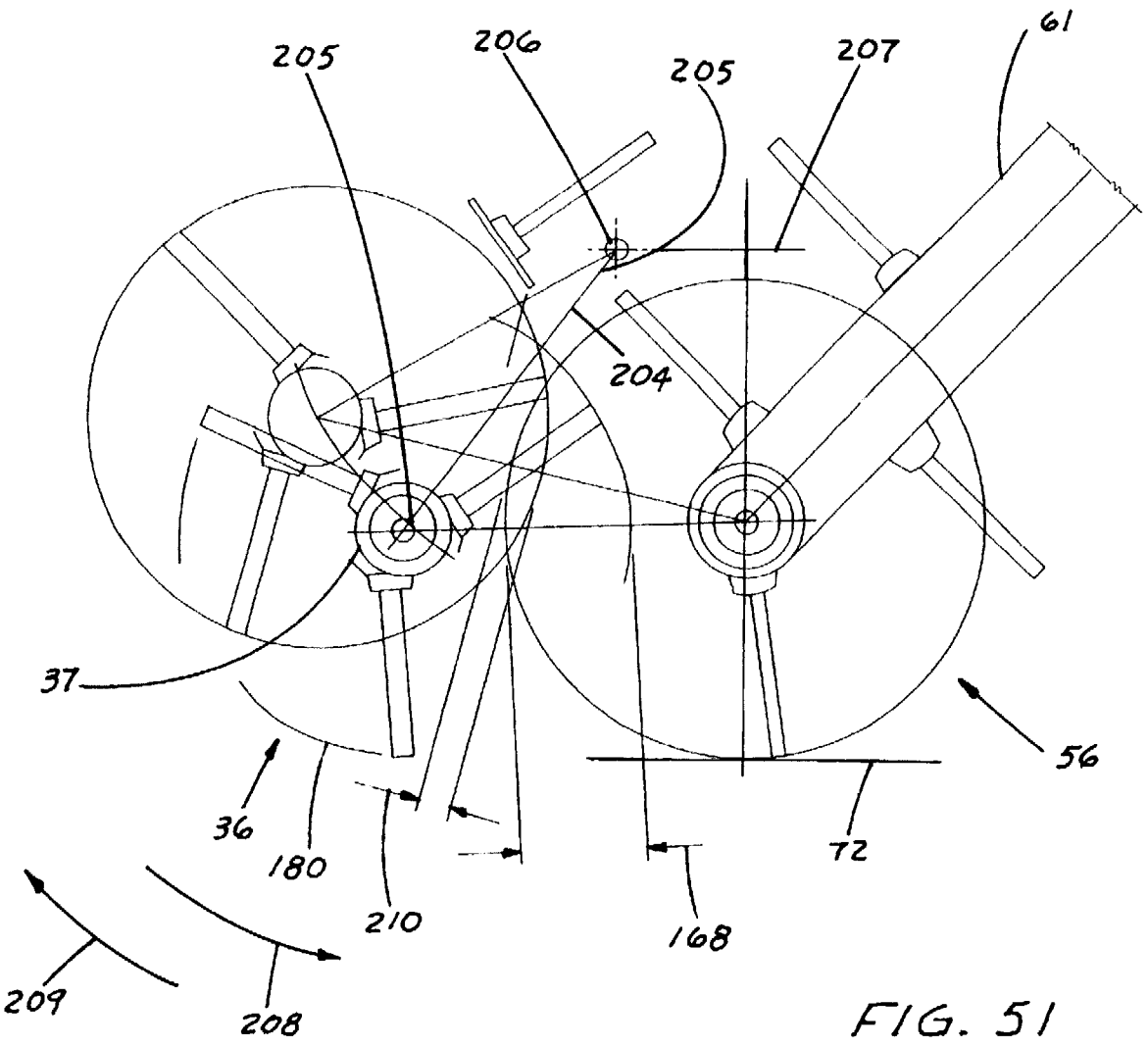
FIG. 51 is a side elevation showing details of the geometrical relationships of the conveyor/collector assembly as depicted in FIG. 18.

Other configurations are possible to achieve different degrees of variation and control over the extent of finger overlap and the size of the throat opening. For example, as depicted in FIG. 51, the collector cylinder 37 can be affixed to the first end 205 of a pivotable arm 204. The second end 205 of the arm 204 is pivotably affixed to pivot pin 206, which is suitably attached to an appropriate frame member 207. When the curb brush contact circle 180 is tangent to a horizontal road surface 72, the finger overlap distance 168 is at its nominal value. If the road surface were to drop downwardly, the curb brush 36 would be permitted to rotate in the direction of arrow 208, which would further increase the finger overlap distance 168. If the road surface were to slope upwardly, the collector brush 37 would rotate in the direction of arrow 209, thereby decreasing the amount of finger overlap to the minimum distance 210. The movement of the pivotable arm 204 could also be controlled by a suitable hydraulic ram or other biasing device as earlier discussed.

Rake and Deflection Bar Configurations

In the preferred embodiments of the present vehicle 1, the collector drum 36 is caused to rotate by hydraulic motor 211 which is mounted at one end of collector cylinder 37. The maximum rotational speed is approximately 300 rpm. While the rotation speed of motor 211 is variable, there will be many instances when the speed chosen will be such that the encountered debris will either flung at such velocity that it will tend travel well over the conveyor belt 61, or more commonly, the debris will not readily separate from the individual collector fingers 169–171. In the latter case, the debris tends to cling to the collector drum assembly 36 and would quickly foul or unbalance the drum 36 if the debris was not removed. Several novel solutions to this problem are disclosed here.

First, as best seen in FIGS. 1, 28, 29 and 44, a rake assembly 212 is mounted above and somewhat behind the collector cylinder 37. The rake assembly 212 includes a laterally extending horizontal bar 213 which is rigidly affixed to the end plates 141 and 142. Extending downwardly are a series of cantilevered ejection bars 214, 215, 216 and 217, for example, which have their upper ends rigidly affixed to the horizontal bar 213. The ejection bars 214–217 tilt forwardly at an angle of approximately twenty degrees such that their lower ends 218 and 220, for example, are several inches forward of the horizontal bar 213. The nominal clearance 219 between the surface of collector cylinder 37 and ejection bar lower ends 218 and 220 is approximately two inches, and may be adjusted by varying the mounting position of horizontal bar 213 on the end plates 141 and 142. There is one ejection bar 214, 215, etc. residing between each adjacent pair of collector drum fingers 221, 222 and 223, for example, as each row 169–171 of fingers passes beneath the horizontal member 213. The ejector bars 214, 215, etc. are preferably constructed of a rigid material, such as steel.

Figure 23:
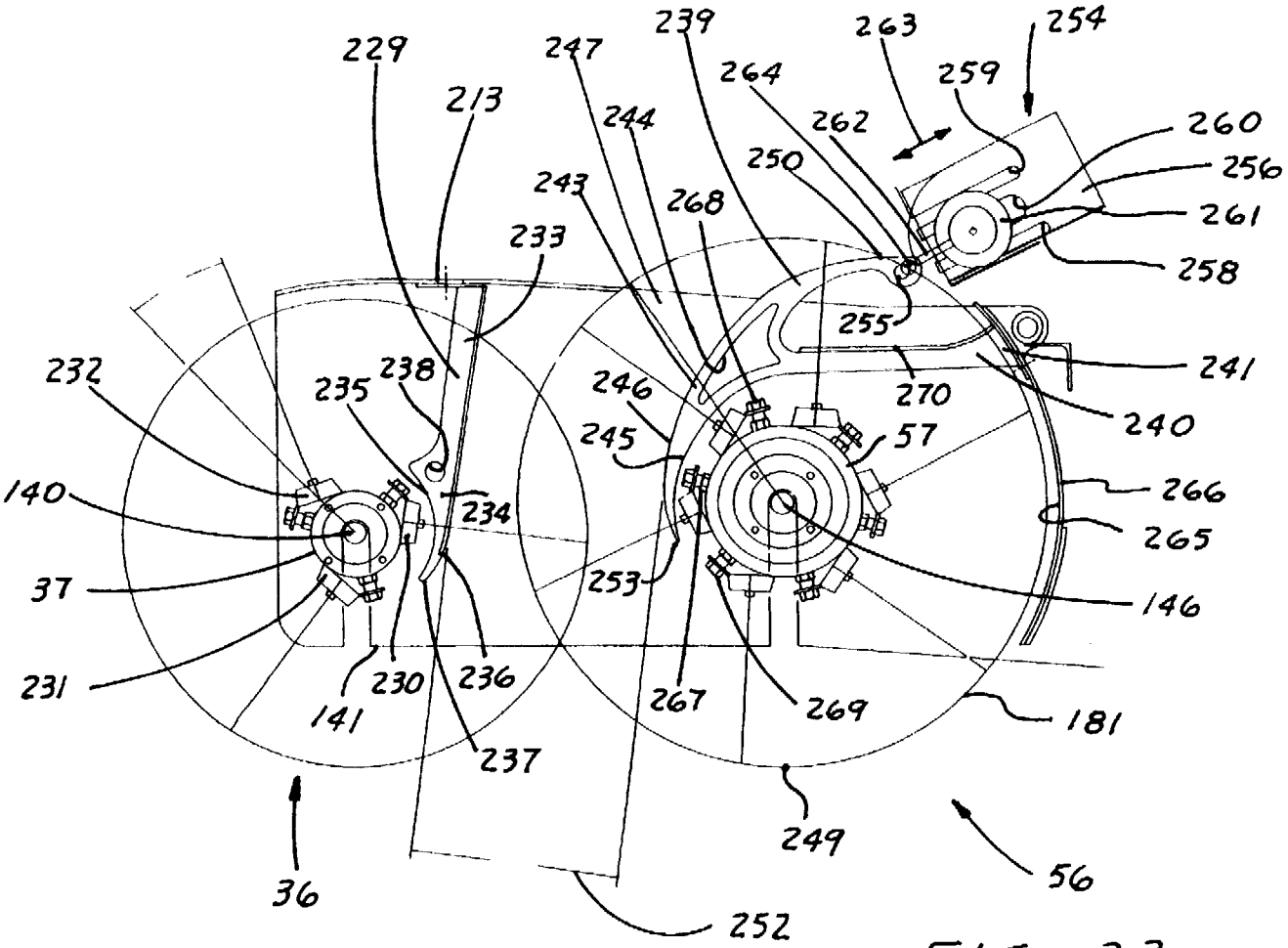
FIG. 23 is a side elevation of the collector/conveyor assembly depicted in FIG. 1 showing details of the deflection bar configuration.
Figure 24:
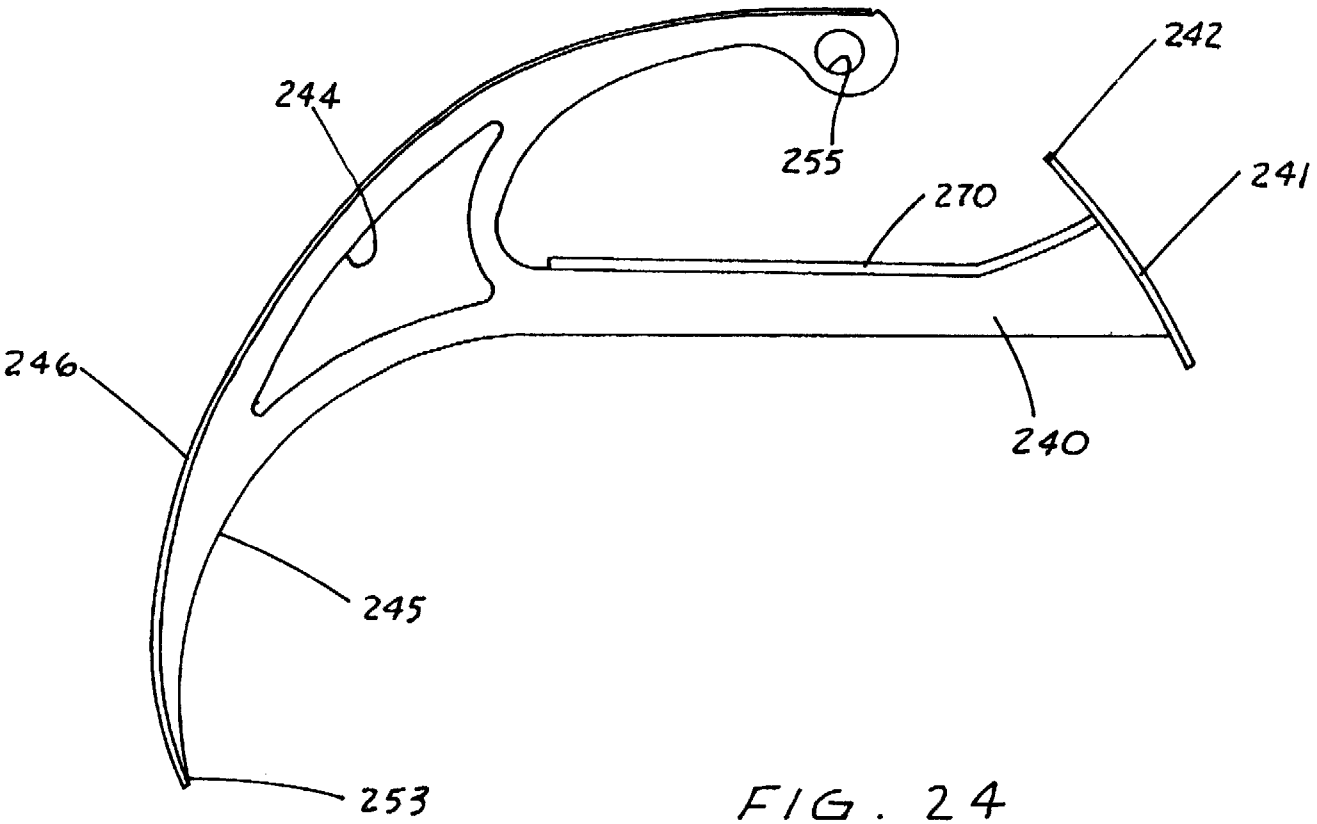
FIG. 24 is a side elevation of the rear deflection bar depicted in FIG. 23.

A second type of ejection bar 229 is depicted in FIG. 23 which is useful in stripping debris not only along the length of the collector fingers but also near the base 230, 231 and 232 of each collector finger. The ejection bar 229 is formed with a substantially linear base portion 233 which is rigidly affixed to horizontal bar 213. The tip region 234 is formed to include a concave inner surface 235 which defines an arc which is approximately concentric with the longitudinal axis 140 of the collector cylinder 37. A lightening hole 238 is formed through the tip region 234, which is typically composed of a relatively massive material such as steel. The bar 229 includes an outer surface 236 which tapers so as to form a pointed region 237 which is displaced approximately three inches above the surface of the collector cylinder 37. The tip 237 is also vertically displaced approximately three inches below the longitudinal axis 140. This positioning is advantageous because it places the tip 237 in a region which will encounter much of the debris flung outwardly from the surface of cylinder 37 as it rotates even if a portion of the debris is clinging to the cylinder 37 or the base 230 of the rubber fingers.

While the ejection bars 214, 215, etc. are effective in stripping or ejecting debris trapped between the fingers, there is still the problem of debris which becomes dislodged from the fingers as the debris comes within the arc 181 of the lower conveyor drum 56. Due to the complementary motions of the collector and conveyor drums in their region of overlap 224, some debris is propelled in the substantially vertically as shown by the direction of arrow 225. Such debris is unlikely to travel into contact with the conveyor 61 and instead will be deposited onto or behind the vehicle 1. In order to recapture such debris, a row of deflection fingers, such as finger 226, is mounted on top of the horizontal bar 213. The finger 26 may be of the rubber type used for the previously discussed fingers 221, 222, etc. The resilience of the finger 226 is helpful in deflecting debris downwardly onto the conveyor 61, rather than causing ricochets in random directions as can occur with a harder or stiffer material. The finger 226 is mounted in a cantilevered fashion with its base 228 affixed to a metal strip or plate 227, the plate 227 being attached to the horizontal bar 213. The finger 226 is mounted such that its longitudinal axis is inclined at an angle of approximately forty five degrees to a vertical plane. This angle tends to deflect debris along an approximately horizontal path which is likely to encounter conveyor belt 61.

Material which is swept upwardly and rearwardly by the collector drum 36, and forwardly and upwardly by lower conveyor drum 56, is further guided onto the conveyor belt 61 by the rear ejection screen bar 239, which is best seen in FIGS. 23 through 27. The rear bar 239 is formed to include a substantially horizontal base member 240 having a first end formed as a slightly convex foot 241. A wear plate 242 is affixed to the foot 241 and conforms to the foot's surface shape. The second end of the base member 240 terminates at head 243. A lightening opening 244 is formed in the region where the head 243 joins base member 240.

The shape of the inner surface 245 of the head 243 is curved so as to approximate an arc that is concentric with the longitudinal axis 146 of lower conveyor cylinder 57. The radius of the inner surface 245 is such that it clears the surface of cylinder 57 by approximately two inches. The shape of the outer surface 246 of head 243 is based on the desired shape of the region 247, which is a crescent like shape defined by the area between the finger tip arc 181 and the outer surface 246. The shape of region 247 is based on the principle of Archimede's curve, which has a increasing radius R that is dependent on the angular velocity w of a rotating body, which in this case is the lower conveyor cylinder 57. Assuming a nominal angular velocity for the conveyor cylinder 57 of 243.00 rpm and a minimum radius 248 of 7.625 inches, the shape of the outer surface 246 can be derived as follows:

$$R = a \times \text{theta}$$

$$\text{where } a = v/w \text{ and}$$

$$w = 243.00 \text{ rpm}$$

$$\text{when theta} = 3.14156 \text{ (pi radians)}$$

$$R = 7.625$$

$$a = 2.427 \text{ and}$$

$$v = 2.427 \times 243 \times 3.14156/30 = 61.763 \text{ inches/second}$$

Figure 25:
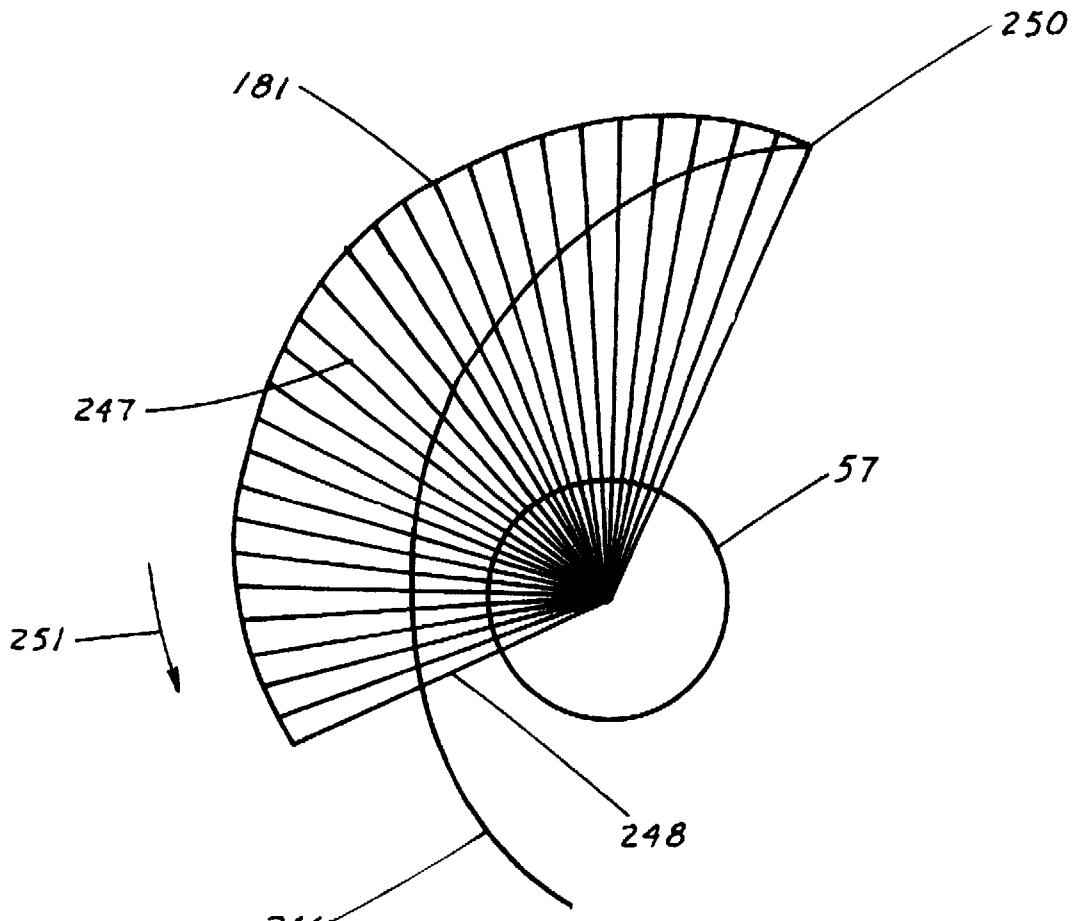
FIG. 25 is a schematic diagram depicting the geometrical construction of the deflection bar shown in FIG. 24.
Figure 27:
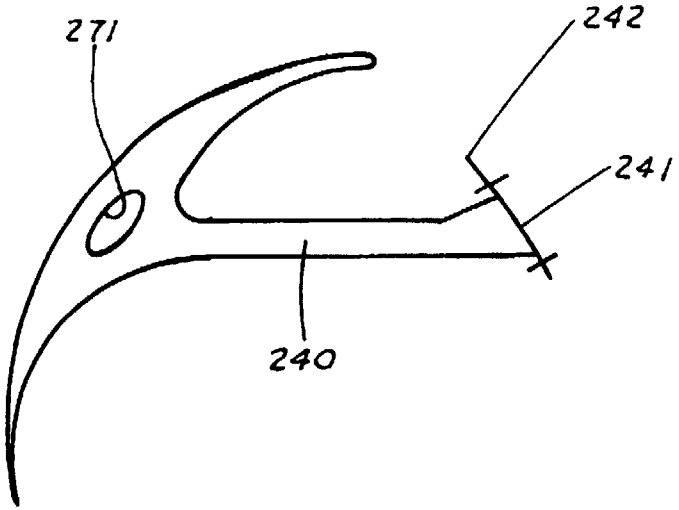
FIG. 27 is a side elevation of a second alternate embodiment of a rear deflection bar.

Assuming that an angle of zero degrees corresponds to the lowest point 249 on arc 181, then for clockwise angles between 66° and 205°, then the value of theta which will permit calculation of each value of R between 66° and 205° is 2×3.14156+(angle between 66° and 205°)×3.14156/180. As seen in FIG. 25, the curve 246 corresponds to a constant radius curve with a fixed upper end point 250 that has been rotated in the direction of arrow 251 by an angle of 23.69°. This particular shape for outer surface 246 has been found to be particularly advantageous for directing debris through the throat 252 and onto conveyor belt 61. In a preferred embodiment using the deflection bars 229 and 239, the nominal throat opening 252 is 13.38 inches.

The outer surface 246 and the inner surface 245 converge at tip 253 which is vertically displaced approximately three inches below the longitudinal axis 146 of lower conveyor cylinder 57. The surface 246, wear plate 242 and the upper surface 270 are all formed of flat iron bar material approximately 0.125 inches thick and 0.75 inches wide. The surface 246 is approximately 30.5 inches in length, allowing for a small overlap past the tip 253 of the underlying material. The deflection bar 243 is formed to include a mounting hole 255 near the upper end point 250 so that the bar 243 may be secured in place by a pin 264. The position of the deflection bar 243 may be adjusted with respect to the cylinder 57 by means of adjustment assembly 254. The adjustment assembly includes a plate 256 which is mounted to a suitable support member such as conveyor shield 257 visible in FIG. 1. The plate 256 is formed to include three parallel guide channels 258, 260 and 259. A pivotable stem support 261 is retained within the guides 258–260.

A stem 262 extends outwardly from the stem support 261 and engages the pin 264 within mounting hole 255. The mounting assembly 254 permits the conveyor deflection bar 243 to move linearly in the direction of arrow 263, and to be rotated about pin 255 in order to achieve the desired spatial relationship with lower conveyor cylinder 57. The wear plate 242 on the foot 241 of the deflection bar 243 abuts the inner surface 265 conveyor drum shield 266. The shield 266 serves as a stop to prevent the inner surface 245 of deflection bar 243 from contacting the mounting hardware 267, 268 and 269, for example, on the surface of cylinder 57.

Figure 26:
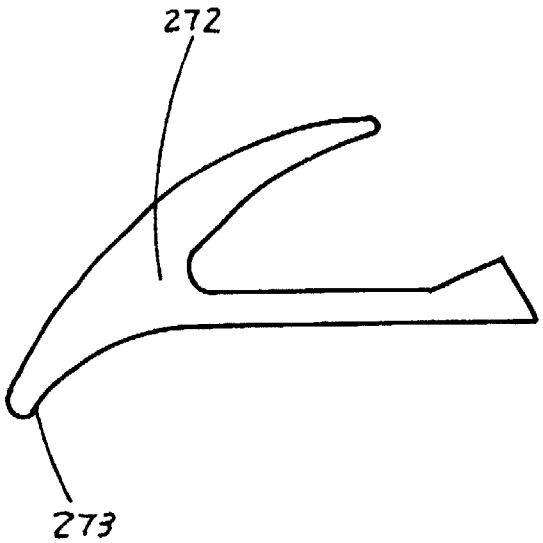
FIG. 26 is a side elevation of a first alternate embodiment of a rear deflection bar.
Figure 28:
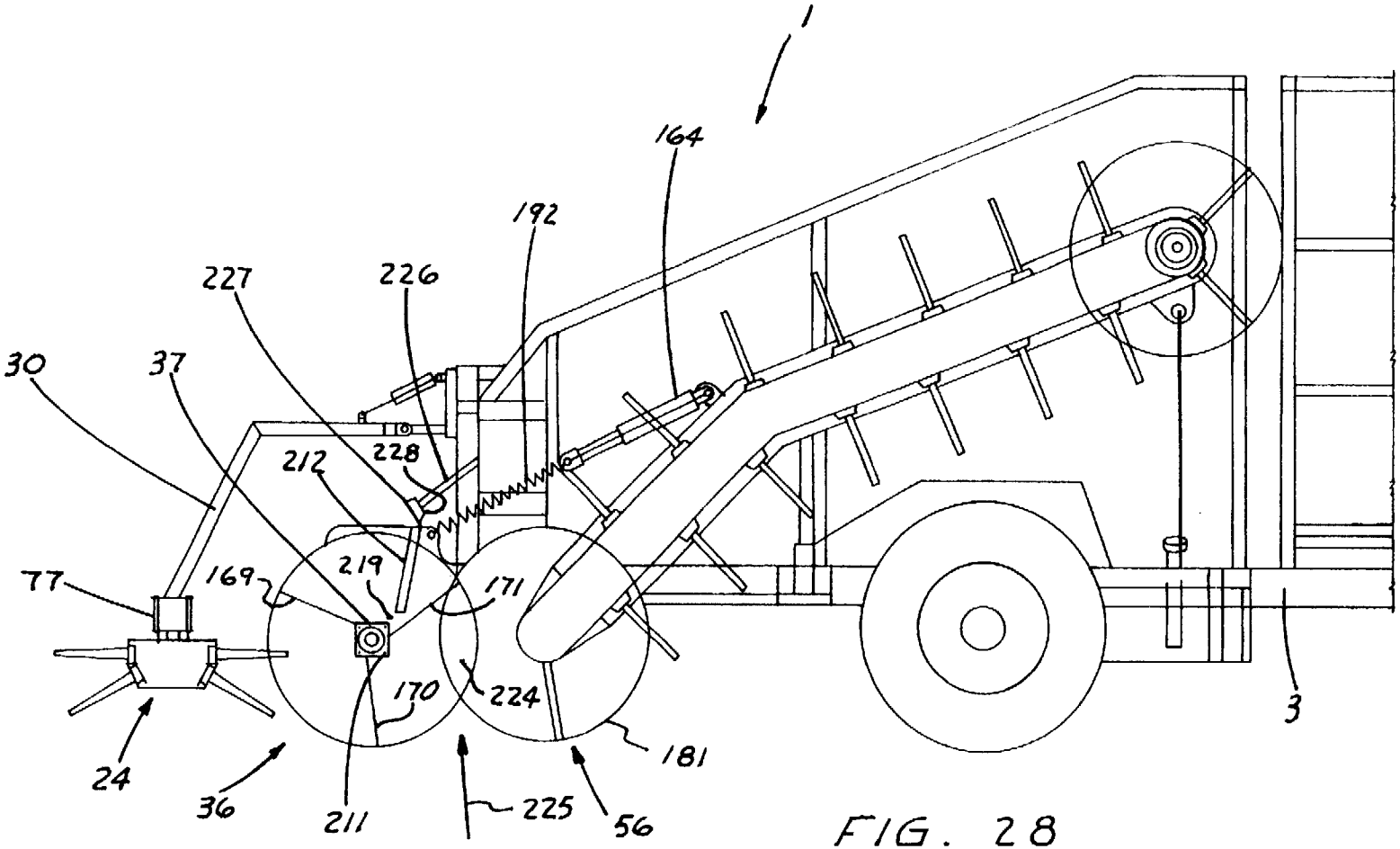
FIG. 28 is side elevation of the debris collection vehicle depicted in FIG. 5 showing details of the conveyor/collector assembly including a spring loaded hydraulic ram.
Figure 29:
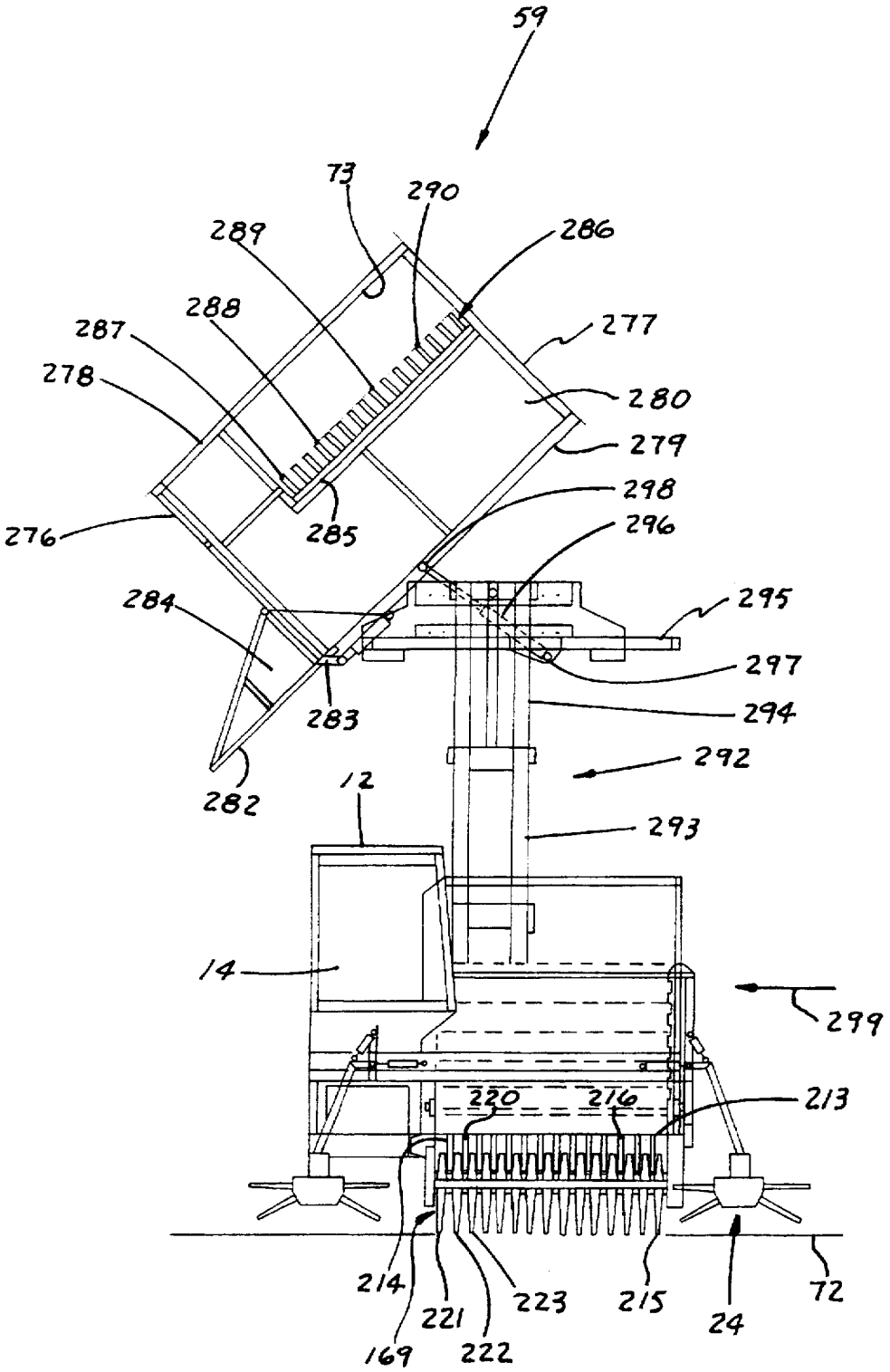
FIG. 29 is a front elevation showing the hopper in a discharge position.

Other configurations of the deflection bar are possible. For example, in FIG. 27, the lightening hole 271 is relatively smaller and substantially elliptical in shape. In FIG. 26, the ejection member 272 is formed without a lightening hole. The tip 273 is relatively blunt, as may be more appropriate in the collection of particularly hard, dense material, such as debris containing a substantial proportion of rocks and gravel.

Disposal of Collected Debris

The following discussion is best appreciated with reference to FIGS. 2, 29 and 31–32. As previously described, the collected debris is transferred onto the moving conveyor 61 which is traveling generally in the direction of arrow 275. A shield 274 displaced above the conveyor belt 61 prevents debris from being flung over the collection hopper 59. Instead, the debris is directed through the opening 73 of the hopper 59, which will eventually become filled with debris and require emptying. Hopper 59 is formed generally as a rectangular container having sidewalls 276 and 274 and an upper surface 278 and a bottom surface 279, and front and rear walls 280 and 281, respectively. A generally rectangular door 282 swings downwardly about hinge line 283, and is formed to include a pair of retaining walls 284. The opening 73 is formed within an upper region of the front wall 280.

Along the lower edge 285 of the opening 73 is a row 286 of rubber fingers 287, 288, 289 and 290, for example. Each finger 287, 288, etc., is inclined at an angle of approximately sixty degrees from the vertical sidewall 280, and extends outwardly from the opening 73 toward the cab 12 for a distance of approximately ten inches. The fingers 287, 288, etc., are substantially identical in construction to the finger 53 as depicted in FIGS. 10 and 11. The hopper fingers 287, 288, etc., are laterally offset from the conveyor fingers 67, 68, 69, etc., of the conveyor 61, such that the conveyor fingers pass between the adjacent hopper fingers as the conveyor fingers pass over the upper conveyor cylinder 58. In this manner, the hopper fingers 67, 68 tend to strip any debris that may be clinging to the conveyor fingers 287, 288 and subsequently direct the debris into the hopper 59.

The hopper 59 resides within a region 291 behind the conveyor belt 61 and above the vehicle frame 3. The hopper 59 is supported by an hydraulic lift assembly 292 which is mounted to frame 3 and which defines the rearward boundary of region 291. The lift assembly 292 includes a telescoping vertical arm 293 which supports an upper member 294. Rigidly affixed to the upper arm is a horizontal platform 295 upon which the bottom surface 279 of hopper 59 rests. An hydraulic ram 296 has a first end 297 which is pivotably affixed to the platform 295. The second end 298 is pivotably affixed to the front sidewall 280 of hopper 59.

The hopper may be emptied in one of two ways. First, the ram 296 may be extended while the hopper 59 is retracted within the region 291, thereby tilting the hopper and allowing door 282 to swing open. A second method of emptying the hopper 59 is to first extend the lift assembly 292 to a desired height and then extend the ram 296. Either of these methods may be performed by the operator alone by appropriate manipulation of the control panel 300. Alternatively, the lift assembly 292 may be retracted and a full hopper 59 may be exchanged with another identical hopper by sliding the hoppers laterally in the direction of arrow 299 and thus through the region 291.

Alternative Vehicle Configurations

Figure 33:
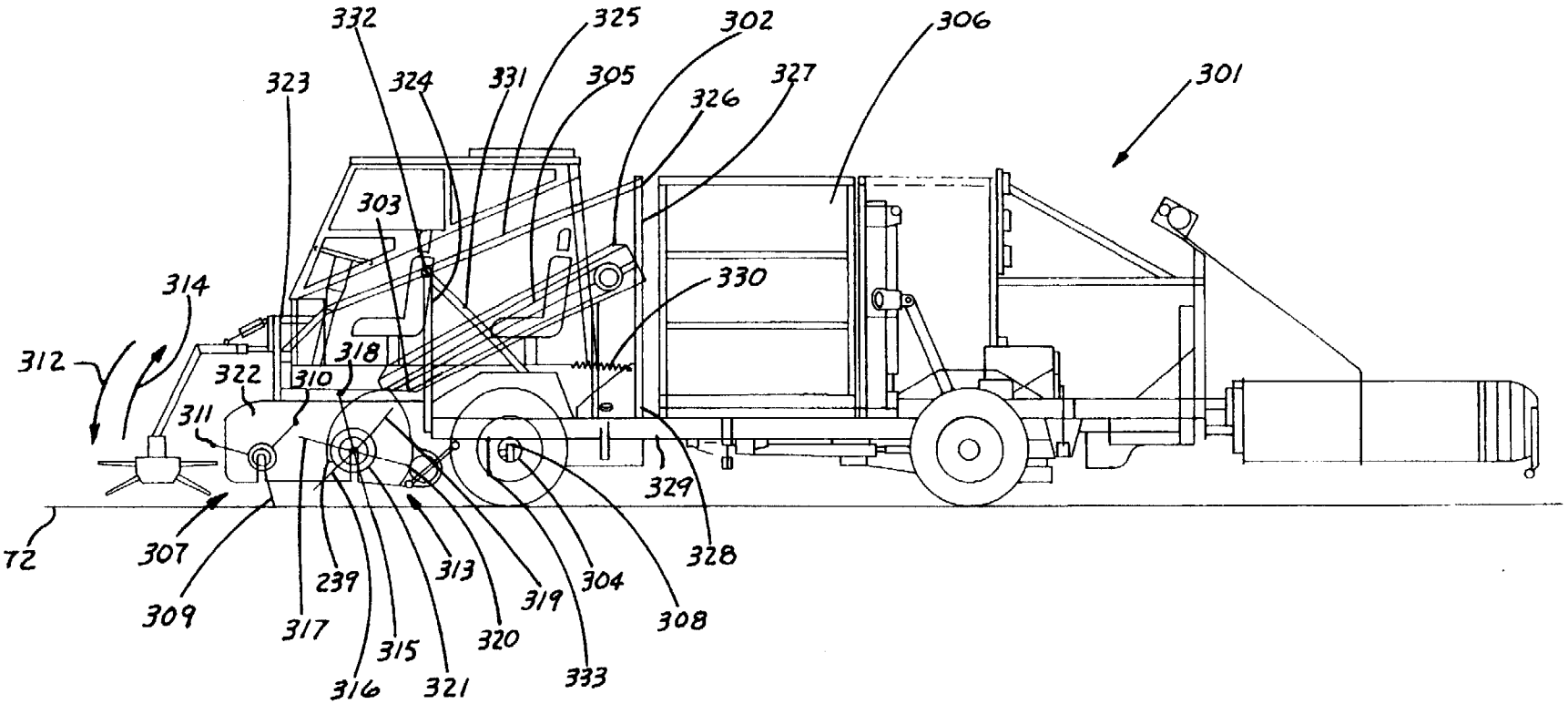
FIG. 33 is a left side elevation of a debris collection vehicle utilizing a straight conveyor.

The basic concepts of the present debris collection vehicle 1 can be modified in a variety of ways as may be appropriate for the type of debris to be collected and depending on the environment in which the vehicle operates. Referring to FIG. 33, an alternative vehicle 301 is disclosed utilizing a straight conveyor 302. The lower conveyor drum 303 is elevated such that it resides above the longitudinal axis 308 of the vehicle front axle 304. This arrangement results in a relatively shorter conveyor 302, and elevates the belt 305 well above the road surface 72, thereby reducing the opportunity for collisions of the belt 305 with stationary objects on the road. The belt 305 is inclined at an angle of approximately thirty degrees with respect to the road surface 72.

This relatively shallow angle of inclination permits the belt 302 to operate without the benefit of large rubber fingers in order to successfully transport debris to the hopper 306. Instead, cleats having a height of approximately 2.50 inches are spaced in rows along the width of belt 302.

In order to successfully transfer debris to the belt 302, a first collection drum 307 is used having rubber fingers arranged in three rows 309, 310 and 311. The collection drum 307 rotates at speeds of 50–300 rpm in the direction of arrow 312. Entrained debris is thus flung rearwardly and upwardly, where it encounters a second collection drum 313. The second collection drum 313 rotates at a speed independently of first drum 307 in the range of 50–300 rpm and in the direction of arrow 314. The second drum 313 includes six rows 315, 316, 317, 318, 319 and 320 of rubber fingers 53 of the type depicted in FIGS. 10 and 11. The individual fingers are mounted so as to be substantially perpendicular to the surface of drum cylinder 321. A deflection bar 239 similar to the type depicted in FIG. 23 is mounted adjacent to the drum cylinder 321.

The first and second collection drums 307 and 313, respectively, are secured to end plates 322 which are supported by the lower ends of vertical frame members 323 and 324. An inclined frame member 325 is pivotably affixed to the upper ends of vertical members 323 and 324, and extends rearwardly to join the upper end 326 of vertical member 327 at a pinned connection.

The lower end 328 of vertical member 327 is rigidly affixed to vehicle frame 329. Connected approximately one foot above the lower end 328 is a biasing member 330. The biasing member 330 is pivotably affixed to an inclined frame member 331 which extends between the pinned junction 332, where member 324 joins member 325, and the portion of the vehicle frame adjacent to wheel well 333. The biasing member tends to suspend the combination of collection drums 307 and 313 above the road surface 72 while allowing movement over stationary objects that may be encountered during forward movement of vehicle 301.

Figure 34:
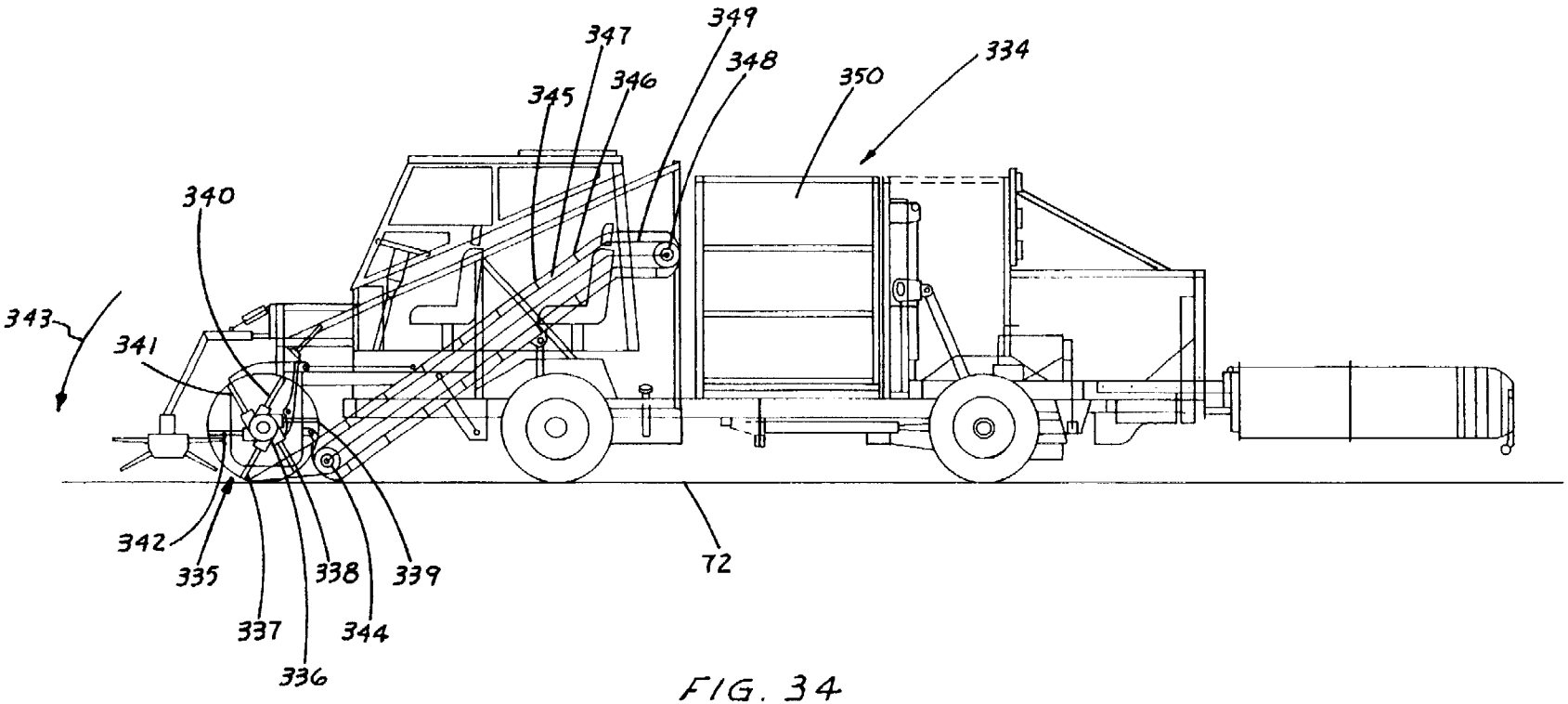
FIG. 34 is a left side elevation of a debris collection vehicle utilizing a horizontal conveyor discharge configuration.
Figure 37:
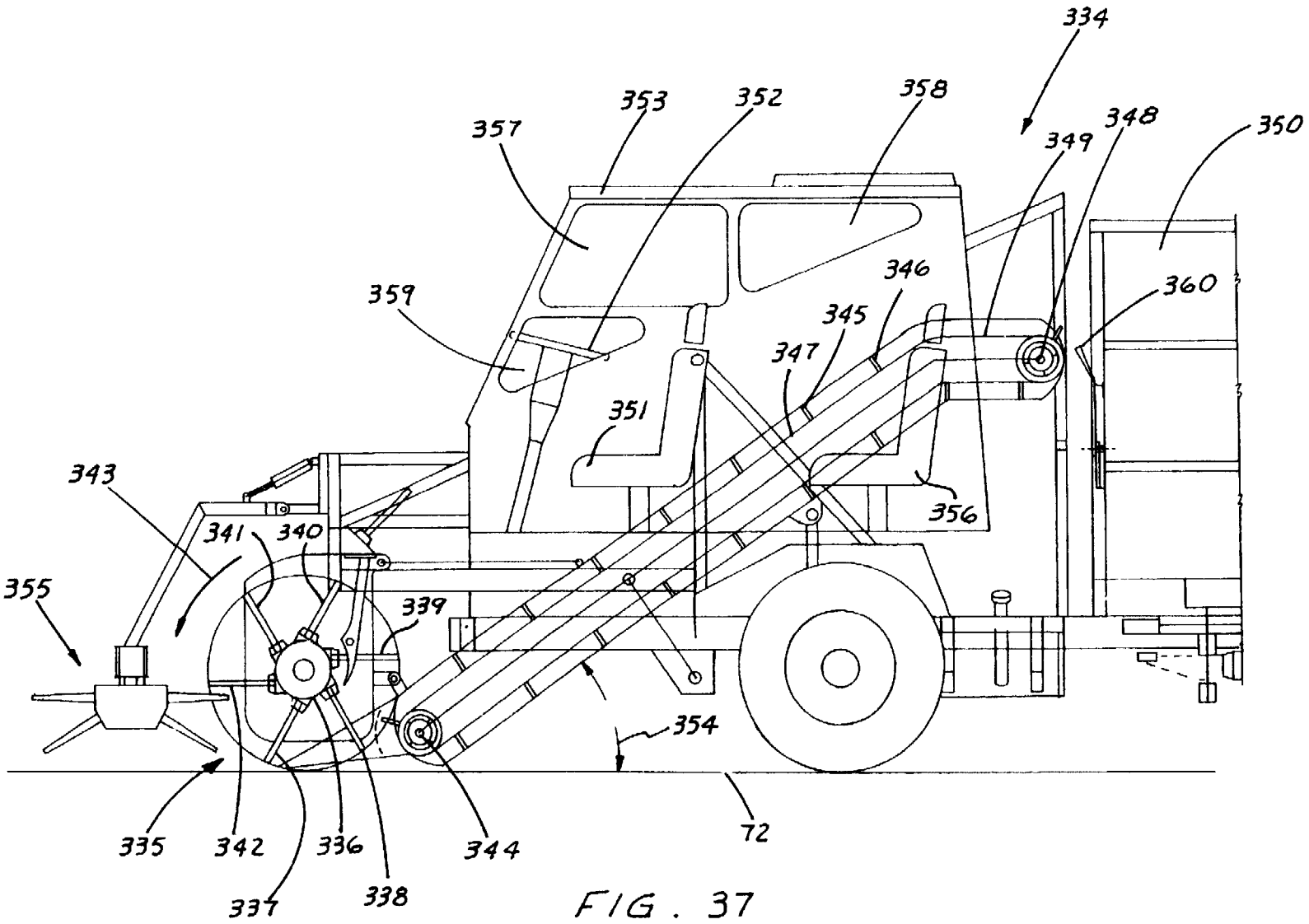
FIG. 37 is a left side elevation of the debris collection vehicle depicted in FIG. 34, showing details of the collector/conveyor assembly.

A second alternative arrangement of a debris collection vehicle is shown in FIGS. 34 and 37, where vehicle 334 includes a single collection roller 335. Collection roller 335 has mounted on its surface 336 six rows 337, 338, 339, 340, 341 and 342 of rubber fingers such as rubber finger 53 depicted in FIGS. 10 and 11. The fingers 53 are mounted so as to be inclined away from the direction 343 of travel by approximately thirty degrees from perpendicular. The lower cylinder 344 is displaced behind and below the collector cylinder 336, and clears the road surface 72 by approximately three inches. A series of cleats 345 and 346, for example, are placed in rows on the surface of conveyor belt 347. Each cleat 345, 346 is approximately three inches in height. In the vicinity of lower cylinder 344, the conveyor belt 347 is inclined at an angle 354 of approximately thirty five degrees, and this angle of inclination continues until approximately two feet before reaching the region 349 adjacent to upper conveyor cylinder 348. In the region 349, the conveyor belt 347 travels in a substantially horizontal direction. Thus, the transported debris tends to be traveling substantially horizontally just prior to entering collection hopper 350. A rake structure 360 at the entrance to the hopper 350 permits entrained debris to be stripped from the cleats 345, 346 as the conveyor passes over the upper conveyor drum 348.

As best seen in FIG. 37, the driver of vehicle 334 siting in the forward seat 351 has access to the steering wheel 352 and unrestricted visibility from cab 353 to curb brush 355, collector 335 and conveyor 347, where the progress of debris on the conveyor 347 can be observed and appropriate adjustments can be made to the relative speeds of the conveyor 347 and the collector 335. Numerous windows in the cab 353, such as windows 357, 358 and 359 permit both the driver and the passenger to observe both traffic and debris collection operations.

Figure 38:
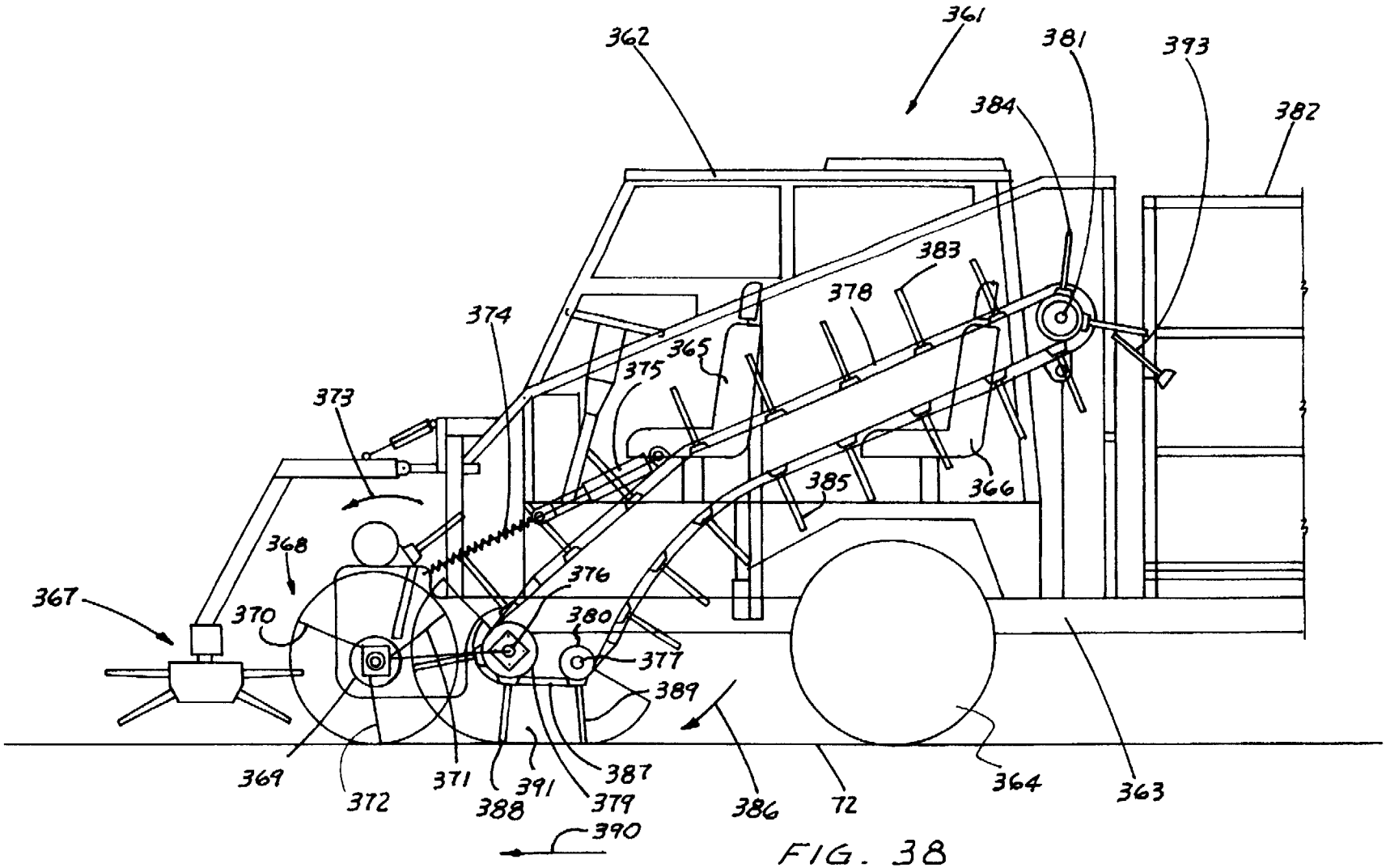
FIG. 38 is an alternate embodiment of the debris collection vehicle depicted in FIG. 37 utilizing a modified conveyor structure.

A third alternative embodiment of the debris collection vehicle is shown in FIG. 38. The vehicle 36 includes a cab 362 riding on vehicle frame 363 and supported by forward tires 364. The cab includes a driver seat 365 and a tandem operator position 366. A forwardly disposed curb brush 367 is manipulated from the operator position 365. Attached to the frame 363 is a collection drum 368 which is disposed forwardly of the cab 362. The drum axle 369 supports three rows 370, 371 and 372 of resilient fingers which are inclined at an angle of approximately thirty degrees to a radial line extending outwardly from axle 369. The collector drum 369 rotates in the direction of arrow 373 at speeds of as much as 300 rpm. The collection drum 368 is biased to hover above the road surface 72 by means of spring 374, which is interconnected to hydraulic ram 375. The ram 375 permits the collector drum 368 to be raised to a transport position well above road surface 72 as is appropriate when the vehicle 361 is in motion but is not in the process of debris collection.

Located rearwardly from the collector drum 368 is a lower forward conveyor axle 376. Approximately twelve inches behind the axle 376 is a lower rearward conveyor axle 377. A conveyor belt 378 extends continuously on a path that includes a portion of the perimeters 379 and 380, respectively, of the conveyor axles 376 and 377. The conveyor belt 378 continues on a path that encompasses upper conveyor axle 381, which is located near the entrance to the debris collection hopper 382 behind cab 362. A number of perpendicularly disposed resilient fingers, such as fingers 383, 384 and 385, for example, are mounted in rows extending across the width of the belt 378. The motion of the conveyor 378 is caused by rotation of upper conveyor axle 381 in the direction of arrow 386, such rotation being at a rate in the range of 10–300 rpm.

The orientation of the tandem lower conveyor axles 376 and 377 is such that the region 387 of the conveyor belt 378 is tangent to the lowest portion of the perimeters 379 and 380, respectively, of the lower conveyor axles 376 and 377. The region 387 of belt 378 is substantially horizontal and parallel to the road surface 72. The rows of fingers 388 and 389 adjacent to region 387 are caused to move generally in the direction of arrow 390. This creates a substantially enclosed volume 391, defined by the belt 387, the finger rows 388 and 389 and the road surface 72, which is constantly being swept forwardly in the direction of arrow 390 so as to entrain the debris collected by collection drum 368. The entrained debris then travels along the conveyor belt 378 until it reaches the vicinity of hopper 382 where it is stripped by rake structure 393.

Figure 39:
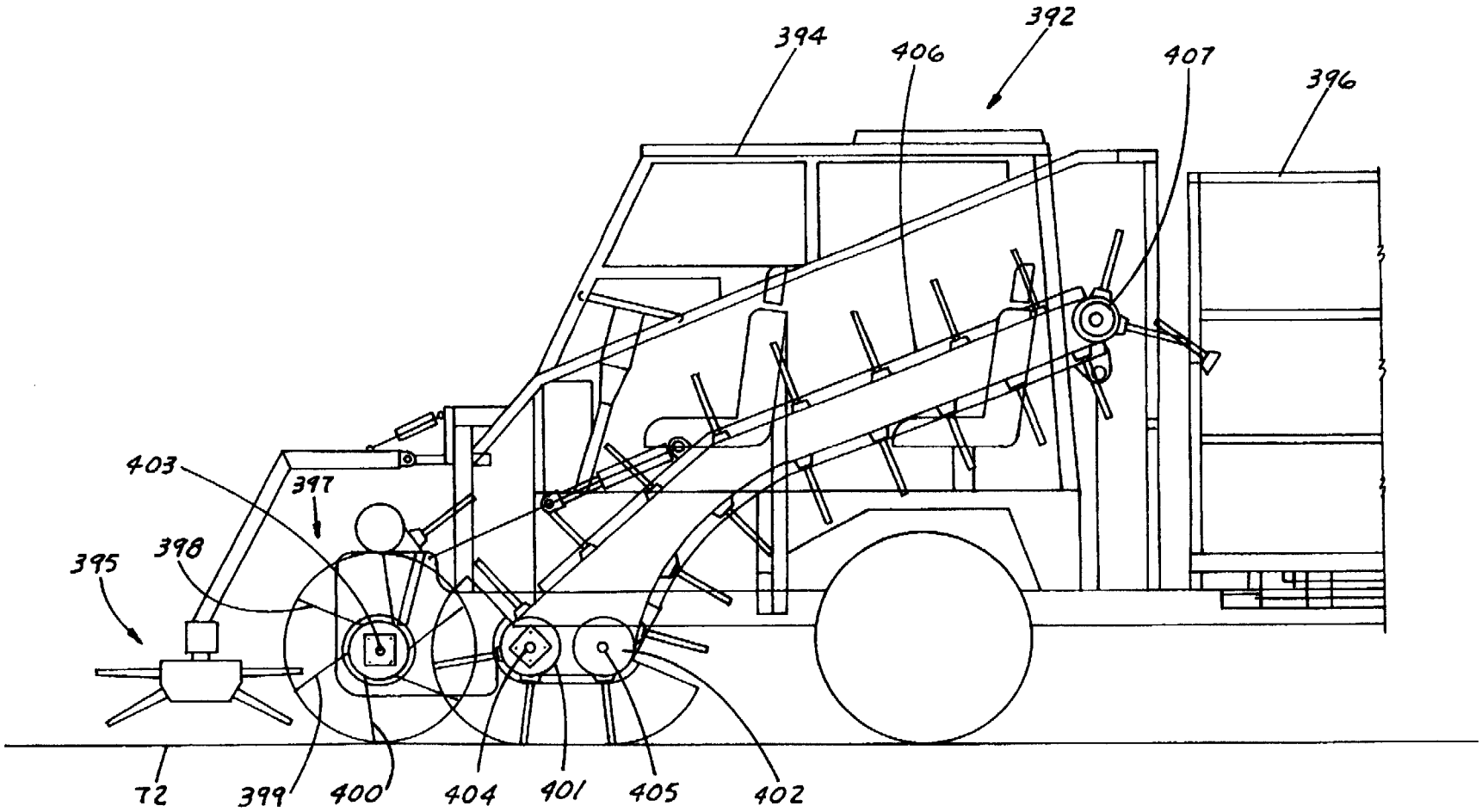
FIG. 39 is an alternate embodiment of the debris collection vehicle depicted in FIG. 38 utilizing a modified finger roller assembly.
Figure 40:
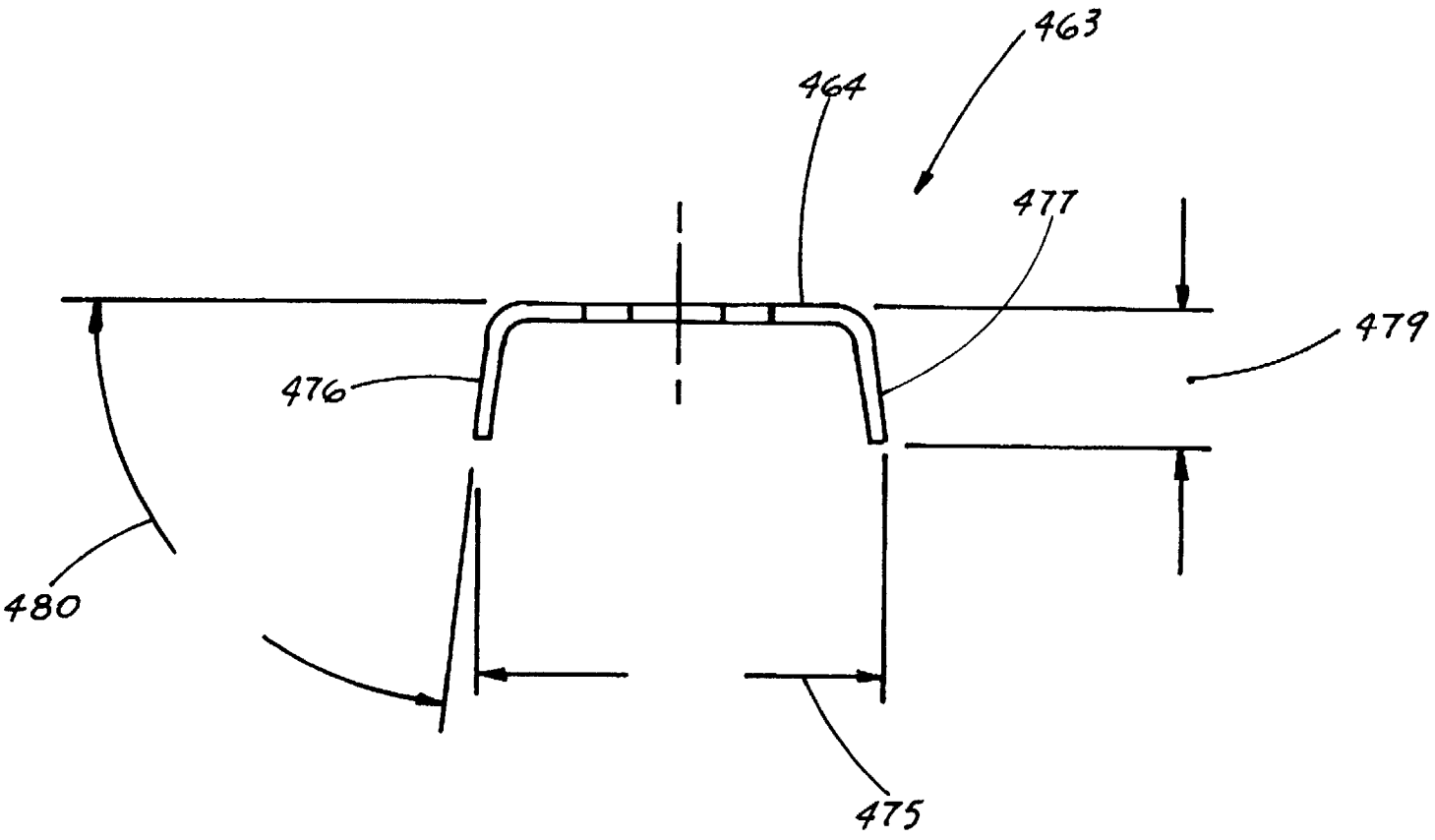
FIG. 40 is an end elevation of a finger attachment device utilized in the debris collection vehicle depicted in FIG. 1.
Figure 41:
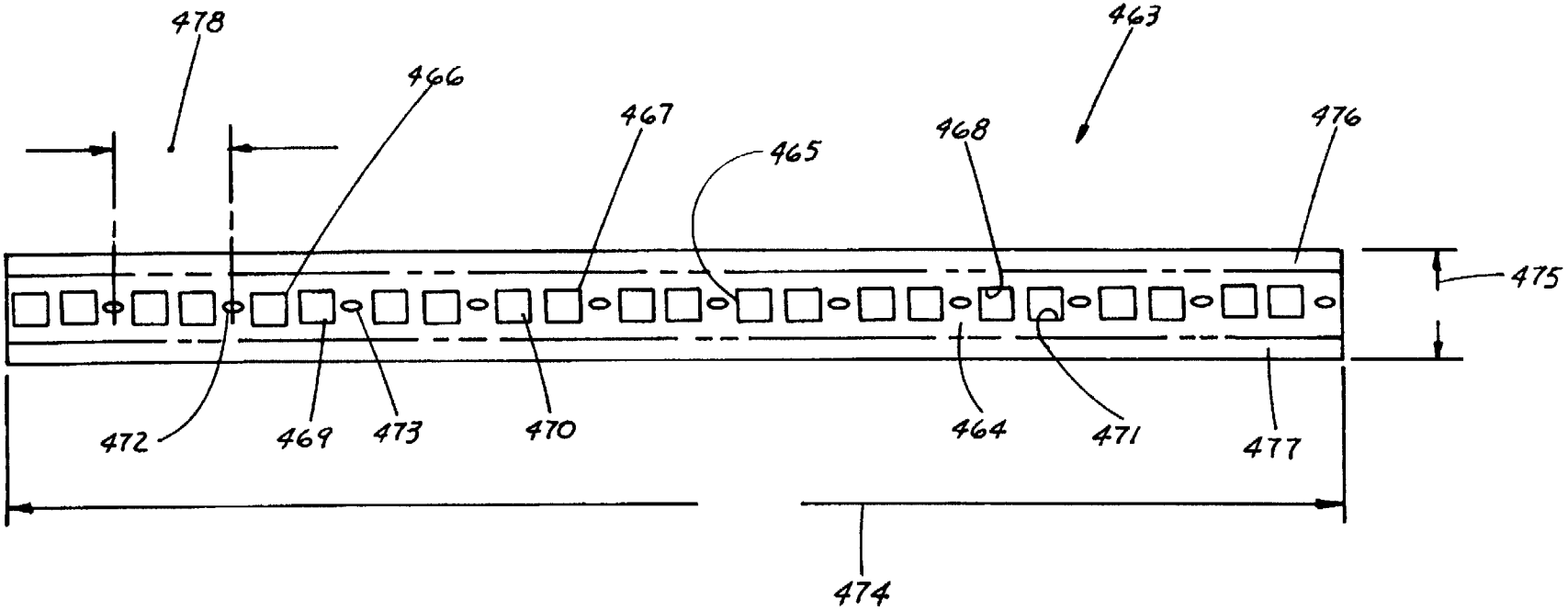
FIG. 41 is a plan view of the finger attachment device depicted in FIG. 40.

A somewhat modified version of this configuration is shown in FIG. 39, where a vehicle 392 is depicted having a cab 394, curb brush 395 and a hopper 396. The collection drum 397 is disposed forwardly of cab 394 and includes six rows, such as rows 398, 399 and 400, for example, of resilient fingers. A lower forward conveyor axle 401 is disposed rearwardly of the collector drum 397, the drum 397 having a diameter of approximately eight inches. Approximately twelve inches behind the forward axle 401 is the lower rear conveyor axle 402, which also has a diameter of approximately eight inches. The longitudinal axis 403 of collector drum 397, the longitudinal axis 404 of conveyor axle 401 and longitudinal axis 405 of conveyor axle 402 all reside within a plane which is substantially parallel to the horizontal road surface 72. The conveyor belt 406 extends on a path around the tandem conveyor axles 401 and 402 and extending to include upper conveyor axle 407. The upper conveyor axle 407 is the driven axle, and can operate at speeds as high as 400 rpm. This configuration is best suited for the collection of smaller or less dense materials which require higher speed operation of the collector 397 and the conveyor belt 406.

Figure 35:
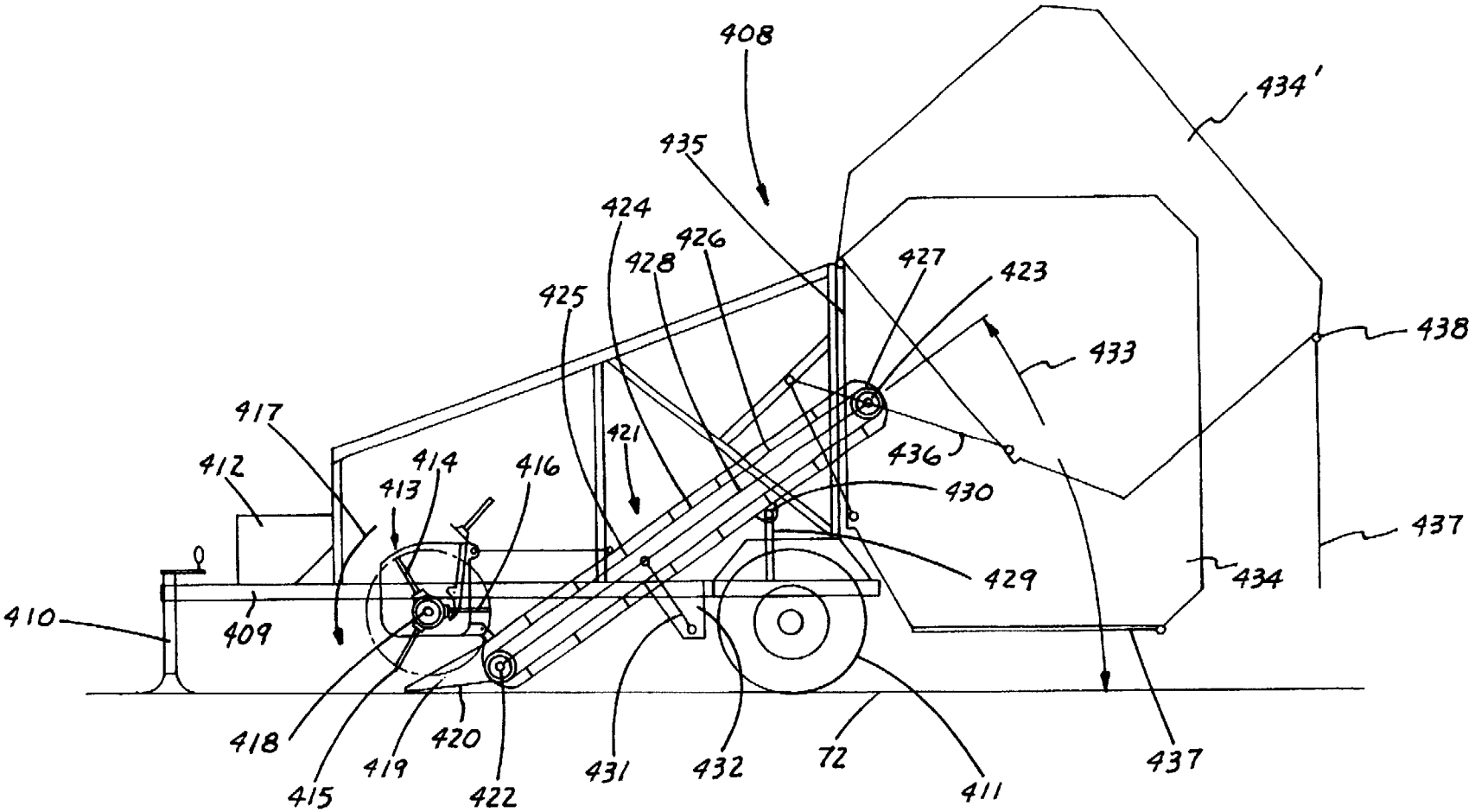
FIG. 35 is a left side elevation of a towable embodiment of the debris collection vehicle.

A fourth alternative embodiment of the present invention is disclosed with reference to FIG. 35. A tow behind vehicle 408 may be used in applications where a dedicated debris collection vehicle is not possible. The vehicle 408 includes a trailer 409 which is supported at its forward end by stand 410 and at its may be used in applications where a dedicated debris collection vehicle is not possible. The vehicle 408 includes a trailer 409 which is supported at its forward end by stand 410 and at its rearward end by tires 411. A motor may be mounted on the trailer within a suitable enclosure, such as housing 412, or hydraulic power may be derived from the parent vehicle (not shown). A forwardly mounted collector drum 413 includes three equally spaced rows 414, 415 and 416 of radially extending resilient fingers. The drum rotates at a rate of as much as 300 rpm in the direction indicated by arrow 417.

Positioned below and projecting somewhat forwardly of the longitudinal axis 418 of collector 413 is an entrainment chute or plate 419 which is positioned to engage or reside slightly above the road surface 72. Material collected by the collector 413 is directed into the chute 419. The bottom surface 420 of chute 419 is inclined at an angle of approximately ten degrees and joins a conveyor assembly 421 having a lower axle 422 and an upper axle 423. Travelling between the conveyor axles 422 and 423 is a continuous belt 424, upon which are mounted, for example, rows of cleats 425, 426 and 427.

A central frame member 428 supports the conveyor axles 422 and 423. The frame member 428 is pivotably mounted at pin 430 to a vertical member 429 which is rigidly affixed to the trailer 409. Hydraulic ram 431 extends between the central frame member 428 and element 432 the height of the frame member 428 may be decreased by retracting the ram 431 in the direction of 433. The inclination of the belt 424 may be necessary to permit improved transport of certain types of debris, or to promote even filling of the collection hopper 434.

In the collection mode, the hopper 434 is in the lower position depicted in FIG. 35. The front side 435 of the hopper 434 is open so as to permit the passage of collected debris. When the hopper 434 is to be emptied, it is raised to the position 434' by means of lever 436. A door 437 is formed into the bottom of the hopper 434 which is may be unfastened and permitted to open along hinge line 438. The collected debris can then exit the hopper by gravity.

Figure 36:
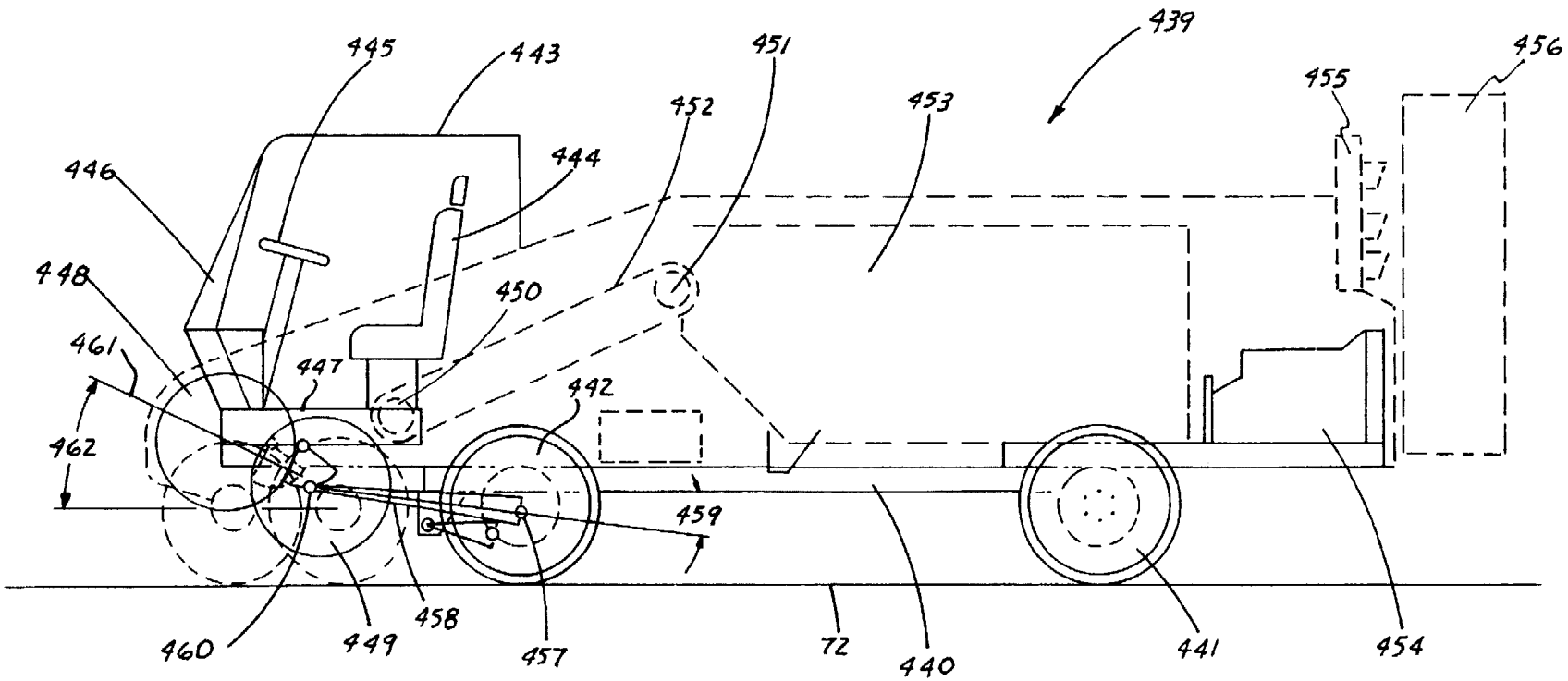
FIG. 36 is a left side elevation of an alternate embodiment of the debris collection vehicle utilizing a front and rear finger roller.

A fifth alternative embodiment of the present invention can be understood with reference to FIG. 36. The debris collection vehicle 439 is constructed to include a flatbed frame 440 which is supported by rear tires 441 and front tires 442. A motor 454 is mounted at the rear of the frame 440, above which is a light position board 455. Assuming that the vehicle 439 is in its transport, rather than debris collecting mode, the attenuator 456 is shown in the stowed orientation. A cab 443 is mounted so that at least a portion of it extends beyond the leading edge of the frame 440. A single operator/driver position 444 is provided within the cab, along with a conventional steering wheel 445 and a windshield 446 which extends to floor 447 of the cab 443.

Beneath the cab 443 is a front finger roller 448 which has a plurality of radially or near radially extending resilient fingers as utilized in the previously discussed embodiments. Immediately rearward of the front finger roller is a rear finger roller 449 of similar construction to roller 448. The fingers of the rear finger roller 449 are laterally offset from those of the front roller 448 so that the spacing between the rollers 448 and 449 can be less than the length of the fingers themselves. Again assuming that vehicle 439 is in the transport mode, the front and rear finger rollers 448 and 449 are shown with both raised to the limit of their upward travel. The rear roller is pivoted by lever arm 458 about the longitudinal axis 457 and can rotate through a maximum angle 459 of seven degrees. The front roller is pivotable via lever arm 461 about the longitudinal axis 460 and can rotate through a maximum angle 462 of approximately twenty five degrees. The upward deflection of rollers 448 and 449 can also be useful in "walking over" larger items that may be encountered without fouling the rollers.

Located at the approximate two o'clock position with respect to the rear finger roller 449 is the lower conveyor roller 450.

An upper conveyor roller 451 resides approximately four feet to the rear of and slightly above the lower roller 450. conveyor belt 452 extends between the rollers 450 and 451. The conveyor belt 453 is inclined at an angle of approximately twenty degrees, the highest region of the belt being adjacent to an opening in the collection hopper 453.

Figure 3:
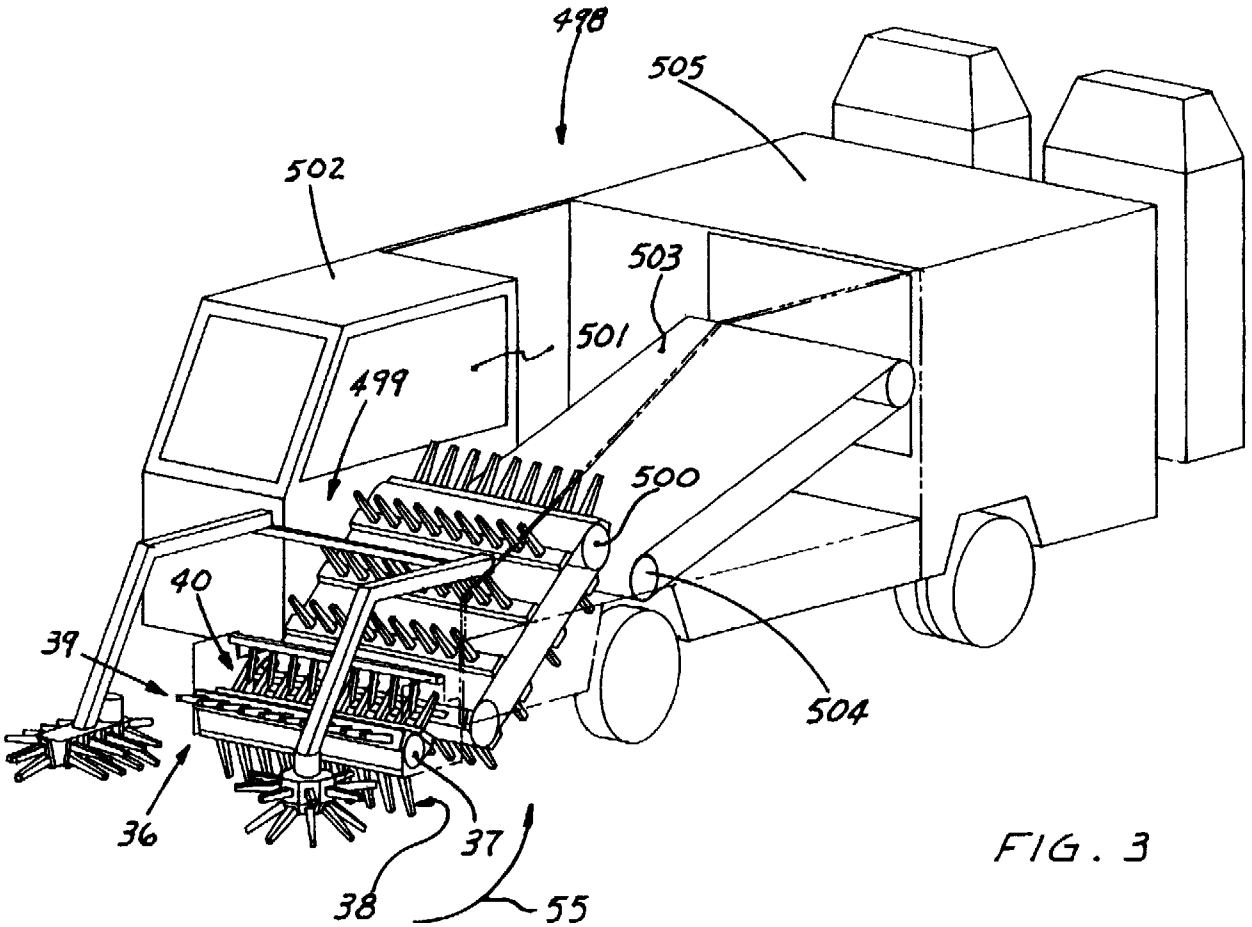
FIG. 3 is a perspective view of a second embodiment of a debris collection vehicle having multiple conveyors.

A sixth alternative embodiment of the invention is shown in FIG. 3, where the vehicle 498 utilizes the previously discussed collection drum 36. Immediately behind the drum 36 is a first conveyor 499 which is inclined at an angle of approximately forty five degrees to a horizontal plane. The upper conveyor axle 500 is positioned forward of and below the rear region 501 of cab 502, thereby permitting the entire length of the conveyor 499 to be viewed by the operator (not shown). A second conveyor 503 is located behind the first conveyor 499. The lower support axle 504 is approximately one foot below and behind the first conveyor upper support 500, thereby permitting debris on the first conveyor 499 to drop onto the conveyor 503. The second conveyor 503 may be operated without cleats or fingers since it is inclined at a relatively shallow angle on the order of twenty degrees. The second conveyor discharges the debris into a rearwardly mounted hopper 505.

Referring now to FIGS. 40–43, one can appreciate the specific mounting arrangements by which the previously discussed fingers and cleats are mounted to the various finger rollers and conveyors. First, one can appreciate that the fingers may be mounted in a variety of combinations, such as in evenly spaced rows, in pairs, or in other groupings. The only requirement is that the fingers be laterally offset from the adjacent fingers of the other roller or conveyor so as to permit the fingers to pass by each other without interference. With that in mind, the basic piece of finger mounting hardware is rail 463, which is formed to include a substantially planar finger retaining surface 464 having a width of approximately 2.80 inches. Centrally located about the longitudinal axis 465 of surface 464 are a plurality of substantially square openings such as openings 466, 467 and 468, for example. The dimension of each square 466 is approximately 1.50 inches. In order to provide versatility in the mounting arrangement of the fingers, each opening 466 is paired with an adjacent square opening such as openings 469, 470 and 471, respectively. The closest distance between adjacent square openings 466 and 469 is approximately 0.50 inches. When mounted on a collector roller, a finger can be inserted in every opening 469, 470, etc., or in any lesser number that may be desired. For example, the collection of a particularly large and uniform type of debris may require the use of relatively few fingers, while the typical variety of highway debris encountered may require the use of as many fingers as possible, hence filling all of the square openings.

Surrounding each pair of openings 466 and 469, for example, are a pair of elongated slots 472 and 473, for example. The slots are approximately 0.53 inches wide and 0.75 inches long, the extra length permitting the slight lateral adjustment of the rail 463 when mounted on a roller. Steel bolts are inserted directly through the slots 472 and extend through the steel surface of the roller, thereby holding the rail rigidly in place. Assuming a typical rail length 474 of fifty nine inches, the spacing 478 between the centers of the slots 472, 473, etc. is approximately 5.344 inches. The rail width 475 is approximately 4.85 inches. The planar surface 464 of the rail 463 is bordered by a pair of flanges 476 and 477, each extending outwardly for a distance 479 of approximately 1.125 inches. Each flange 476, 477 forms an angle 480 of approximately eighty two degrees with the planar surface 464. The rail 463 itself is formed of eleven or twelve gauge steel. The rail 463 may be mounted on a flexible conveyor belt by the use of a suitable backing plate (not shown).

Figure 42:
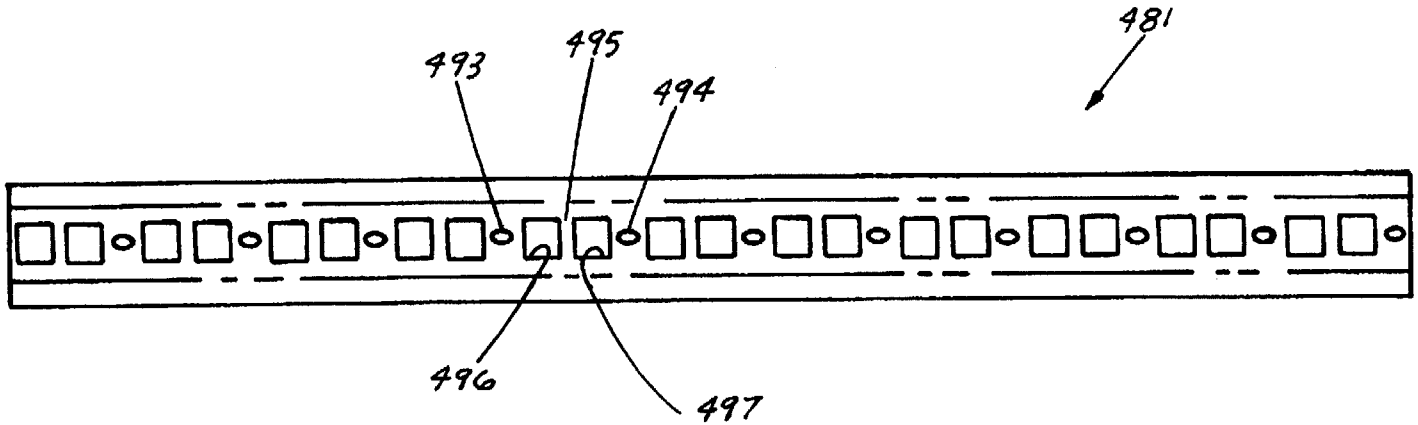
FIG. 42 is a plan view of a cleat attachment device used in an alternate embodiment of the debris collection vehicle.
Figure 43:
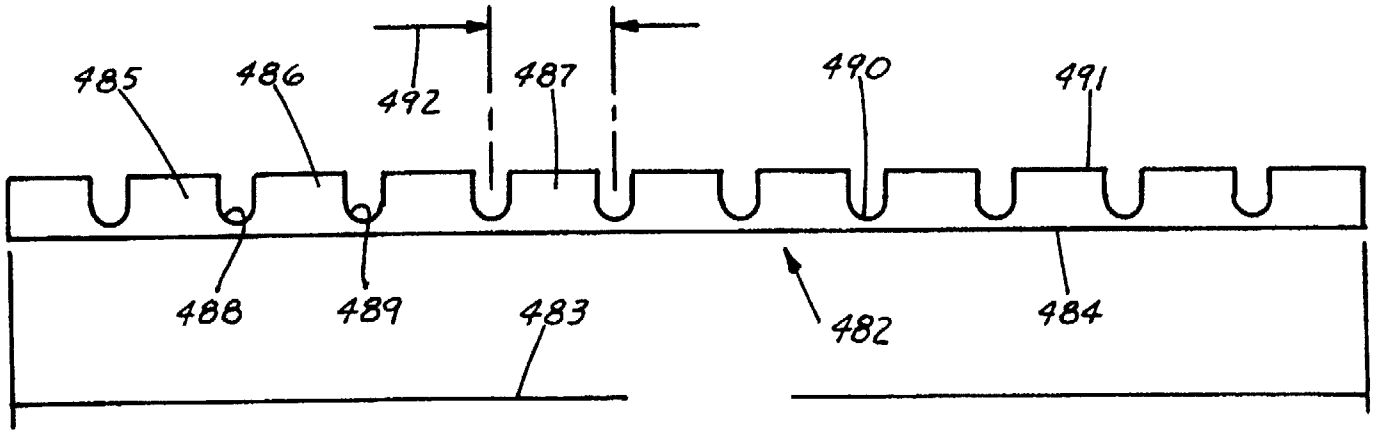
FIG. 43 is a front elevation of a cleat used in conjunction with the attachment depicted in FIG. 42.
Figure 44:
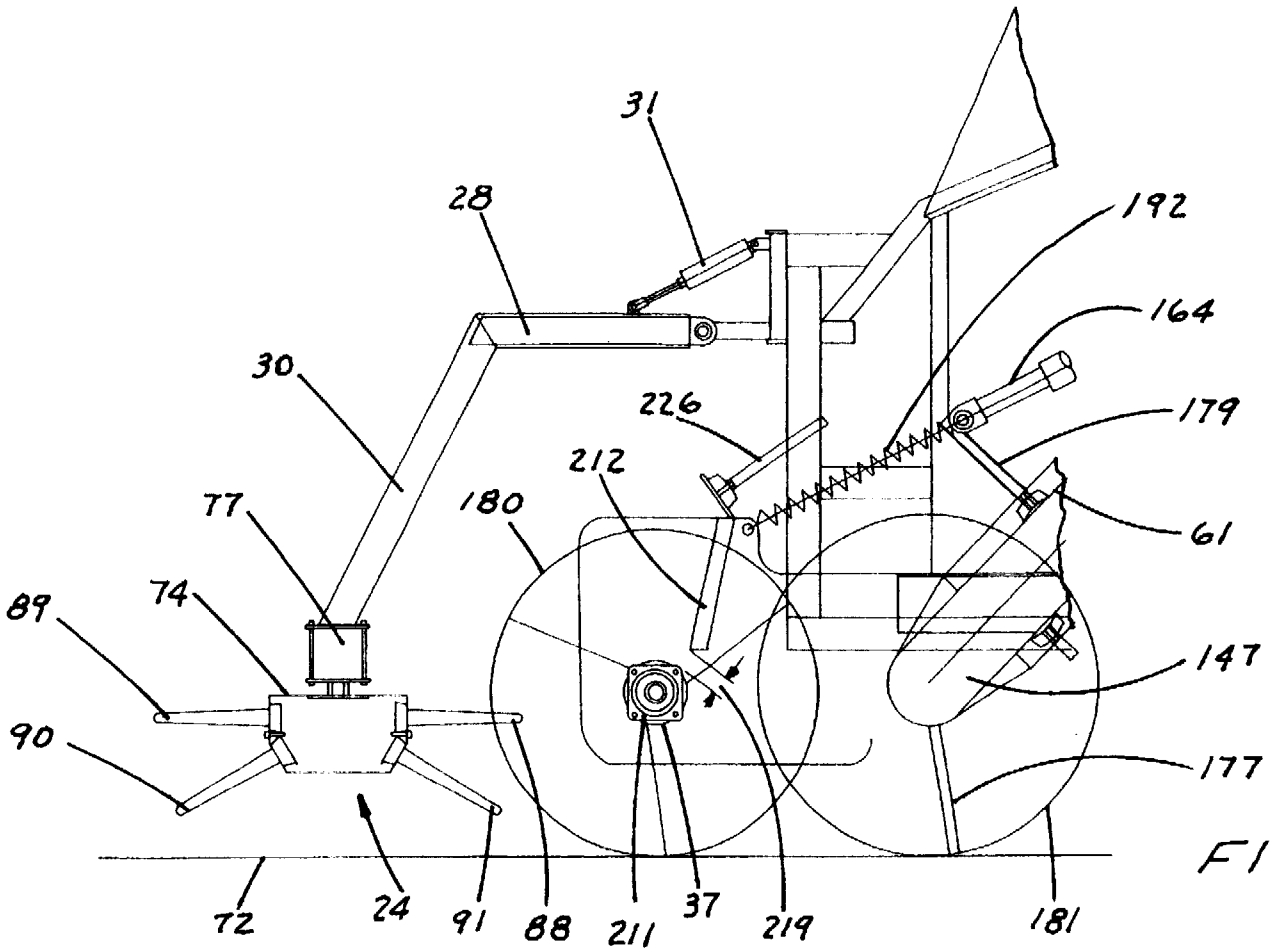
FIG. 44 is a side elevation of the debris collection vehicle depicted in FIG. 38 showing details of the curb brush construction.

As earlier discussed, cleats may be used instead of the rubber fingers. As seen in FIGS. 42 and 43, a modified rail 481 may be used for mounting cleats. The cleat 482 is formed as an integral unit and is typically composed of a rubber material having a durometer of approximately forty. The length 483 of the cleat 482 is approximately fifty seven inches. The cleat 482 has a continuous bottom surface 484 from which extend uniformly spaced pillars 485, 487 and 487, for example. Each pillar resides between a pair of grooves 488 and 489, for example. The bottom surface 490 of each groove 488, 489, etc. is approximately 0.5 inch above the bottom surface 484 of the cleat 482. The upper surface 491 of each pillar is approximately 2.50 inches above the cleat bottom surface 484. The spacing 492 between adjacent grooves 488 and 489 is approximately 5.344 inches, which corresponds to the distance between adjacent rail slots 493 and 494, for example. Further, by removing the material 495 which resides between the paired square rail openings 496 and 497, for example, the pillar 487 will fit through the newly enlarged opening. Thus, a bolt (not shown) may be inserted through the each slot 493, for example, and through the bottom 490 of each groove. The bolt may then pass through a suitable backing plate on a conveyor belt, thereby securing the cleat 482 to the belt.

Commercially Preferred Embodiment

Figure 53:
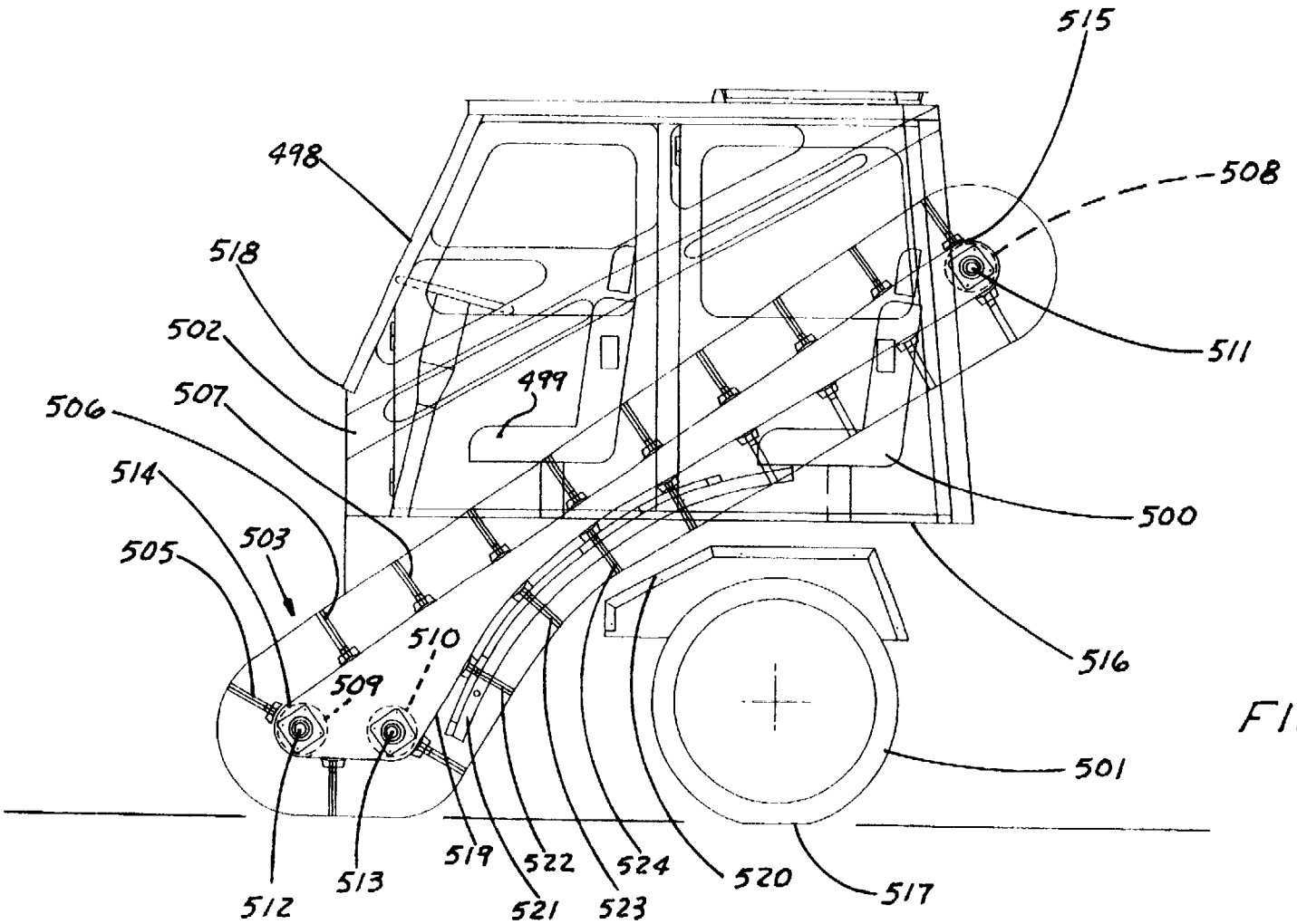
FIG. 53 is a side elevation of a portion of the preferred commercial embodiment of the present invention utilizing a dual conveyor front roller configuration.

Illustrated in FIG. 53 is an embodiment of the invention which is thought to be a particularly advantageous arrangement for commercial applications. This embodiment is similar in many respects to the versions depicted in FIGS. 38 and 39, sharing with those embodiments the basic concept of a conveyor belt having dual front rollers. In FIG. 53 the cab 498 includes driver seat 499 and observer position 500. One of the vehicle wheels 501 is positioned beneath the operator position 500. The assembly 503 includes a belt 504 to which are affixed approximately twenty rows 505, 506 and 507, for example, of fingers such as the fingers 41 depicted in FIGS. 8 and 9. Ideally, the fingers have a length of approximately eight inches. The conveyor belt 504 is supported at its upper end by a cylindrical drum or roller 508 having a diameter of approximately eight inches. The roller 508 is powered by hydraulic motor 511.

At the lower end of the belt 504, a first roller 509 is mounted approximately one foot from an adjacent second roller 510. The belt is tangent to first roller 509 at point 514 and is also tangent to upper roller 508 at point 515. The belt 504 extends in a substantially straight line between points 514 and 515, being inclined with respect to the lower edge 516 of cab 498 at an angle of approximately thirty degrees. This configuration has the advantage of eliminating the complexity of intermediate supports for the belt 504 between the upper roller 508 and the lower roller 509, as well as simplifying the path to be followed by any collected debris travelling along the belt 504.

Further, the belt 504 is inclined with respect to the road surface 517 at a relatively shallow angle along its entire length. This is accomplished partly by lengthening the belt 504 and locating lower roller 509 so as to be completely forward of the forwardmost point 518 of cab 498. In order to provide adequate clearance between the lower portion 519 of belt 504 and the wheel well 520, which would otherwise be a problem when using this particular belt/dual front roller geometry, a novel belt deflection channel 521 is utilized. The belt deflection channel 521 could be formed as a plate or series of longitudinal strips that are arranged to span substantially the entire width of the belt 504, but preferably the channel is formed by curved angle irons on each side of the belt. Slots of spaces are provided wihin the structure 521 to permit the fingers 522, 523 and 524, for example, to pass through or by the deflection channel 521 without interference.

Figure 54:
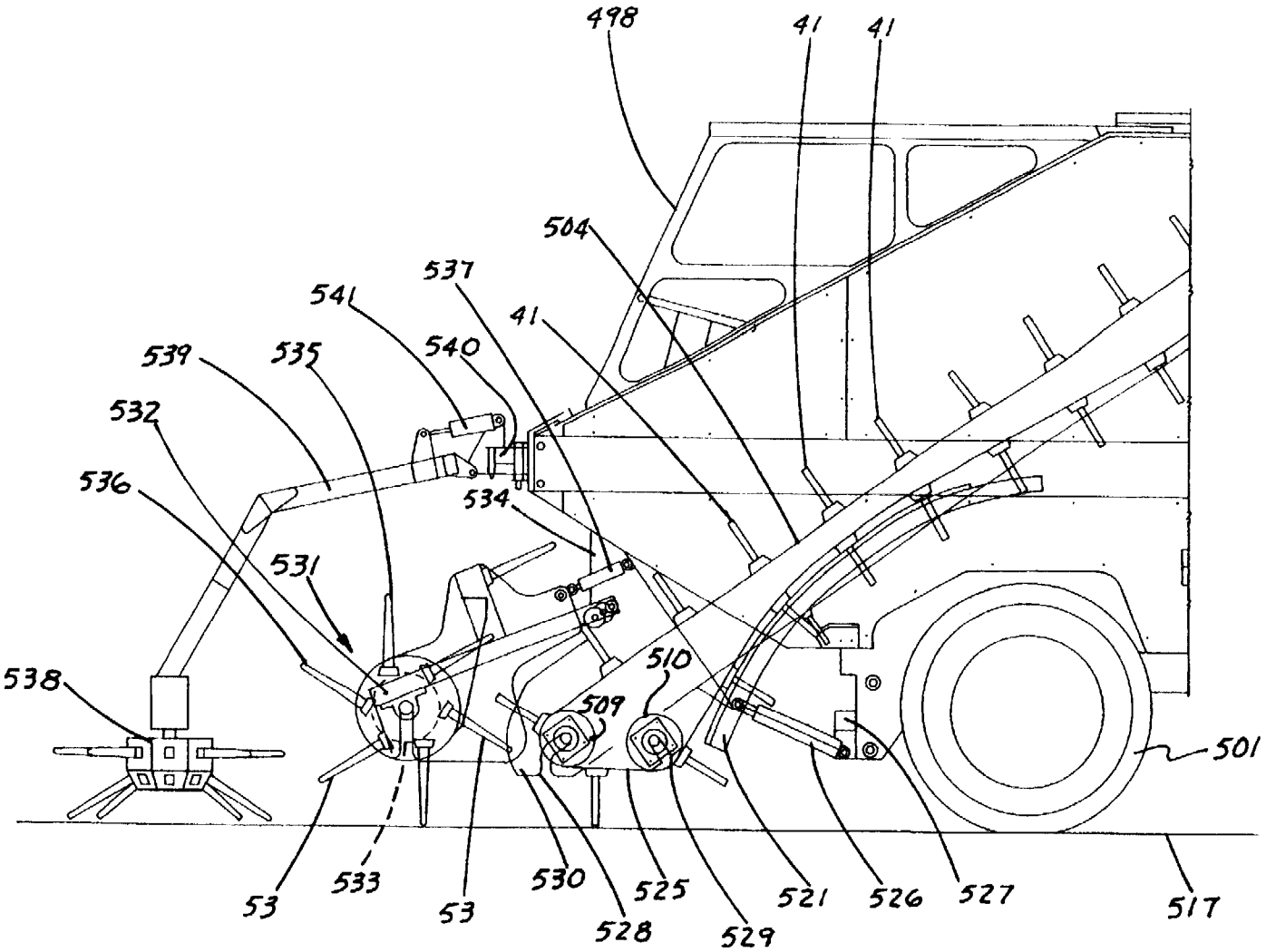
FIG. 54 is a side elevation of the device depicted in FIG. 53 showing details of the collector roller construction.

Referring now to FIG. 54, additional functional details of this arrangement can be appreciated. Several structural features are provided to permit adjustment of the tension of belt 504 and to vary the clarance between the lowest portion 525 of belt 504 and the road surface 517. First, an hydraulic ram 526 extends between the conveyor frame and the vehicle frame bracket 527.

A pivotable collector roller assembly 531 is mounted forwardly of the forwardmost conveyor roller 509. A support member 532 is interconnected between collector roller 533 and the conveyor frame. Six rows, including rows 535 and 536, for example, of fingers are spaced along the perimeter of roller 533. The roller 533 is approximately ten inches in diameter. The fingers are approximately twelve inches long and are similar to the fingers 53 depicted in FIGS. 10 and 11. The fingers 53 are inclined at an angle of approximately thirty degrees to a line normal to the surface of collector roller 533. A hydraulic cylinder 537 permits controls the elevation and orientation of the collector roller 533 with respect to the foward conveyor roller 509. A curb brush 538 is also mounted to the vehicle by means of pivotable arm 539. The arm 539 is rotated by hydraulic cylinder 540 and elevated by cylinder 541.

Figure 55:
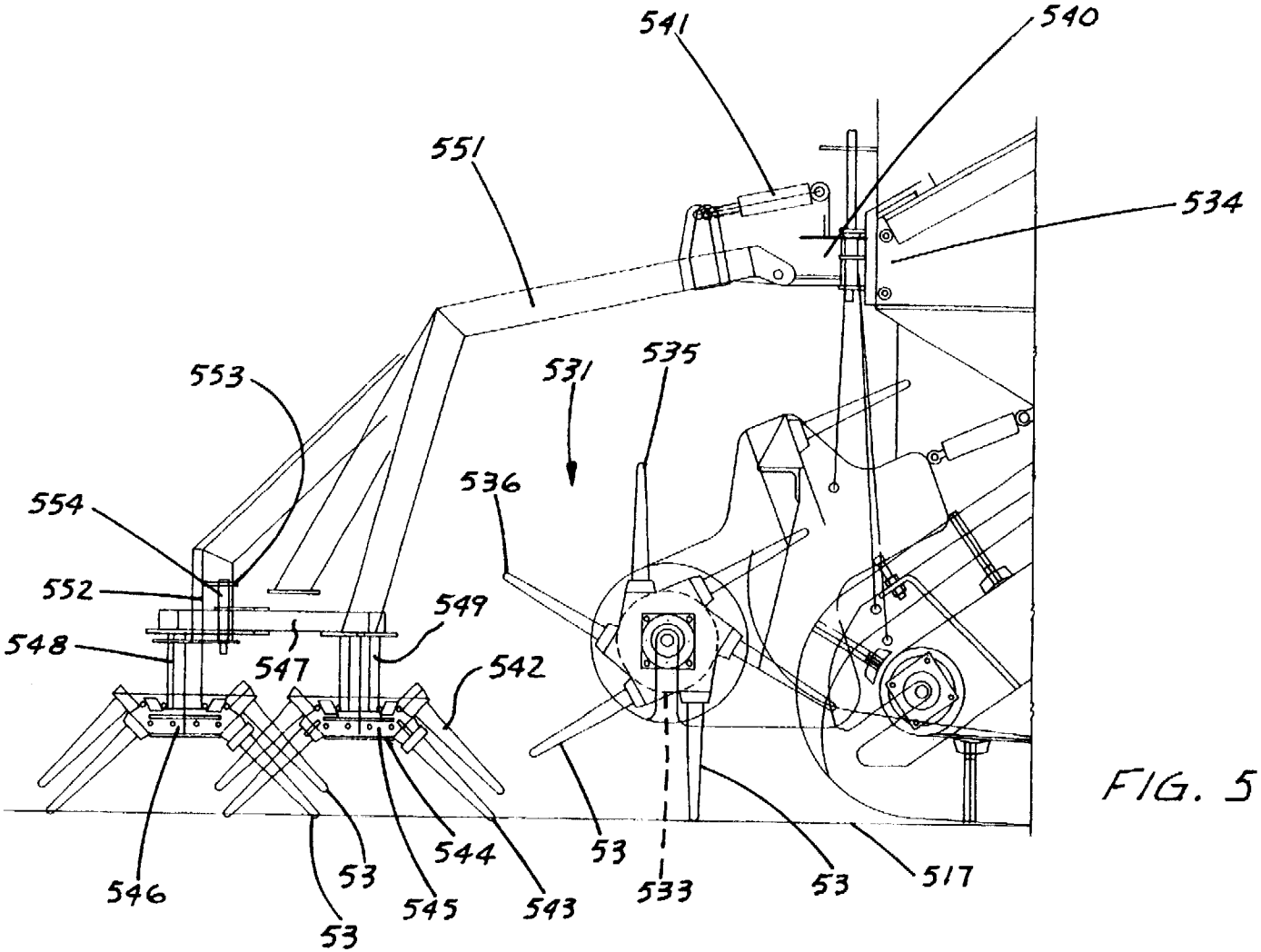
FIG. 55 is a side elevation of an alternative embodiment of the device shown in FIG. 54.
Figure 56:
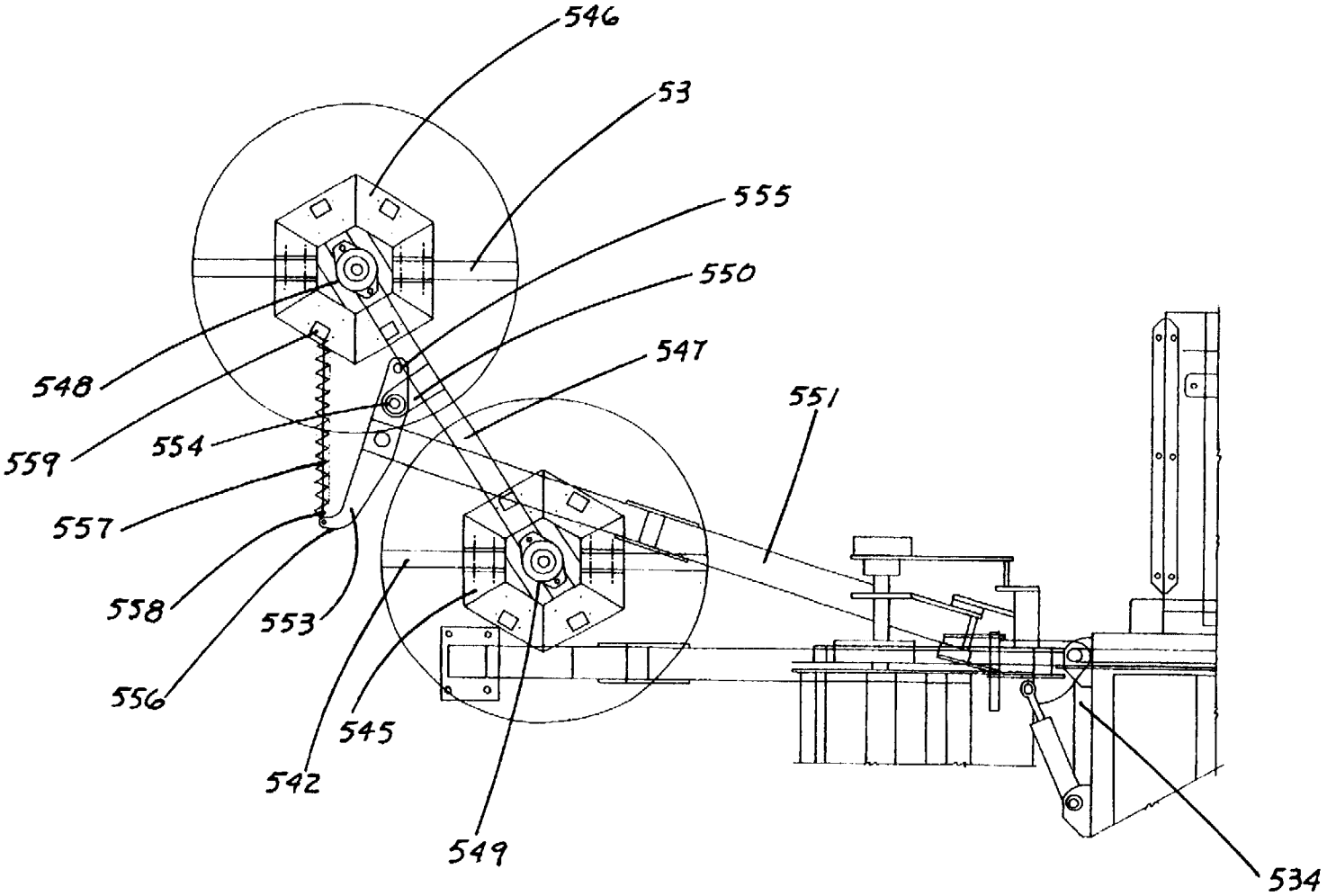
FIG. 56 is a plan view of the alternative right side curb brush depicted in FIG. 55.

An alternate type and arrangement of curb brush is depicted in FIGS. 55 and 56. First, the curb brush is formed to include an upper row 542 of rubber fingers and a lower row 543 or rubber fingers. Each row includes approximately eight fingers of the type used on collector roller 533. Further, each finger 53 is inclined at an angle of approximatley forty five degrees with respect to the lower edge 544 of brush housing 545.

In the preferred embodiment, a first brush housing 545 is interconnected to a substantially identical second brush housing 546 by means of linking member 547. Each brush is driven by an independent hydraulic motor 548 and 549, respectively. Extending from member 547 is bracket 550. A support arm 551 extends from vehicle frame 534 and is manipulated by means of hydraulic cylinder 540 and hydraulic cylinder 541. The lower end 552 of arm 551 terminates at a bracket 553. The bracket 553 receives a pin 554 which also passes through the brush linking member 547, the brush linking member being free to pivot about pin 554 until encountering stop 555. Bracket 553 also includes a tip portion 556 adapted to retain one end 558 of a biasing spring 557. The opposite end 559 of biasing spring 557 is attached to the brush linking member 547. In this manner, the tandem brush combination formed by brushes 545 and 546 is free to deflect in reaction to the encountering of rigid obstacles but maintains its general orientation so as to permit the vehicle operator to manipulate the curb brush assembly as required in order to reach otherwise inaccessible roadside debris. One understands that changes may be made in the specific construction and arrangement of the various parts described without departing from the sphere and scope of the invention as expressed in the following claims.

We claim:

1. A debris collection vehicle comprising:

(a) a chassis;

(b) a prime mover mounted on the chassis;

(c) a cab, the cab being mounted on a forward region of the chassis;

(d) a first conveyor, the first conveyor being mounted laterally adjacent to the cab such that a majority of the first conveyor resides in a volume defined by a lateral projection of the cab, the first conveyor comprising:

(i) a lower support axle;

(ii) an upper support axle, at least a portion of the upper support axle residing within the volume defined by a lateral projection of the cab;

(iii) a continuous belt, the belt following a path extending between the lower support axle and the upper support axle;

(e) a second conveyor, the second conveyor having a lower support axle and an upper support axle, the lower support axle residing beneath and behind the upper support axle of the first conveyor; and (f) a first curb brush, the curb brush being pivotably mounted to the chassis, the curb brush being adapted to direct debris toward the first conveyor, the curb brush further comprising:

(i) a housing, the housing being formed with an octagonal upper portion and an octagonal lower portion, each octagonal portion being formed of eight wall segments;

(ii) an hydraulic motor, the hydraulic motor being pivotably affixed to the octagonal upper portion of the housing, the hydraulic motor causing the housing to rotate;

(iii) a single rubber finger extending outwardly from each wall segment, each rubber finger mounted on the octagonal lower portion of the housing being inclined with respect to each rubber finger mounted on the upper octagonal portion of the housing.

2. The debris collection vehicle of claim 1, further comprising a collection drum, the collection drum being adapted to direct debris toward the first conveyor, the collection drum being separated from the lower support axle of the first conveyor by a first distance.

3. The debris collection vehicle of claim 2, wherein the collection drum further comprises:

(a) a substantially cylindrical housing, the housing having a longitudinal axis; and (b) at least one row of resilient fingers extending outwardly from the housing, the row being substantially parallel to the longitudinal axis of the housing.

4. The debris collection vehicle of claim 3, wherein each resilient finger comprises:

(a) a concave base portion, the concave base portion being adapted to abut the cylindrical housing of the collection drum; and (b) an elongated portion, the elongated portion having a relatively wide end that joins the concave base, the elongated portion having a relatively narrow end opposite the wide end.

5. The debris collection vehicle of claim 4, wherein each resilient finger is mounted to the collection drum at an angle that is offset from a radial line by at least ten degrees.

6. The debris collection vehicle of claim 5, further comprising a distance adjustment bracket, the distance adjustment bracket permitting the first-distance between the collection drum and the lower support axle of the first conveyor to be varied by an operator within the cab.

7. The debris collection vehicle of claim 6, further comprising a biasing mechanism, the biasing mechanism extending between the vehicle chassis and the collection drum and being adapted to urge the collection drum in an upward direction.

8. A debris collection device, comprising:

(a) a chassis;

(b) a prime mover;

(c) a first collection drum, the collection drum being cooperatively connected to the chassis, the first collection drum having a perimeter;

(d) a second collection drum, the second collection drum being cooperatively connected to the chassis, the second collection drum being in a tandem relationship with the first collection drum;

(e) at least one first end plate, the first end plate being pivotably affixed to the first collection drum, the first end plate being formed to include at least one guidepiece extending therefrom;

(f) at least one second end plate, the second end plate being pivotable affixed to the second collection drum, the second end plate being formed to include a slot adapted to slidably receive the guidepiece of the first end plate; and (g) at least one hydraulic ram, the hydraulic ram having a first end affixed to the first end plate and a second end affixed to the second end plate, the hydraulic ram thereby permitting adjustment of a distance between the first and second collection drums along a path definded by the slot of the second end plate.

9. The debris collection device of claim 8, further comprising a first deflection bar, the first deflection bar being formed so as to have a curved outer surface, the curved outer surface surrounding at least ninety degrees of the perimeter of the first collection drum.

10. The debris collection device of claim 9, wherein the curved outer surface of the first deflection bar follows a path defined by Archimedes' curve, the outer surface having a first end residing on a radius extending from the first collection drum at an angle in the range of 60° to 70° from a substantially horizontal line.

11. The debris collection device of claim 10, further comprising a conveyor belt, the conveyor belt being cooperatively connected to the chassis and positioned to transport debris collected by at least one of the collection drums, the conveyor belt having a first section and a second section, the first section being inclined at a first angle with respect to a horizontal line, the second section being inclined at a second angle with respect to a horizontal line.

12. The debris collection device of claim 11, further comprising a hopper, the hopper being positioned to intercept material transported by the conveyor belt.

13. The debris collection device of claim 12, further comprising an elongated curb brush, the elongated curb brush being cooperatively connected to the chassis, the elongated curb brush being formed to include at least two rows of resilient fingers.

* * * * *